US010954744B2

(12) United States Patent
Skeels et al.

(10) Patent No.: US 10,954,744 B2
(45) Date of Patent: Mar. 23, 2021

(54) PLUG AND ABANDONMENT SYSTEM FOR FORMING AN UPPER PLUG WHEN ABANDONING AN OIL AND GAS WELL

(71) Applicant: FMC Technologies, Inc., Houston, TX (US)

(72) Inventors: Harold Brian Skeels, Kingwood, TX (US); Ole Eddie Karlsen, Houston, TX (US); Luis Felipe de Barros Mendes, Fulshear, TX (US); Vidar Sten-Halvorsen, Kongsberg (NO)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/637,164

(22) PCT Filed: Aug. 11, 2017

(86) PCT No.: PCT/US2017/046465
§ 371 (c)(1),
(2) Date: Feb. 6, 2020

(87) PCT Pub. No.: WO2019/032116
PCT Pub. Date: Feb. 14, 2019

(65) Prior Publication Data

US 2020/0165896 A1 May 28, 2020

(51) Int. Cl.
*E21B 33/13* (2006.01)
*E21B 29/00* (2006.01)
(Continued)

(52) U.S. Cl.
CPC ..... *E21B 33/13* (2013.01); *E21B 29/002* (2013.01); *E21B 29/06* (2013.01); *E21B 33/12* (2013.01);
(Continued)

(58) Field of Classification Search
CPC ..... E21B 43/116; E21B 33/12; E21B 17/06; E21B 17/023; E21B 33/13; E21B 34/02
See application file for complete search history.

(56) References Cited

U.S. PATENT DOCUMENTS 4,595,063 A 6/1986 Jennings et al.
6,640,902 B2 11/2003 Baten et al.
(Continued)

FOREIGN PATENT DOCUMENTS

WO 2012/057631 A1 5/2012
WO 2017031464 A1 2/2017

OTHER PUBLICATIONS

International Search Report and Written Opinion dated Jul. 24, 2018 for PCT/US2017/046465.
(Continued)

*Primary Examiner* — Zakiya W Bates
(74) *Attorney, Agent, or Firm* — Osha Bergman Watanabe & Burton LLP

(57) ABSTRACT

A system for forming an upper plug in a well, the system, comprising lower tool segment that is adapted to land within a wellhead housing under open water conditions, a well control package that is adapted to be positioned above the lower segment and coupled to the wellhead housing, the well control package comprising at least one seal ram, an upper tool segment that is adapted to be positioned through the well control package (i.e., after the well control package has been attached to the wellhead) and operatively coupled to the lower tool segment, wherein at least one seal ram of the well control package is adapted to engage an outer surface of the upper tool segment, and at least one cutting means that is coupled to the lower segment and adapted to be actuated to cut at least one opening in at least one section of casing within the well.

34 Claims, 49 Drawing Sheets

(51) Int. Cl.

| | |
|---|---|
| ***E21B 33/12*** | (2006.01) |
| ***E21B 33/129*** | (2006.01) |
| ***E21B 43/116*** | (2006.01) |
| ***E21B 29/06*** | (2006.01) |
| ***E21B 43/1185*** | (2006.01) |

(52) U.S. Cl.
CPC ..... *E21B 43/1185* (2013.01); *E21B 33/1293* (2013.01)

(56) References Cited

U.S. PATENT DOCUMENTS

| | | | |
|---|---|---|---|
| 8,584,756 | B1 | 11/2013 | Barlow et al. |
| 9,488,024 | B2 | 11/2016 | Hoffman et al. |
| 9,587,466 | B2 | 3/2017 | Burguieres et al. |
| 2013/0269948 | A1 | 10/2013 | Hoffman et al. |
| 2014/0138078 | A1 | 5/2014 | Lerbrekk et al. |
| 2016/0237779 | A1 | 8/2016 | Husby et al. |

OTHER PUBLICATIONS

David Bizley, "Subsea P&A | Energy Global," May 7, 2015, pp. 1-12, retrieved from the Internet: URL:https://ww.energyglobal.com/upstream/special-reports/07052015/subsea-panda/.

Buckman et al., "A new approach to drilling," Oilfield Technology, Aug. 2013.

Product Data Sheet—Bend Restrictor, Seacon Universal Joint Bend Restrictor Connector, Mar. 2013.

David Bizley, "Subsea P&A | Energy Global," May 7, 2015, pp. 1-12, retrieved from the Internet site https://www.oilfieldtechnology.com/special-reports/07052015/subsea-panda/ on Aug. 19, 2020—color version.

Fig. 30
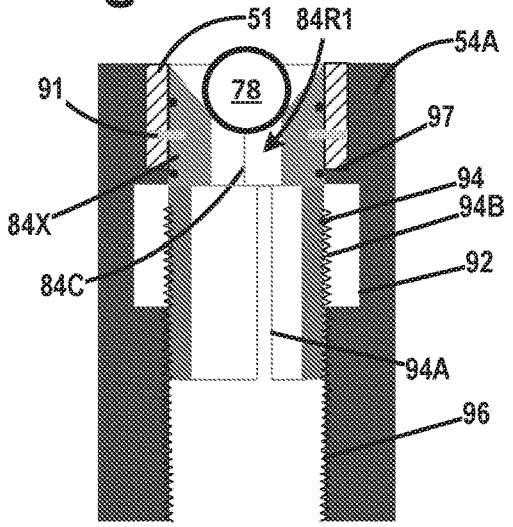
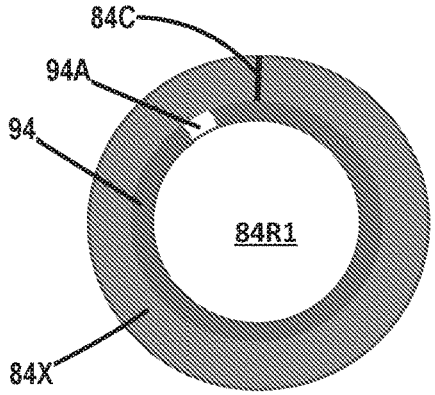
Fig. 33
Fig. 31
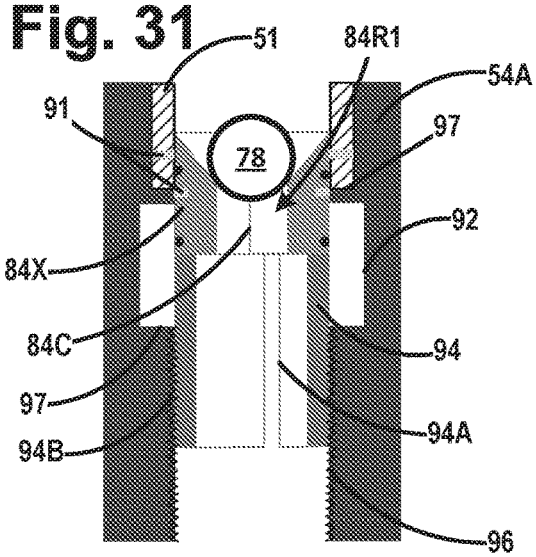
Fig. 32
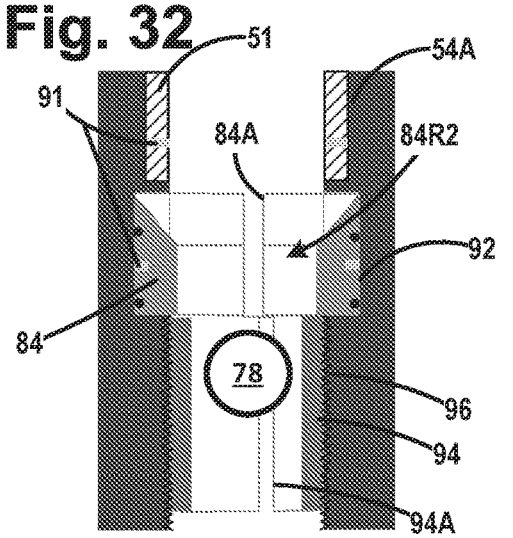
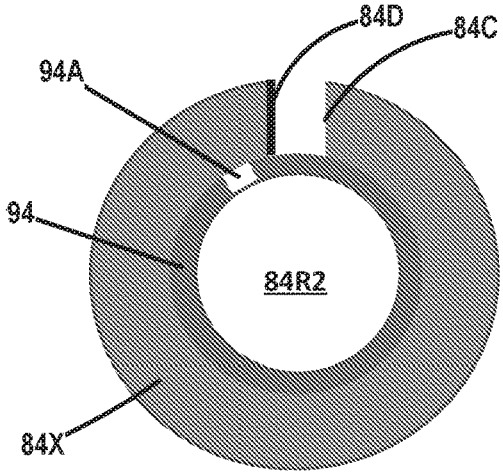
Fig. 34

PLUG AND ABANDONMENT SYSTEM FOR FORMING AN UPPER PLUG WHEN ABANDONING AN OIL AND GAS WELL

TECHNICAL FIELD

The present disclosed subject mailer generally relates a plug and abandonment system for forming an upper plug when abandoning an oil and gas well.

BACKGROUND

FIG. 1 is a simplistic cross-sectional depiction of a prior art cased and cemented subsea well 200. The sea floor or "mud line" is indicated by the reference numeral 202. In general, in one illustrative example, the cased well 200 comprises outermost conductor casing 204, surface casing 206, intermediate casing 208 and production casing 210. These sections of casing typically comprise several joints of pipe that are threaded to one another. Also depicted in FIG. 1 is production tubing 211 that is positioned within the production casing 210.

The basic structure of the well 200 in terms of the various sections of casing and how they are installed are well known to people skilled in the art. As one simplistic example, the conductor casing 204 may be driven or jetted into the sea floor 202 (or alternatively a spud hole may be drilled into the sea floor) and thereafter cemented in place as indicated by the cement column 212A. The conductor casing 204 typically includes a subsea low-pressure housing (not shown) that is positioned above the sea floor 202. Thereafter, an initial hole or well bore that is sized (in terms of diameter and depth) to accommodate the surface casing 206 is drilled into subsea floor through the conductor casing 204. The surface casing 206 is thereafter lowered into the well bore and cemented in position as indicated by the cement column 212B. The surface casing 206 typically includes a subsea high-pressure wellhead housing (not shown) that is positioned above the subsea floor 202. The high-pressure wellhead housing is adapted to land within the low-pressure housing on the conductor casing 204. Once the surface casing 206 has been set and cemented in place, additional drilling is performed through the surface casing 206 to further extend the depth of the well by drilling a hole that is sized (in terms of diameter and depth) to accommodate the intermediate casing 208. The intermediate casing 208 may then be lowered into the well bore and cemented in position as indicated by the cement column 212C. The intermediate casing 208 typically includes a casing hanger (not shown) that lands in and engages the inside of the high-pressure well head housing on the surface casing 206. Accordingly, the weight of the intermediate casing 208 is suspended from the high-pressure wellhead housing. Once the intermediate casing 208 has been set and cemented in place, additional drilling is performed through the intermediate casing 208 to further extend the depth of the well by drilling a hole that is sized (in terms of diameter and depth) to accommodate the production casing 210. The depth of the well at this point typically corresponds to the final depth of the well which is targeted based upon the depth and location of hydrocarbon-containing formations. The production casing 210 may then be lowered into the well bore and cemented in position as indicated by the cement column 212D. The production casing 210 typically includes a casing hanger (not shown) that lands in and engages the inside of the high-pressure well head housing on the surface casing 206. Accordingly, the weight of the production casing 210 is suspended from the high-pressure wellhead housing. The production tubing 211 is then positioned within the production casings 210. The production tubing 211 has a tubing hanger (not shown) at its upper end and a subsea packer in the bottom end. For a well that uses a so-called vertical production tree, the tubing hanger lands in the wellhead. For a well that uses a so-called horizontal production tree, the tubing hanger lands within the production tree.

Thereafter, various actions are taken to "complete" the well such that hydrocarbon-containing fluid, e.g., oil and/or gas, may be produced through the well. For example, perforations will be formed in the production casings 210 and the cement column 212D at the location of the hydrocarbon-containing formation, a production tree (not shown) will be installed on the well head housing, etc. The well 200 may produce commercially significant quantities of hydrocarbon-containing fluids for many years or even decades. However, at some point in time, the well may outlive its commercially useful life and must be abandoned. The operations that are undertaken to abandon a well are sometimes referred to as "plugging and abandoning (P&A)" a well or simply "plugging" a well. Plugging or abandoning a well involves sealing off and isolating one or more hydrocarbon or pressure bearing geological formations using two or more plugs that are formed within the well. Typically these plugs have been traditionally made of cement, but in more recent years plugs comprised of resin based plugging materials have been recognized and accepted within the industry. The plugs may vary in size, both in terms of diameter and height, depending upon the particular application and any local rules and regulations. For example, some jurisdictions establish a minimum height of the plug as being about 50-150 meters.

The abandonment of oil and gas wells is governed by many rules and regulations established by various governmental agencies worldwide. In general, one goal of such rules is, to the extent practicable, create barriers similar in to previous geological barriers so as to prevent any flow of formation fluids from one zone to another zone, or any flow of formation fluids to an external environment, e.g., into the ocean. For example, such rules and regulation may require that the well must by plugged and abandoned in such a manner that, so far as reasonably practicable, there will be no unplanned escape of fluids from the abandoned well and that the risks to the health and safety of persons from the abandoned well itself, any thing from the abandoned well or in any connected strata are as low as is reasonably possible. There are differing recommended practices for the abandonment of wells of differing complexities and structures, and there are several techniques for forming such plugs, see, e.g., U.S. Pat. Nos. 9,488,024 and 8,584,756 and US Published Patent Application 2014/0138078.

With reference to FIG. 1, the various sections of casing and the production tubing 211 define various annuli. More specifically, the annulus between the production tubing 211 and the production casing 210 is typically referred to as the "A" annulus; the annulus between the production casing 210 and the intermediate casing 208 is typically referred to as the "B" annulus; the annulus between the intermediate casing 208 and the surface casing 206 is typically referred to as the "C" annulus; and the annulus between the surface casing 206 and the conductor casing 204 is typically referred to as the "D" annulus. Typically, for subsea wells, most regulatory authorities (e.g., in the United States and Norway) require a permanent well barrier be formed in the well to properly abandon a well. To qualify: as a permanent well barrier, the barrier must extend across all annuli, extending to the full cross-section of the well and seal the well in both vertical and horizontal directions In some cases, cement may be pumped down coiled tubing and forced (i.e., "bullheaded") into the producing formation. In other cases, a fluid path is created, and then cement is pumped into the circulation path. When a sufficient amount of fluid is circulated through the well (indicating that the cement is at the desired location), circulation flow is stopped and pressure is applied to both the inlet and outlet of the circulation path, squeezing the cement plug in place to form what is referred to as a "balanced" plug. Oil companies have their own internal procedures as to where and how such barriers or "plugs" are formed.

FIGS. 2-4 are schematic cross-sectional drawings that simplistically depict one illustrative prior art technique for abandoning a well 200. Historically, a "bottom" plug 230 was formed in the well so as to form a barrier in the A annulus and through the production casing perforations in the production casing into the oil bearing geological formation. There are various techniques for forming a bottom plug in a well. One technique involved installing a bridge plug 231 within the production casing 210 and thereafter pumping cement down into the subsea production tree and through the production tubing, and forcing or "bull-heading" the cement down to the bottom of the well and into the perforations and the A annulus, and allowing the cement to cure thereby creating a cement plug 232 above the bridge plug 231. Note the extension of the cement into the formation is not depicted in FIG. 2. After the cement plug 232 sets, and the well is confirmed to be dead, the downhole production tubing is cut below the downhole safety valve and the upper portion of the production tubing is recovered to the surface along with the production tree and production tubing hanger hardware.

Thereafter, and with reference to FIG. 3, an upper plug 240 was formed for the well. In this embodiment, another bridge plug 241 was set within the production casing 210. Next, an additional cement 242 was poured on top of the bridge plug 241 to complete the formation of an upper plug 240, creating the necessary permanent barriers (along with the original cement columns 212C and 212D) to isolate the geological formation below.

With reference to FIG. 4, to complete the abandonment process, all of the casing strings 204, 206, 208, 210 above the plug 240 were cut and severed at a location approximately 3-5 meters below the sea floor location 202. The casing stubs along with the subsea low-pressure housing, high-pressure wellhead, and casing hangers were then retrieved to the surface.

Another technique for forming a bottom plug involved performing various activities through the production tubing to establish a circulation path to enable the formation of a balanced plug. A clear brine (of appropriate weight for hydrostatic overbalance) may be pumped (i.e. bullheaded) down through the production tubing and into the reservoir to kill the well. Once the well is confirmed dead, the downhole production tubing is cut or perforated below the downhole safety valve. Thereafter, a circulation path is established from the A annulus, through the tubing perforations and returns through the production tubing. Next a cement plug is circulated down the A annulus until it reaches the tubing perforations. Then the return flow is shut off while continuing to pump down the A annulus. This will force (bullhead) the cement plug down below the tubing perforations down to and into the production casing and oil bearing formation perforation in the well (pressure balance "squeeze"). After the cement plug sets, and the well is confirmed dead, the production tubing above the perforations is cut and recovered to the surface along with the production tree and production tubing hanger hardware. This is followed by placing a mechanical plug barrier in the production casing above the safety valve and production tubing left in the well. Sometimes an additional cement plug is poured on top of the mechanical set plug to complete the sealing process, creating the necessary permanent barriers, (along with the original cement 212C and 212D) to isolate the geological formation below. To complete the abandonment process, all of the casing strings 204, 206, 208, 210 are cut and severed approximately 3-5 meters below the sea floor location 202. The casing stubs along with the subsea low-pressure housing, high-pressure wellhead, and casing hangers are retrieved. At that point, an additional cement cap may be installed by installing a cast iron bridge plug and pouring cement into the open hole on top of the bridge plug.

In more recent years (e.g., since 2013), some regulatory agencies have revised their interpretation of governing rules and regulations as mandating that an abandoned well must also have an upper plug that ensures that all annuli meet the same geology formation isolation requirements. For example, some regulators now view the rules as requiring that a second (upper) abandonment plug must be put in place such that the B, C and possibly D annuli are also fully isolated. For both bottom and upper plugs, regulations required that a well control device be in place on top of the well as abandonment operations take place. Bottom plug operations historically have used the production tree as the well control device, greatly saving on overall cost and avoiding the use of deploying a BOP (blowout preventer). Operations that are performed to gain access to the outer annuli so as to form the upper plug must be performed with either a BOP or a large bore well-control package (WCP) positioned on the well as an extra pressure barrier as these upper plug abandonment operations are performed. However, the use of a BOP or a large bore well-control package (WCP) during the upper plug abandonment operations can greatly impact the abandonment process. First, there a limited number of vessels that have the capability to handle larger and heavier BOPs or WCPs, and such larger vessels command relatively higher rental rates as compared to relatively smaller vessels that may be employed when forming a bottom plug in a well.

One approach that has been used to form an upper plug involves cutting (severing) and recovering a desired axial length of the production and intermediate casings so as to gain full access to the B, C and possibly D annuli. However, this approach requires the pulling of their subsea casing hangers and annulus seal assemblies. These components typically have an outside diameter of about 470 mm (18-½ inches), and require the use of a BOP with a bore of about 476 mm (18¾ inches) so as to permit the removal of such components along with the removed casing.

The present application is directed to a plug and abandonment system for forming an upper plug in the process of abandoning an oil and gas well that may eliminate or at least minimize some of the problems noted above.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to a plug and abandonment system for forming an upper plug in the process of abandoning an oil and gas well. In one example, the system comprises, among other things, a lower tool segment that comprises a landing structure that is adapted to land within a wellhead housing and a well control package that is adapted to be positioned above the lower segment positioned within the wellhead housing and coupled to the wellhead housing, wherein the well control package comprises at least one seal ram. In this example, the system also includes an upper tool segment that is adapted to be positioned through the well control package and operatively coupled to the lower tool segment wherein at least one seal ram is adapted to engage an outer surface of the upper tool segment and at least one cutting means that is coupled to the lower segment and adapted to be actuated to cut at least one opening in at least one section of casing within the well.

One illustrative method disclosed herein for forming an upper plug in the process of abandoning a well comprises positioning a lower tool segment within a wellhead housing the lower tool segment comprising at least one cutting means that is adapted to be actuated to cut at least one opening in at least one section of casing within the well and after positioning the lower tool segment within the wellhead housing, operatively coupling a well control package to the wellhead housing, the well control package comprising at least one seal ram (38). In this example the method further comprises inserting an upper tool segment through the well control package and into operative engagement with the lower tool segment and urging at least one seal ram into engagement with an outer surface of the upper tool segment.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein:

FIGS. 30-34 depict other illustrative example of various ball seats that may be employed with one embodiment of a P&A tool disclosed herein that may be employed when forming an upper plug when abandoning an oil and gas well;

Figure 1:
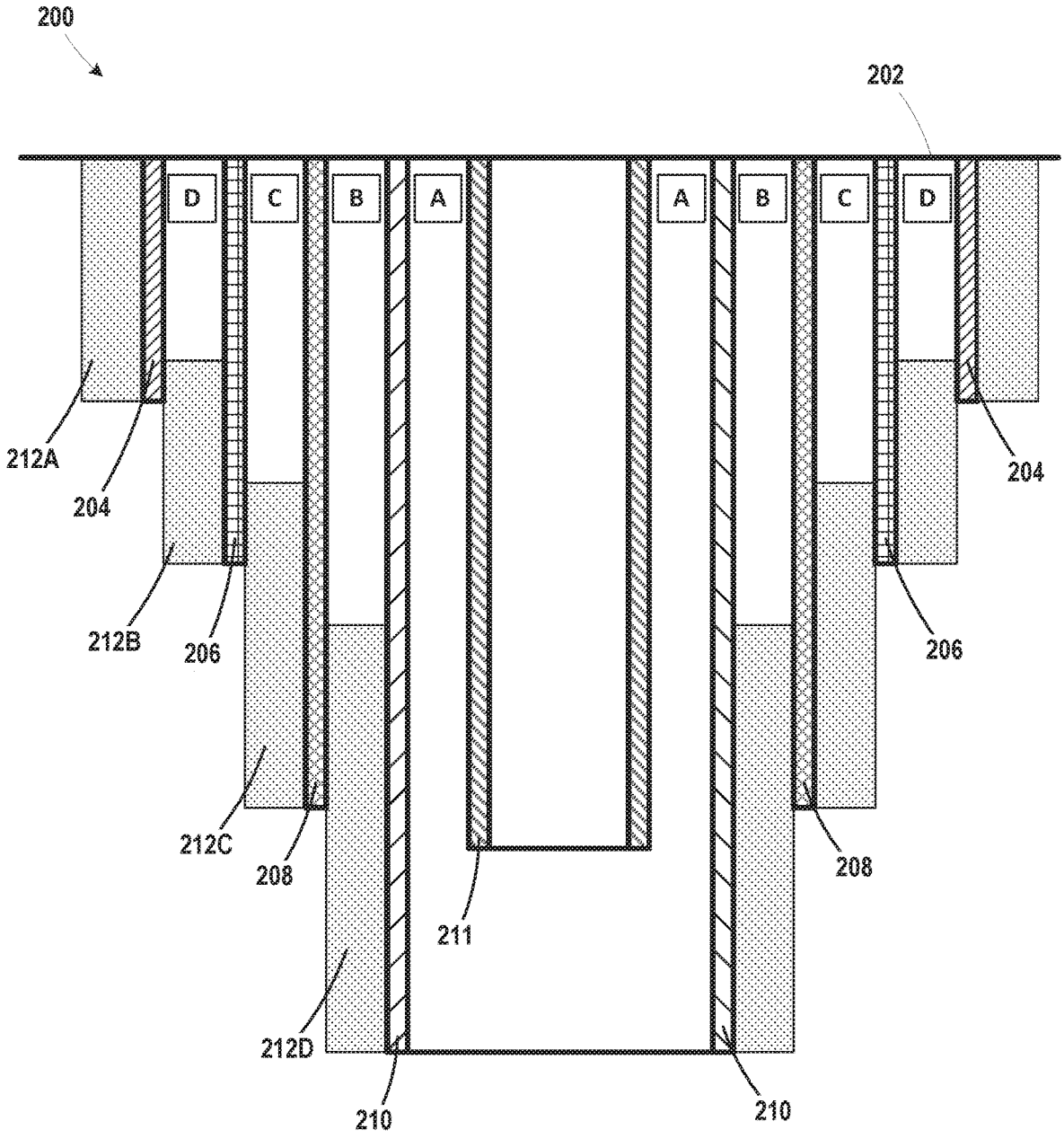
Fig. 1 (Prior Art)
FIG. 1 is a simplistic cross-sectional depiction of a prior art cased subsea 200.
Figure 2:
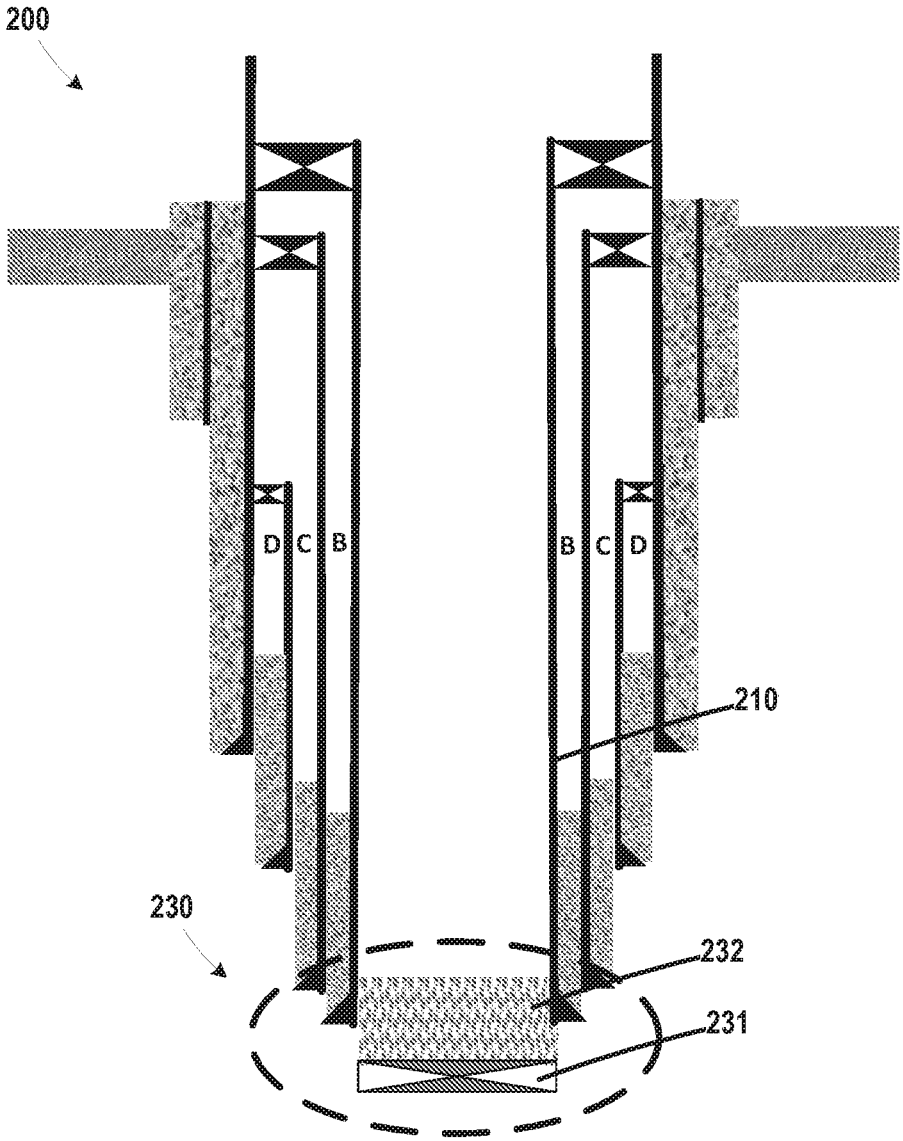
Fig. 2 (Prior Art)
FIGS. 2-4 depict one illustrative embodiment of a method of abandoning a prior art well.
Figure 3:
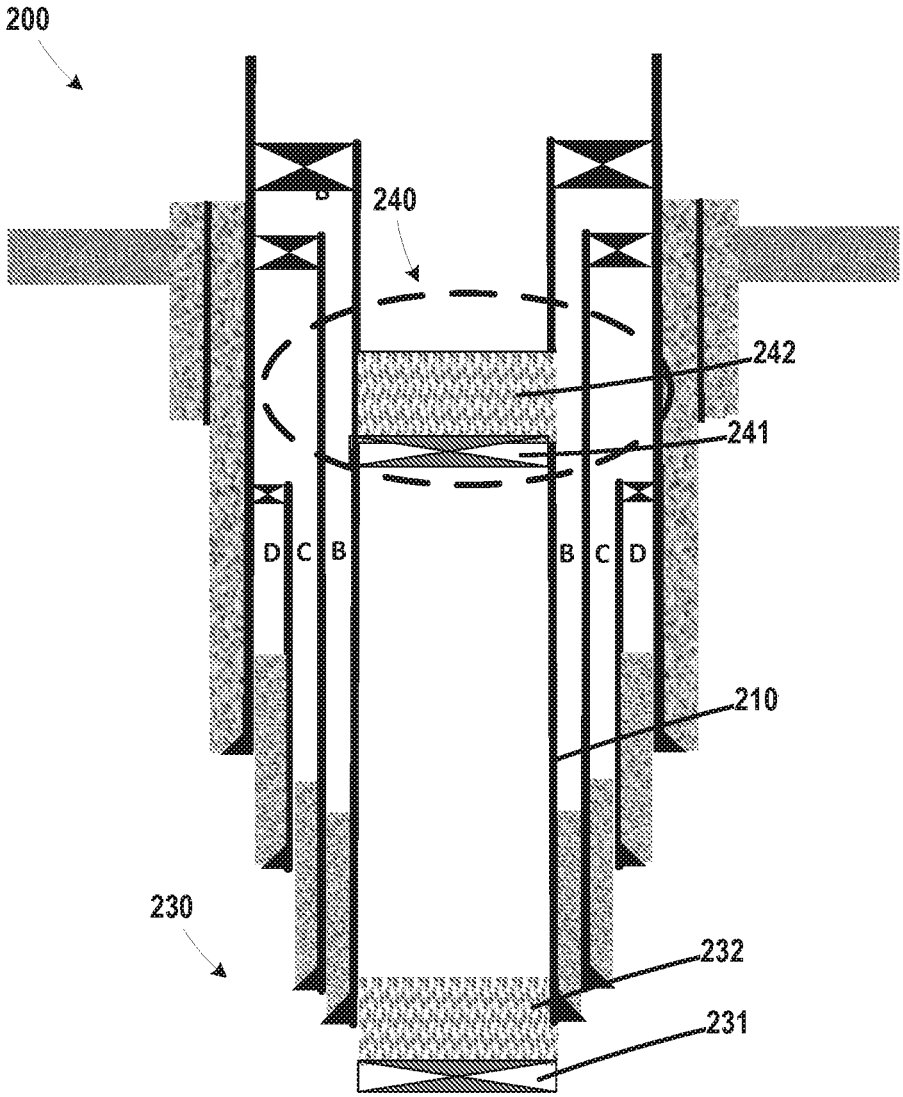
Fig. 3 (Prior Art)
Figure 4:
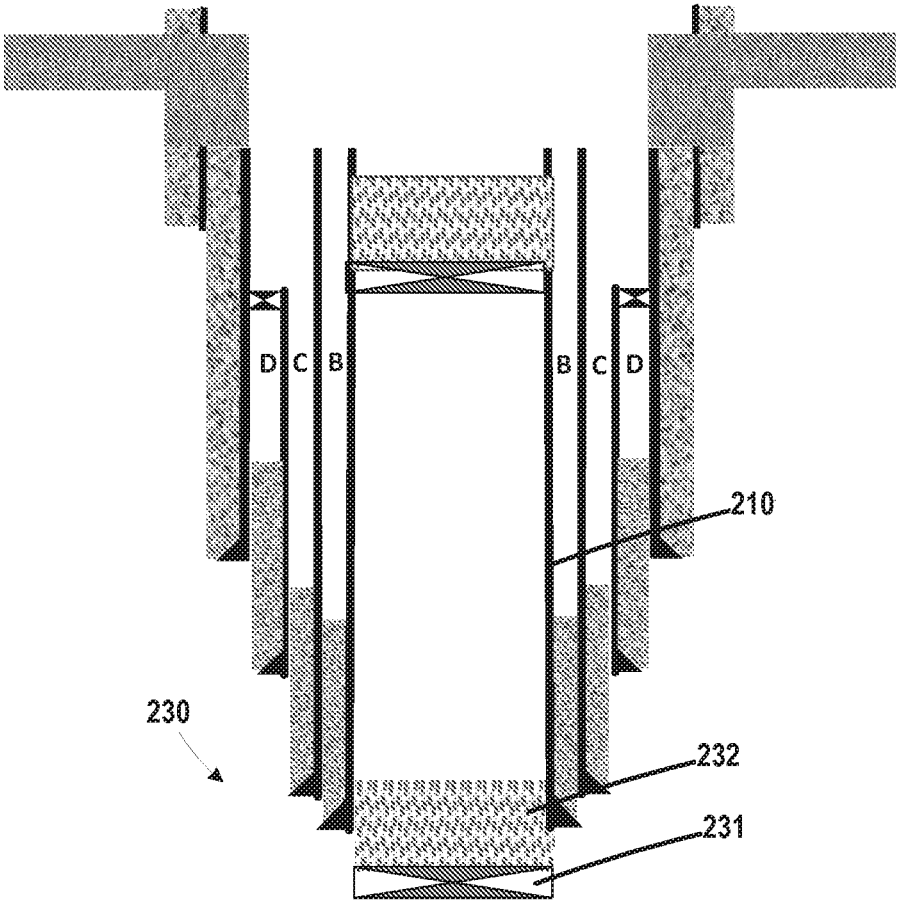
Fig. 4 (Prior Art)

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 5:
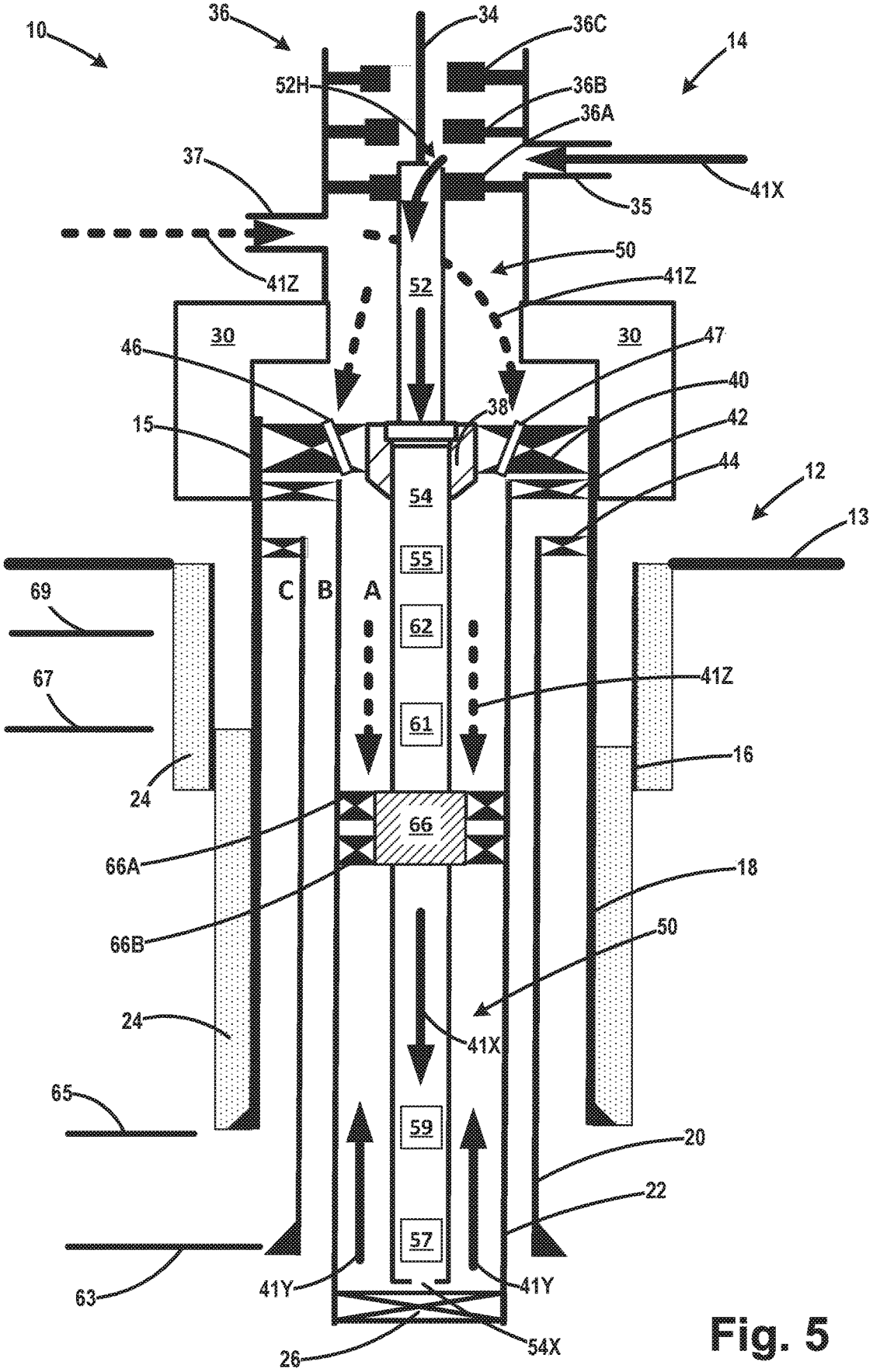
FIGS. 5-20 depict various aspects of one illustrative example of a novel plug and abandonment (P&A) system and tool disclosed herein that may be employed when forming an upper plug when abandoning an oil and gas well.

FIG. 5 schematically and simplistically depicts one illustrative embodiment of a P&A system 10 after it has been initially installed in the well 12. FIGS. 5-37 depict various components or features of the system 10 in more detail. In one example, the system 10 includes a novel P&A tool 50 that will be positioned in the well 12 and used to form an upper plug in the well 12. In one illustrative example, the P&A tool 50 generally comprises an upper segment 52 and a lower segment 54. In one particularly illustrative example, the upper segment 52 is an upper ball-carrying segment 52 that includes a plurality of balls 78 that will be individually released when using the tool 50, as described more fully below. The following discussion assumes that a lower plug (not shown) has already been formed in the well 12. Such a lower plug may be formed using any desired technique and it may have a variety of different configurations. Additionally, the following discussion assumes that an upper portion of the production tubing (not shown) and a production tree (not shown) has already been removed from the well. Lastly, even though the production tubing has been removed, the annular space between the plug & abandonment tool 50 (described below) and the production casing will still be referred to as the A annulus herein and in the attached claims. In practice, the plug will span the entire inside diameter of the production casing 22.

In general, in one illustrative example, the cased and cemented well 12 comprises outermost conductor casing 16, surface casing 18, intermediate casing 20, production casing 22, intermediate casing hanger 44 and production casing hanger 42. The intermediate casing hanger 44 and production casing hanger 42 are set within a high-pressure wellhead housing 15 that extends from the surface casing 18 for a given distance above the sea floor 13. The various casings are cemented within the well as indicated by the various cement columns 24. An illustrative bridge plug 26 has been positioned within the production casing 22 at a desired location within the well below the P&A tool 50. The system 10 also comprises a well control package 14, i.e., equipment that is used to contain the pressure within the well. As depicted, portions of the well control package 14 have been landed on the simplistically depicted high-pressure wellhead housing 15. The well control package 14 is secured to the high-pressure wellhead housing 15 by actuation of a schematically depicted hydraulic clamp or connector 30. The well control package 14 further comprises a small bore (tubing) well control device 36 comprised of a at least one sealing ram 36A and one or more additional rams or closure valves 36B, 36C (each of which may be any type of ram, such as, for example, a shearing ram. As depicted, the sealing ram 36 is adapted to sealingly engage the outer surface of an upper portion the upper ball-carrying segment 52 of the P&A tool 50. A wireline 34 is operatively coupled to the P&A tool 50. The wireline 34 passes through a pressure control head (PCH), also known in the art as a grease head or stuffing box (not shown) in the well control package 14 so as to provide a pressure-tight seal around the wireline 34. The well control package 14 also includes a fluid inlet 35 and a fluid outlet 37 so that any desired type of fluid (as simplistically depicted by the arrow 41) may be circulated into and through the P&A tool 50 from either direction or used to pressure test various parts of the well 10, as described more fully below.

In general, in one illustrative embodiment, the upper ball-carrying segment 52 comprises a plurality of balls 78 (not shown in FIG. 5 but see FIGS. 11-12) that will be individually released so as to actuate various components in the lower segment 54 of the tool 50. In one illustrative embodiment, the lower segment 54 comprises a plurality of schematically depicted devices for forming openings (e.g., perforations) in the various strings of casings, as described more fully below: first perforation means 57 (for establishing casing shoe conductivity); second perforation means 59 (for establishing next outer casing shoe conductivity), third perforation means 61 (for establishing casing annulus circulation) and fourth perforation means 62 (for establishing next outer casing annulus circulation). The perforations means 57, 59, 61 and 62 are axially spaced-apart along the lower segment 54. The exact location and spacing of the perforations means 57, 59, 61 and 62 need not be uniform and will depend upon the particular casing strings' setting depths and other particular well control/pressure integrity characteristics unique to the well being abandoned. The P&A tool 50 is sized such that when it is landed in the well, the first perforation means 57 is positioned at a first depth 63 within the well; the second perforation means 59 is positioned at a second depth 65; the third perforation means 61 is positioned a third depth 67; and the fourth perforation means 62 is positioned at a fourth depth 69. As will be appreciated by those skilled in the art after a complete reading of the present application, depending upon the structure of the well being abandoned, the tool 50 may only be provided with first 57 and third 61 perforation means (i.e., a "two-gun" system), e.g., when the well comprises only A and B annuli. In other applications where the well comprises A, B and C annuli, the tool 50 may comprise four perforation means (i.e., a "four-gun" system) as shown in FIG. 5. In other applications, where the well comprises A, B, C and D annuli, the tool 50 may comprise six perforation means (i.e., a "six-gun" system).

The P&A tool 50 further comprises a mid-tool packer 66 comprised of a schematically depicted expandable seal 66A that is adapted to, when energized, engage the inner surface of the production casing 22. The packer 66 also comprises a plurality of schematically depicted anchor slips 66B that are adapted to, when actuated, engage the inner surface of the production casings 22 so as to secure the lower segment 54 of the tool 50 within the well. As depicted in FIG. 5, the first and second perforation means 57, 59 are positioned in a lower zone located vertically below the packer 66, while the third and fourth perforation means 61, 62 are positioned in an upper zone located vertically above the packer 66. The tool 50 also comprises a cutting means 55, e.g., a chemical spray cutter or the like, that is adapted to, when actuated, cut the lower section 54 of the tool 50, as described more fully below. The tool 50 further comprises an adapter 38 and a tool landing structure 40 that is adapted to land on some type of structure that was previously positioned within the high-pressure wellhead housing 15.

The upper ball-carrying segment 52 comprises an opening 52H that, with the seal ram 36A energized, is adapted to be opened so as to establish a fluid flow path that permits fluid 41 to flow from the inlet 35 into the interior of the upper ball-carrying segment 52 for purposes that will be explained more fully below. In one illustrative example, the opening 5214 is adapted to be opened by shifting a sleeve 52F on the upper ball-carrying segment 52, as described more fully below. In the example depicted herein, the opening 52H is formed in the upper surface of the upper ball-carrying segment 52 and a single seal ram 36A sealingly engages the upper ball-carrying segment 52 at a point below the opening 52H. In other embodiments, the opening 52H could be provided in a side surface of the upper ball-carrying segment 52 and two seal rams (one above the opening 52H and one below the opening 52H) could be employed to form the desired seal around the opening. 52H. In this latter case, the fluid inlet 35 would discharge fluid 41 into the vertical space between the two seal rains. Of course, as will be appreciated by those skilled in the art after a complete reading of the present application, other mechanisms and techniques may be provided so as to establish this flow path between the inlet 35 and the interior of the upper ball-carrying segment 52. The tool landing structure 40 comprises a plurality of fluid passages 46 that extend through the body of the tool landing structure 40. The fluid passages 46 establish fluid communication between the A annulus and the inlet/outlets 35, 37 in the well control package 14. The fluid passages 46 may be used when circulating fluids to and from the tool 50, as described more fully below. The lower segment 54 comprises an opening 54X at the bottom of the lower segment 54.

FIG. 5 depicts the lower section 54 with the packer 66 set to establish the upper and lower zones in well with the intermediate casing hanger 44 and production casing hanger 42 positioned therein. A dropped ball 78 from the upper ball-carrying segment 52 of the P&A tool 50, lands in a seated outlet at the base 54X of the lower segment 54. Once seated, pressure can be applied to test the pressure integrity of the tubing string of the tool 50 by allowing fluids 41 to be introduced via the inlet 35 of the well control package 14, as indicated by the solid arrow lines 41X. The pressure is increased until such time as a mechanism inside the packer 66 is tripped, thereby expanding its annular seal 66A and anchor slips 66B. To confirm that the packer 66 is properly set and sealed, continued pressure increase is applied by fluids 41 introduced through inlet 35 to shift open ports or shear out the sealing ball at the lower segment's base 54X, allowing fluid and pressure from inside the lower segment 54 to enter in the lower zone of the well below the packer 66 in the annular space between the lower segment 54 and the production casing 22, as indicated by the solid arrow lines 41Y. This in turn allows for a positive pressure integrity test of the packer 66 annular seal 66A from the lower zone below the packer 66. Pressure and fluids are subsequently vented from the inlet 35.

After testing the integrity of the packer 66 from below by pressuring-up the lower zone (as described above), the integrity of the packer 66 is tested from the upper zone, i.e., from above the packer 66. This testing of the packer 66 from above involves introducing fluids 41 into the upper zone of the well above the packer 66 in the annular space between the lower segment 54 and the production casing 22 well via the "outlet" 37 of the well control package outlet 37, as indicated by the dashed arrow lines 41Z. The pressure of the fluid in the upper zone is then increased (which is applied through the circulating ports 46 and the well's A annulus) to test the pressure integrity of the packer's 66 annulus seal 66A from the upper zone above the packer 66. This pressure testing of the packer 66 from above, combined with the previous pressure testing of the packer 66 from below, establishes that the packer 66 is a proper barrier.

Figure 6:
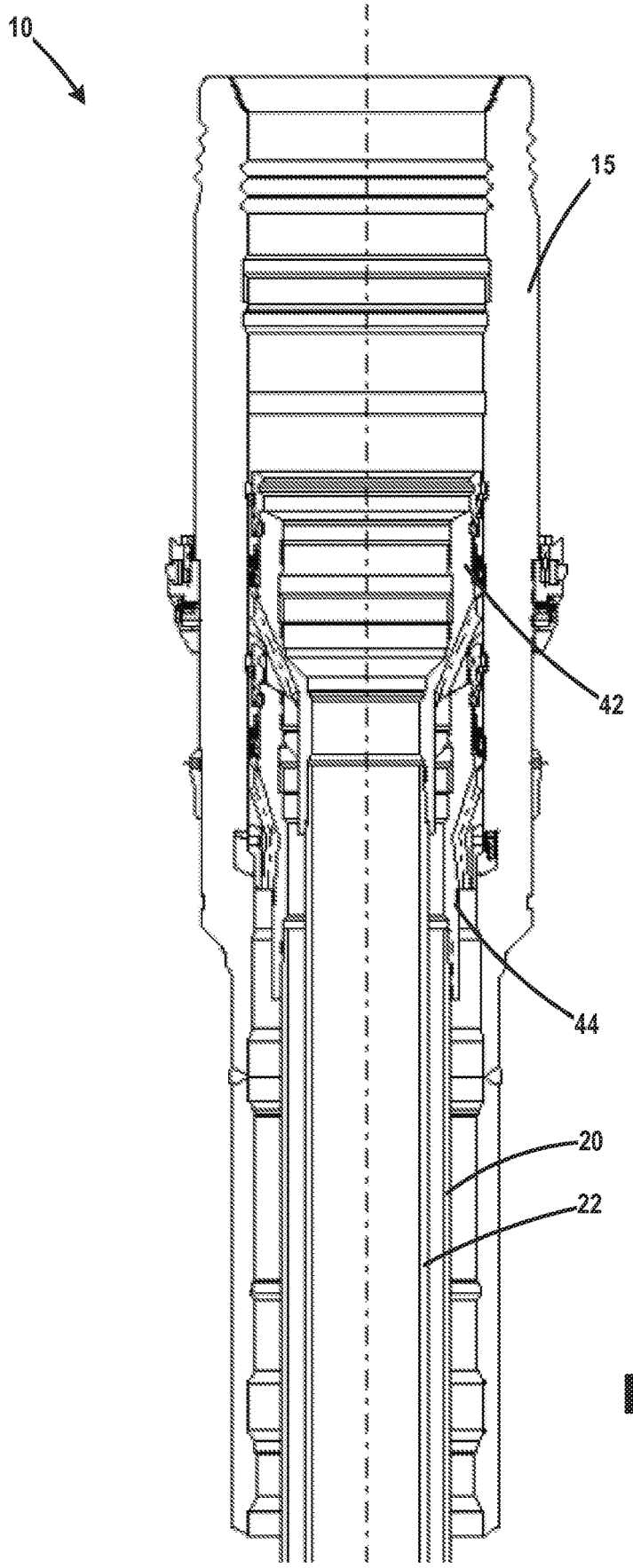

FIG. 6 depicts the wellhead 15 with the intermediate casing hanger 44 and production casing hanger 42 positioned therein. No portion of the P&A tool 50 is depicted in FIG. 6.

Figure 7:
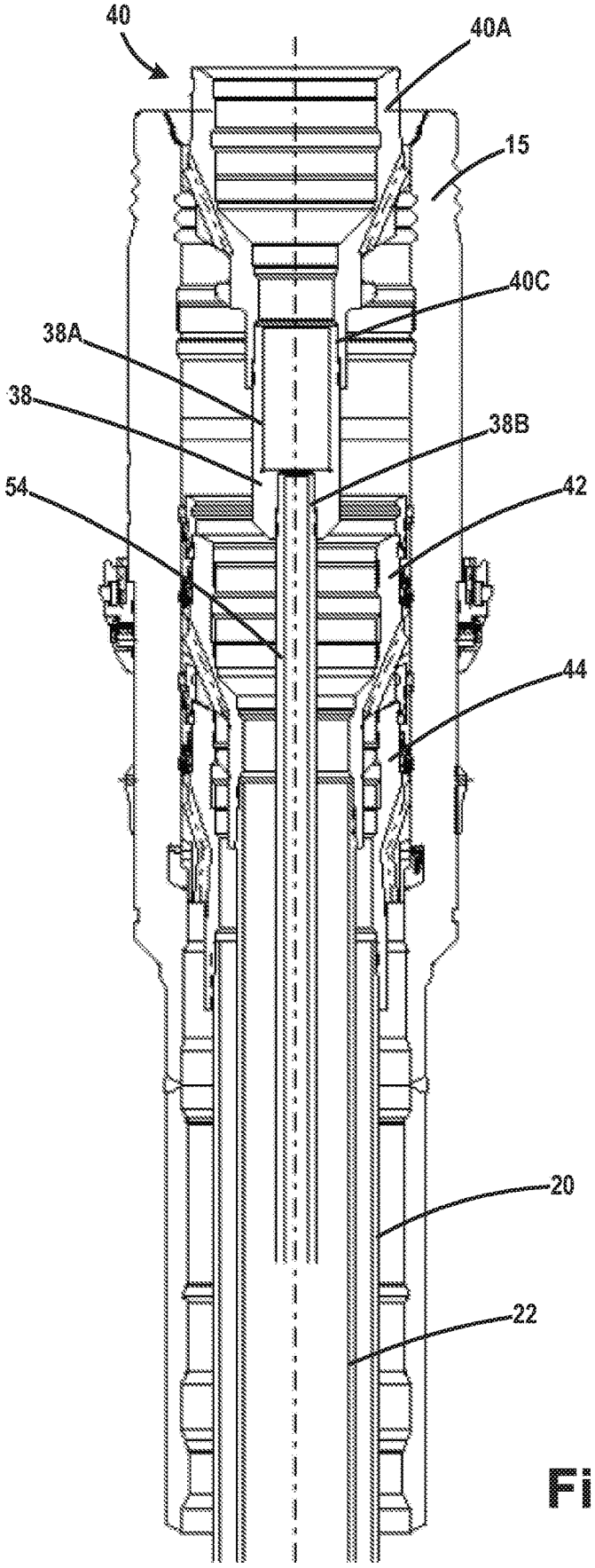

FIG. 7 depicts the wellhead 15 at a point in time where the lower segment 54 of the tool 50 is being positioned in the wellhead 15. At the point in time depicted in FIG. 7, the tool landing structure 40 has not yet landed on any structure (e.g., the production casing hanger 42) that was previously positioned within the wellhead 15.

Figure 8:
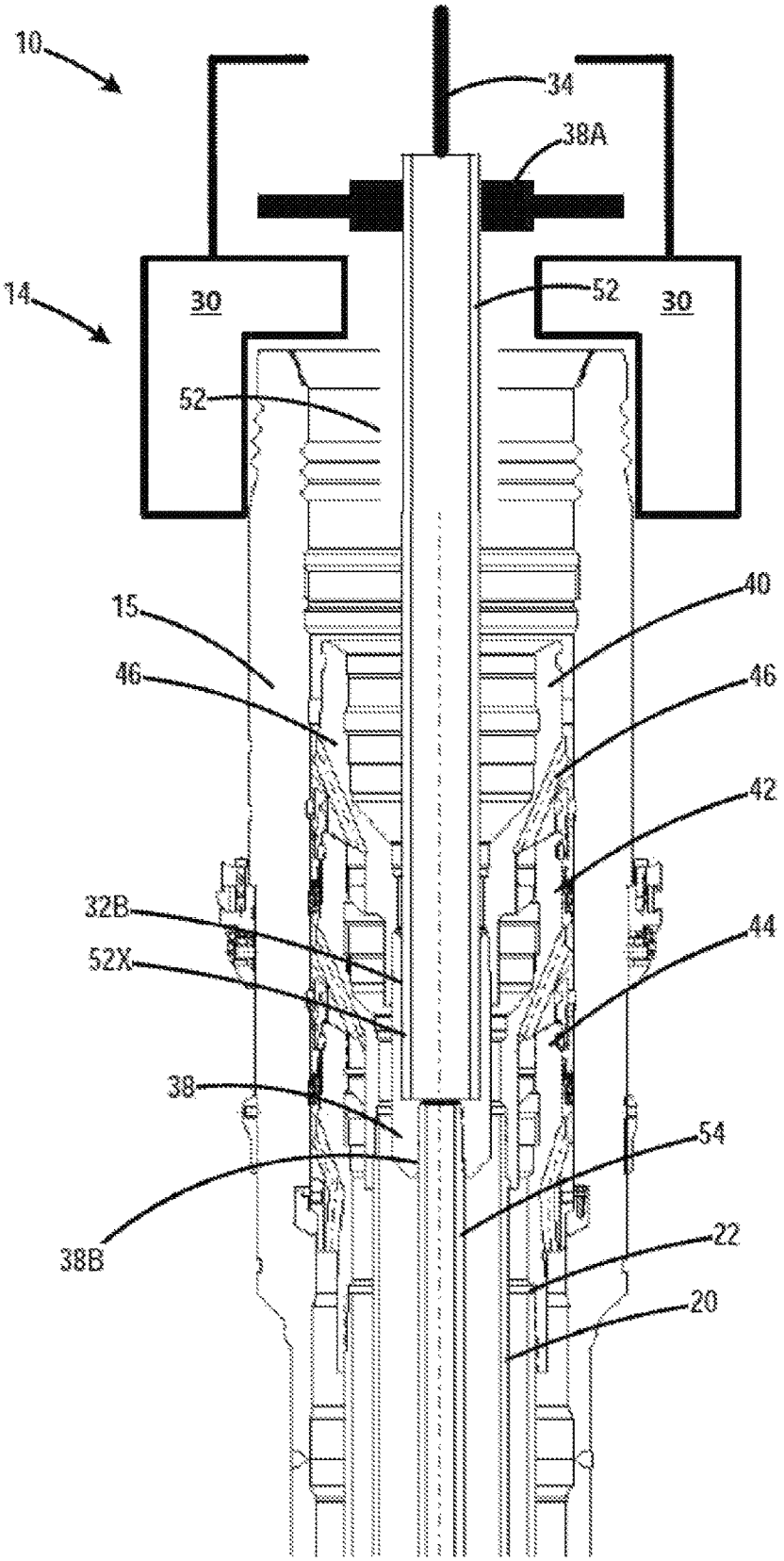

FIG. 8 depicts the wellhead 15 at a point in time after several actions were performed. First, the lower segment 54 of the tool 50 was lowered to its final position within the well wherein the tool landing structure 40 was landed on the production casing hanger 42. At some point thereafter, the above-described well control package 14 was operatively coupled to the wellhead 15 by actuation of the connector 30. After the well control package 14 was installed, the upper hall-carrying segment 52 was lowered, via wireline 34, through an opening in the well control package 14 until such time as a lower end 52X of the upper ball-carrying segment 52 lands in the adapter 38. The is the final position of the upper ball-carrying segment 52 relative to the lower segment 54 and the tool landing structure 40, i.e., at this point the upper ball-carrying segment 52 is operationally coupled to the lower segment 54. At that point, the sealing rain 36A was energized so as to seal against the outer surface of the upper ball-carrying segment 52. The energizing of the sealing ram 36A around the upper ball-carrying segment 52 also locks the tool landing structure 40 in place. Any subsequent upward pressure end load will be resisted by the inherent increased sealing strength of the sealing rain mechanism 36, thereby eliminating the need for any locking devices between the tool landing structure 40 and the wellhead 15.

Figure 9:
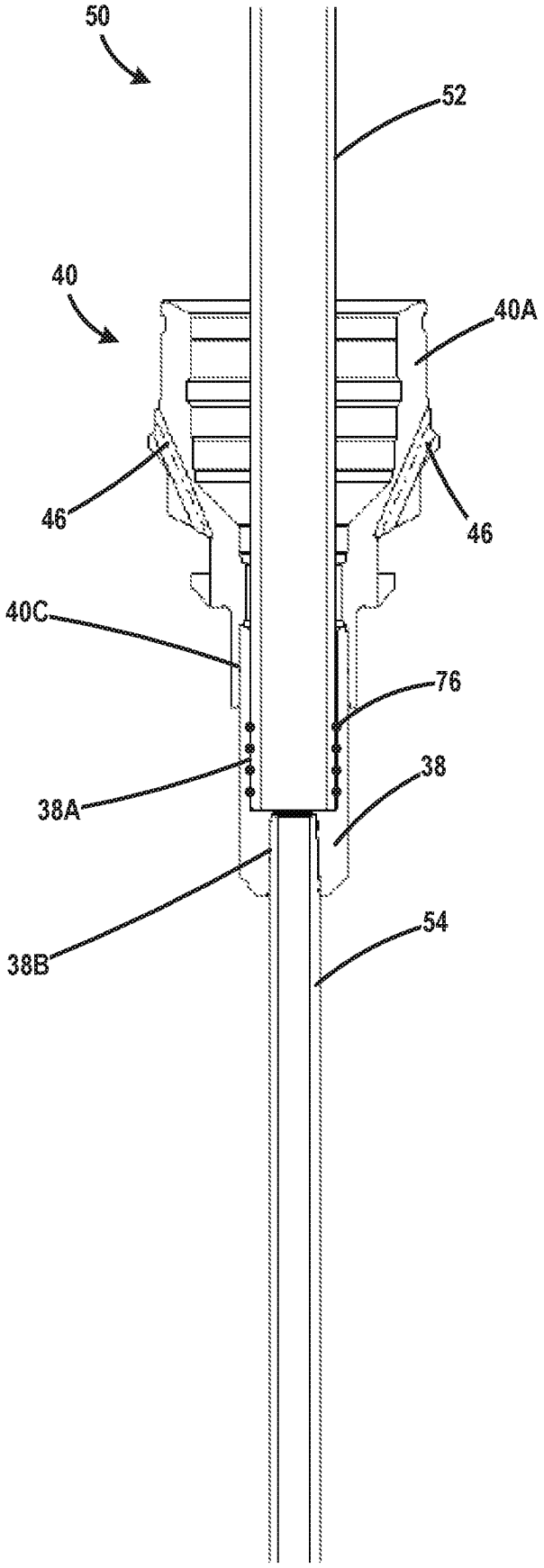

FIG. 9 separately depicts one illustrative embodiment of a P&A tool 50 herein positioned outside of the wellhead 15. As noted above, the P&A tool 50 generally comprises the upper ball-carrying segment 52, the lower segment 54, the adapter 38 and the tool landing structure 40. Note that the perforations means 57, 59, 61 and 62 and the mid-tool packer 66 are not depicted in FIGS. 7-9 so as to not overly complicate the drawings.

Figure 10:
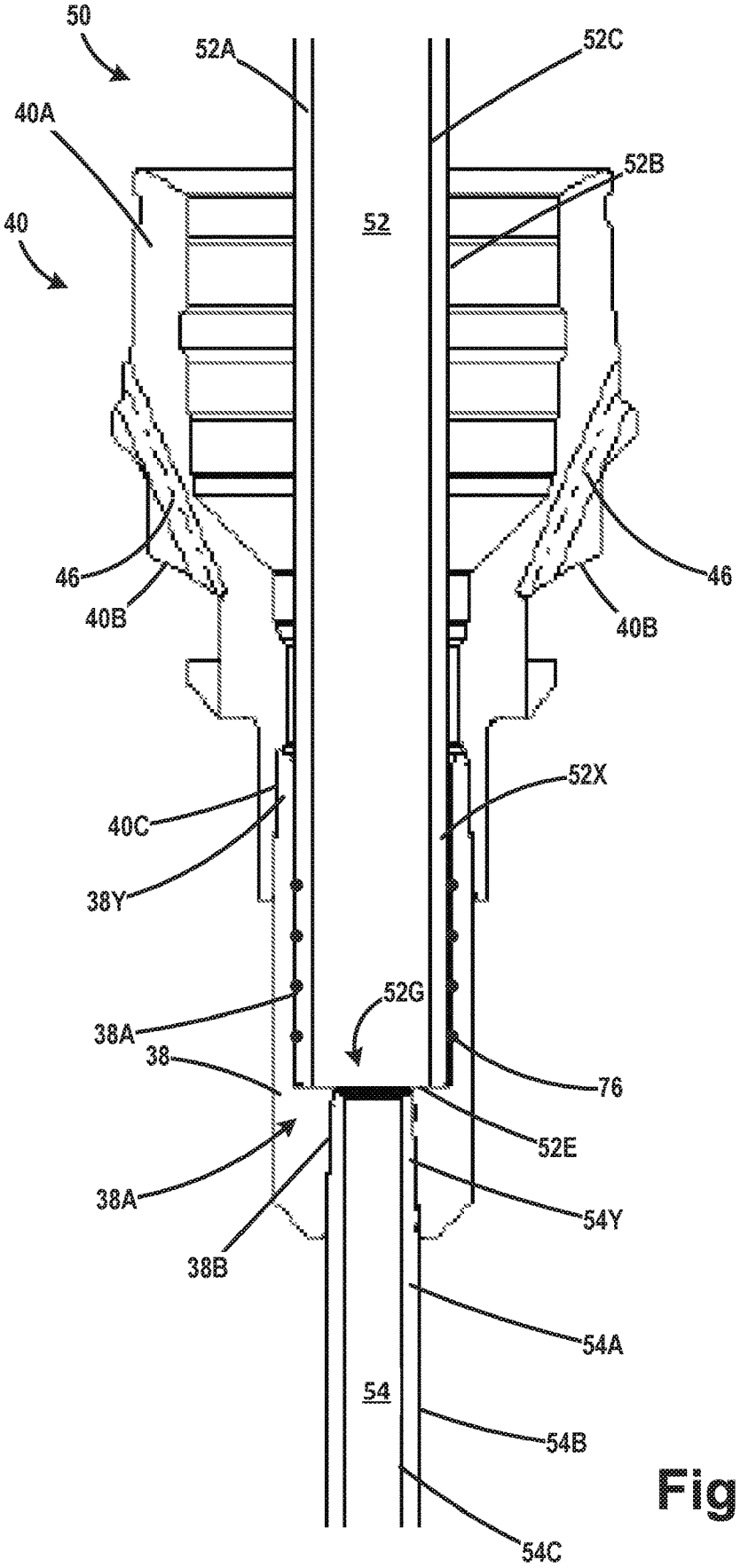

FIG. 10 is an enlarged view of a portion of the tool 50 that further describes the relationship between the tool landing structure 40, the upper segment 52, the lower segment 54 and the adapter 38. As noted above, in one illustrative embodiment, the tool landing structure 40 may be a standard 178 mm (7 inch) casing hanger that comprises a body 40A, a landing shoulder 40B, the above mentioned fluid passages 46 that extend through the body 40A and an internally threaded bottom opening 40C. In one illustrative example, the upper segment 52 comprises a body 52A with an external surface 52B, an internal surface 52C and a bottom 52E with ball outlet 52G defined therein. The lower segment 54 comprises a body 54A with an outer surface 54B and an inner surface 54C. In one illustrative embodiment, the adapter 38 comprises a polished bore recess 38A and a lower internally threaded bottom opening 38B. The upper end 38Y of the adapter 38 is provided with external threads (not shown) such that the adapter 38 may be threadingly coupled to the bottom opening 40C in the tool landing structure 40. The upper end 54Y of the lower segment 54 of the tool 50 is provided with external threads (not shown) such that lower segment 54 may be threadingly coupled to the threaded bottom opening 38B in the adapter 38. The lower end 52X of the ball-carrying segment 52 is adapted to be positioned in the polished bore recess 38A of the adapter 38. A plurality of seals 76, e.g., O-rings, is positioned around the perimeter of the ball-carrying segment 52 so as to effectuate a seal between the ball-carrying segment 52 and the adapter 38. In this manner, the upper segment 52 is operatively coupled to the lower segment 54 of the tool 50. Once the upper segment 52 is positioned within the adapter 38, the seal ram(s) 36A may be actuated so as to sealingly engage the outer surface of the upper segment 52.

As will be appreciated by those skilled in the art after a complete reading of the present application, the tool landing structure 40 is adapted to land on top of any type of structure 42 (such as a casing hanger) that has been previously positioned in the wellhead housing 15. In one illustrative embodiment, the tool landing structure 40 need not be locked or oriented relative to the structure 42 (e.g., a casing hanger) or to the wellhead 15, as discussed more fully below. Of course, if desired, the tool landing structure 40 may be modified so as to attach and lock to the structure 42 and/or the wellhead 15. The tool landing structure 40 may take a variety of forms, e.g., a casing hanger, or a wear bushing from the wellhead manufacturer, a casing hanger or wear bushing from another manufacturer, a purpose built machined body with an integral landing structure 40 and adapter 38 as one piece, or a simple plate-like structure fabricated structure, all with an outside diameter that is less than the inside diameter of the wellhead housing 15 and with a plurality of circulation ports 46. The load shoulder 40B does not have to be an exact seating area or angle match to the top of the structure 42 (e.g., a casing hanger) that the tool landing structure 40 contacts. Additionally, the tool landing structure 40 does not have to be specifically positioned axially on top of the structure 42 (e.g., a casing hanger). An allowable setting of the tool landing structure 40 high or low within the well is accommodated by the sealing ram 36A being allowed to seal at any position along the outer body of the upper segment 52. Similarly, the previously-positioned structure 42 may also take a variety of forms, e.g., a casing hanger, a wear bushing, etc. In the illustrative example disclosed herein, the tool landing structure 40 may take the form of a standard casing hanger, e.g., a nominal 178 mm (7 inch) casing hanger, while the previously-positioned structure 42 may take the form of a nominal 244 mm (9⅝ inch) production casing hanger. However, the subject matter disclosed herein should not be considered to be limited to this particular illustrative example.

Figure 11:
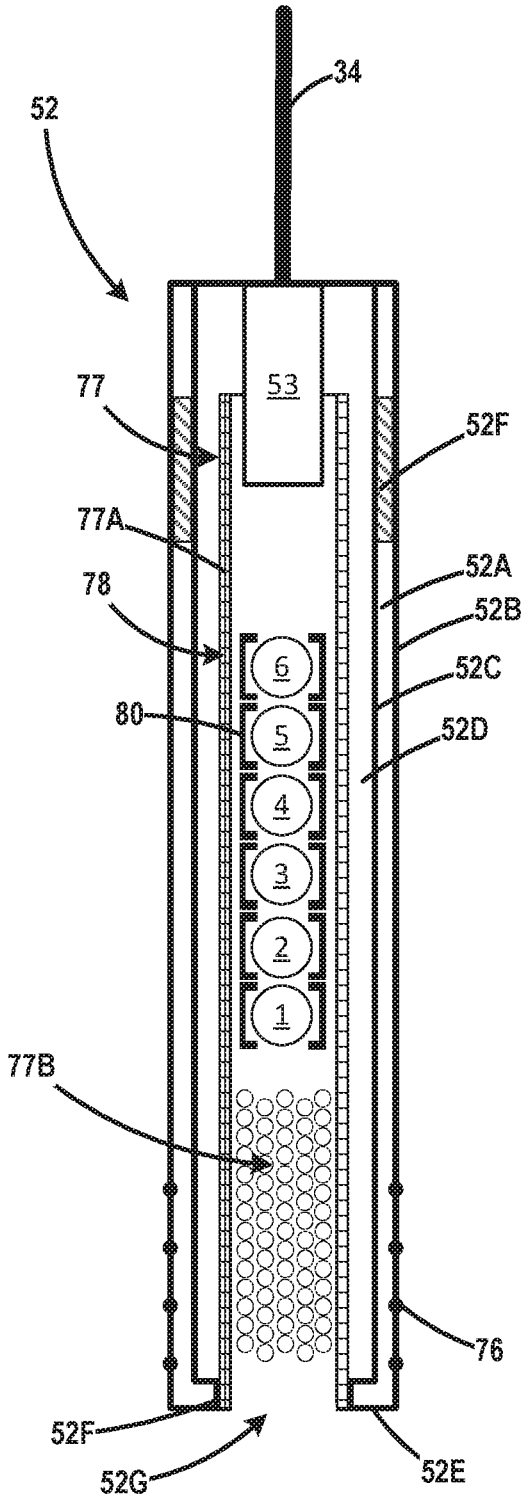
Figure 12:
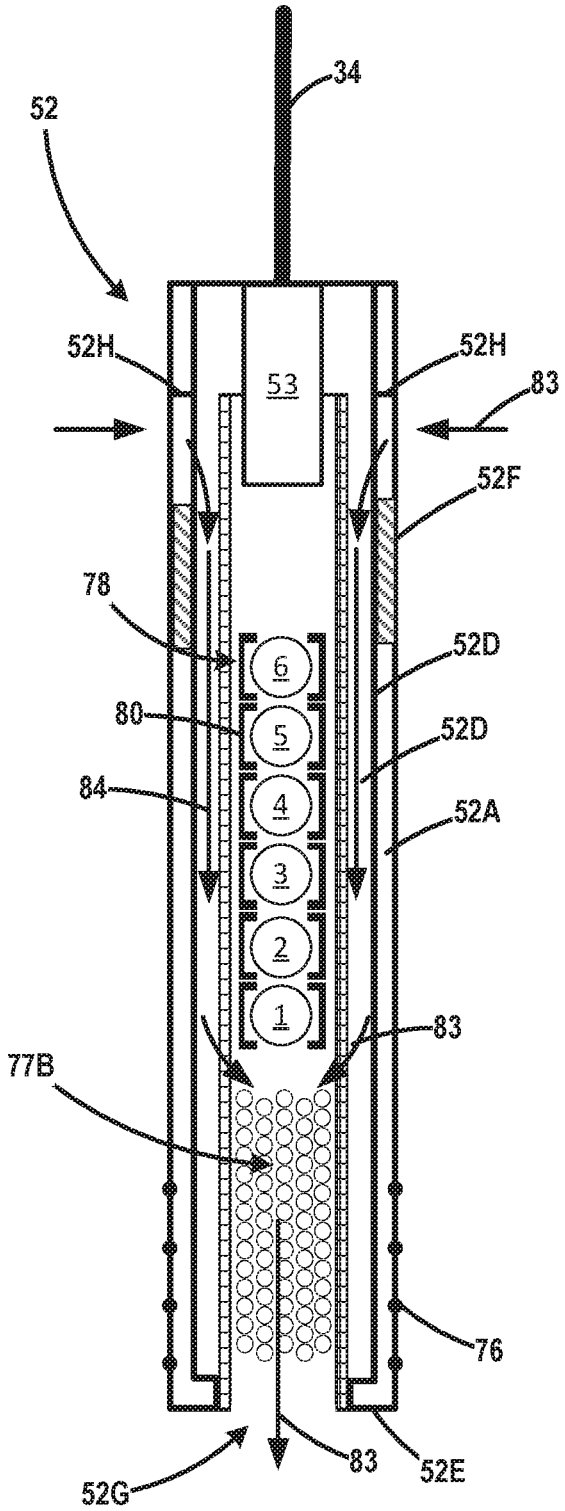

FIGS. 11 and 12 are cross-sectional views of one illustrative embodiment of the ball-carrying segment 52 of the illustrative tool 50 that is presently being described. FIG. 1 depicts the ball-carrying segment 52 when a sliding sleeve 52F is closed, while FIG. 12 depicts the ball-carrying segment 52 with the sliding sleeve 52 open so as to expose the above-mentioned opening 52H and establish a fluid flow path 83 from the fluid flow inlet 35 to the interior of the ball-carrying segment 52. In FIGS. 11 and 12, the opening 52H is schematically depicted as being located on the side of the upper ball-carrying segment 52. However, as noted above, the opening 52H may be positioned at any desired location so long as the seal ram 38A is adapted to sealingly engage the upper ball-carrying segment 52 at a point below the opening 52H. With reference to FIG. 11, in one illustrative example, the ball-carrying segment 52 comprises a body 52A with an external surface 52B, an internal surface 52C, a bottom 52E with a ball outlet 52G defined therein, and the above mentioned sliding sleeve 52F. The ball-carrying segment 52 also comprises a ball housing 77 positioned within the interior of the body 52A so as to define an annular space 52D between the exterior of the ball housing 77 and the inner surface 52C of the ball-carrying segment 52. In the depicted example, the ball housing 77 comprises a body 77A with a plurality of openings 77B formed in the lower portion of the body 77A. In the depicted example, the ball housing 77 is sized and configured to hold six illustrative balls 78 (numbered 1-6 for reference purposes). Each of the balls 78 is positioned in its own electrically actuatable housing 80 such that the balls 78 may be individually released on an as-needed basis, as described more fully below. The number and size of the balls 78 may vary depending upon the particular application. In one particularly illustrative example, the balls 78 are all different sizes and they increase in diameter from ball 1 to ball 6. The ball-carrying segment 52 also comprises a schematically depicted control and sensor means 53 that are operatively coupled to the wireline 34. The control and sensor means 53 includes various sensors and electrical components to permit the opening of the sleeve 52F and the releasing of the balls 78 out of the ball outlet 52G of the ball-carrying segment 52 as the balls are needed. FIG. 12 depicts the ball-carrying segment 52 after the sliding sleeve 52F has been moved to its open position based upon a command received via the wireline 34. Movement of the sleeve 52F exposes the above-mentioned opening 52H in the body 52A and establishes a flow path through the ball-carrying segment 52 as indicated by the arrows 83. More specifically, with the sleeve 52F open, fluid may enter the opening 52H, flow down the annulus 52D, flow into through the openings 77B (into the interior of the body 77A) and out of the ball outlet 52G.

Figure 13:
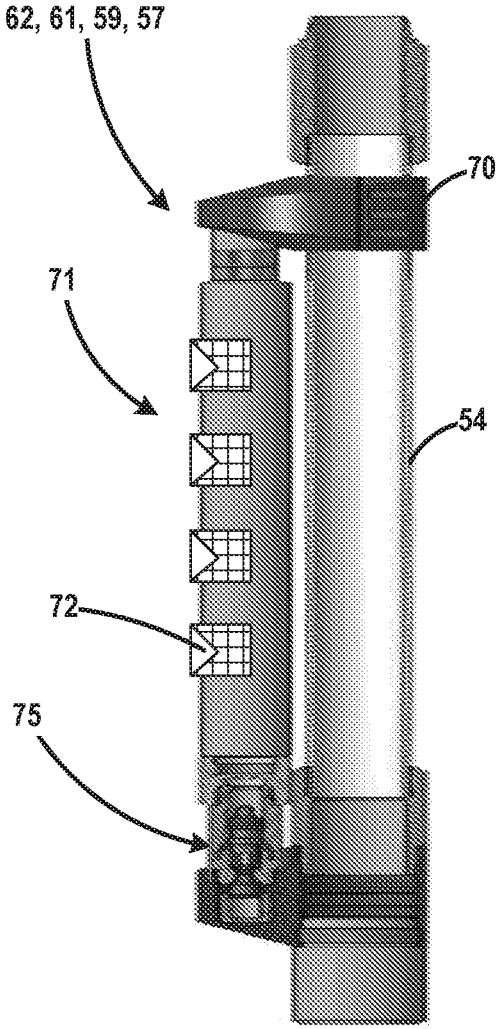

FIG. 13 is a side view of one illustrative embodiment of the perforation means 57, 59, 61 and 62 that may be employed with an illustrative embodiment of the tool 50. In the depicted example, the perforation means includes one or more perforating guns 71 that comprise a plurality of schematically depicted shaped charges 72 and a pressure switch 75. In one illustrative example, the guns 71 are pressure-actuatable guns that are adapted to be actuated or "fired" by increasing pressure on the pressure switch 75. In the depicted example, the guns 71 are adapted to be mounted to the exterior of the lower segment 54 by a plurality of clamps 70. In other embodiments, the perforation means 57, 59, 61 and 62 may be positioned, in whole or part, inside the body of the lower segment 54. Each of the perforation means 57, 59, 61 and 62 may comprise multiple guns 71 mounted on the lower segment 54. For example, the first perforation means may comprise three of the guns 71 that are equally spaced around the outer perimeter of the lower segment 54, e.g., they may have an angular spacing of about 120°. The number of gun(s) 71 and the positioning of such guns 71 need not be the same for each of the perforations means 57, 59, 61 and 62, but that may be the case in some applications. Additionally, in the case where a particular perforation means comprises multiple guns 71, they may be axially offset from one another along the lower segment 54, at least to some degree.

In general, with respect to this embodiment of the tool 50, the methods disclosed herein involve releasing individual balls 78 from the ball-carrying segment 52 so as to actuate other devices or components within the lower segment 54 so as to enable individual actuation of each of the perforation means 57, 59, 61 and 62 at the desired time and in any desired order or sequence. In general, the balls 78 will land in a ball sleeve (that is generally referred to with the reference numeral 84) positioned within the components of the lower segment 54. i.e., within one or more of the perforation means 57, 59, 61 and 62.

Figure 14:
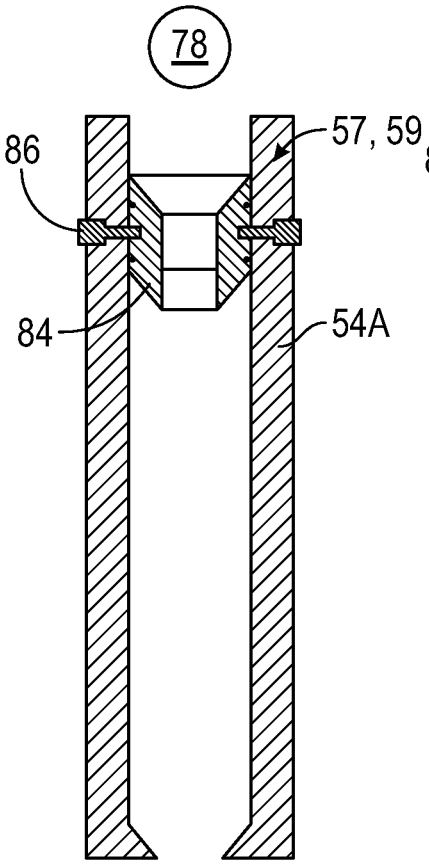
Figure 15:
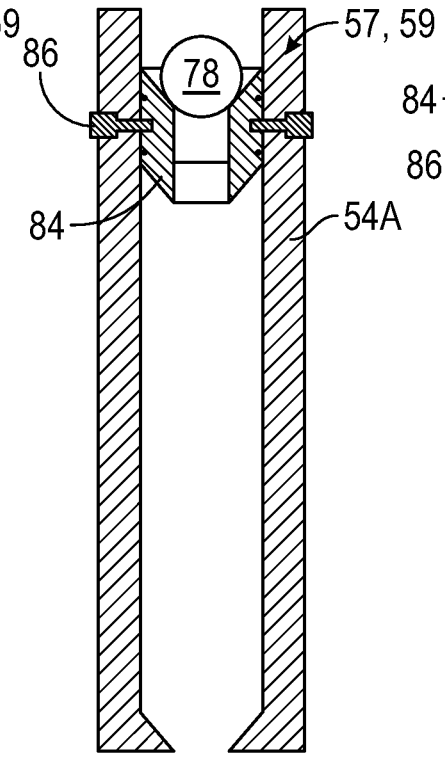
Figure 16:
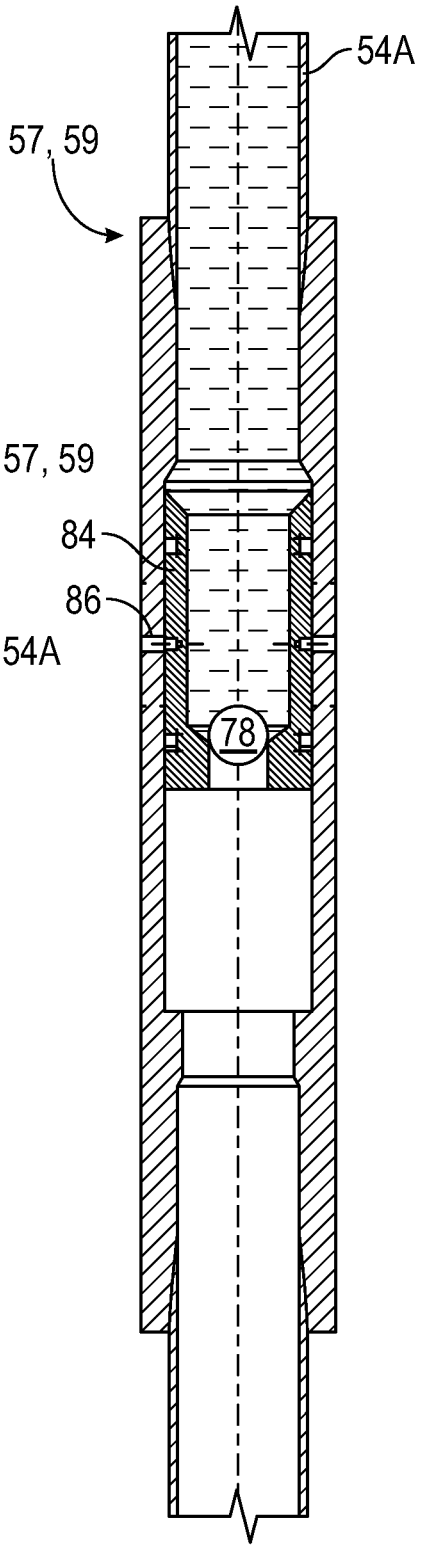
Figure 19:
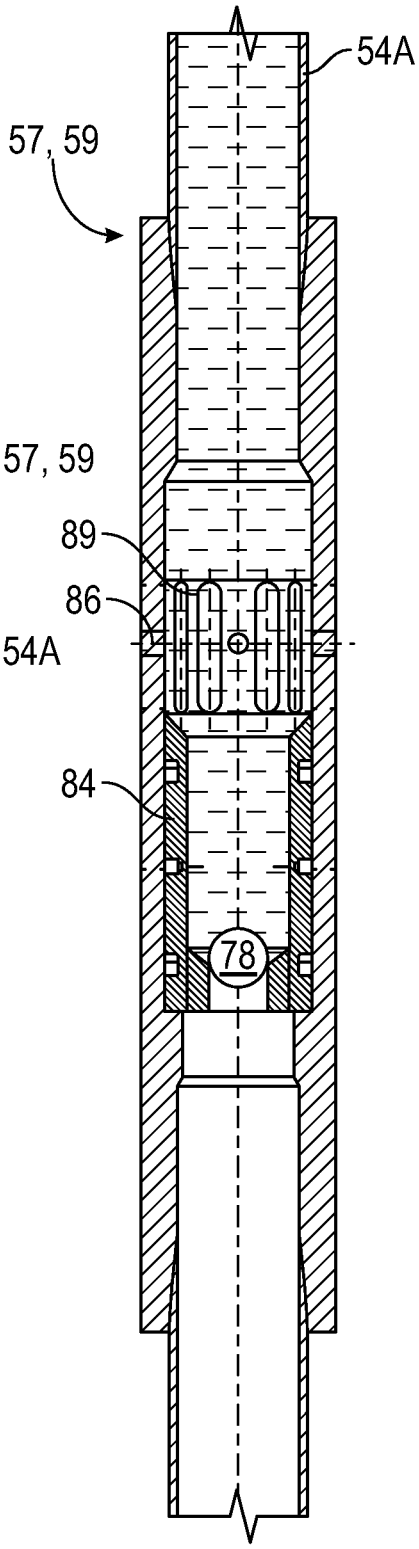

As will be described more fully below, the two lowermost perforation means 57 and 59 that are positioned below the packer 66 have a different configuration than the two upper perforation means 61 and 62 that are positioned above the packer 66. FIGS. 14-16 depict one illustrative example wherein the ball sleeve 84 for one of the two lowermost perforations means 57, 59, is pinned to the body 54A of the lower segment 54 by one or more shear pins 86, i.e., the ball sleeve 84 is releaseably coupled to the body 54A of the lower segment 54. FIG. 16 depicts the perforation means 57 and 59 in a closed position, i.e., prior to the shifting of the downward shifting of the sleeve 84. FIG. 19 depicts the perforation means 57 and 59 in an open position, i.e., after the ball sleeve 84 has been shifted downward. As depicted in FIG. 19, the ball sleeve assemblies for the two lower perforation means 57 and 59 comprise a plurality of vents 89 that are only exposed when the ball sleeve 84 is shifted downward. When opened, the vents 89 establish a fluid communication path between the inside of the lower segment 54 and the A annulus. Thus, with the vents 89 exposed, only pressure within the lower segment 54 can be used to fire the two lowermost perforation means 57 and 59, i.e. the pressure switch 75 on the perforation guns 71 will be exposed to internal pressure within the lower segment 54. Of course, the settings on the two lowermost perforation means 57 and 59 are set such that they will fire at different pressures and not at the same time.

Figure 17:
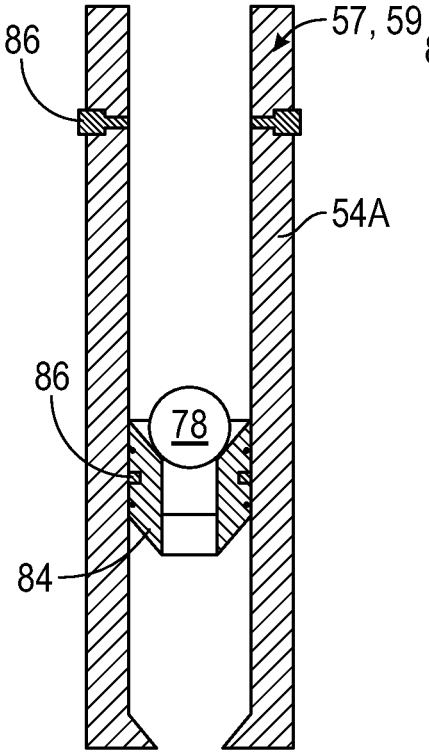
Figure 18:
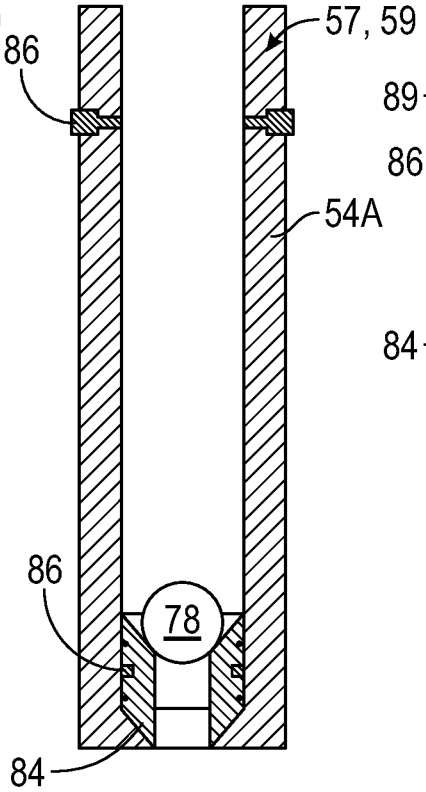

FIG. 14 depicts the tool 50 prior to the ball 78 landing in the ball sleeve 84. FIGS. 15 and 16 depict the tool after the ball 78 has first landed in the ball sleeve 84. At the point shown in FIGS. 15 and 16, the sleeve remains pinned to the lower segment 54. FIG. 17 depicts the tool 50 after the pressure within the lower segment 54 above the ball 78 was increased so as to shear the shear pins 86 and thereby release the ball sleeve 84 so that it may travel further down the lower segment 54. FIGS. 18 and 19 depict the tool after the ball sleeve 84 has been shifted to it lowermost position thereby opening the vents 89, so as to fire the gun(s) 71 at the third perforation means 61. After the ball sleeve 84 is shifted to the position shown in FIG. 19, the pressure within the lower segment 54 above the ball 78 may be further increased so fire the gun(s) 71 at one of the two lowermost perforation means 57 and 59. FIGS. 14 and 17 depict the perforation means 57 and 59 after the pressure within the lower segment 54 of the tool 50 was increased to a level that was sufficient to shear the shear pins 84 and after the sleeve 84A has shifted downward.

Figure 20:
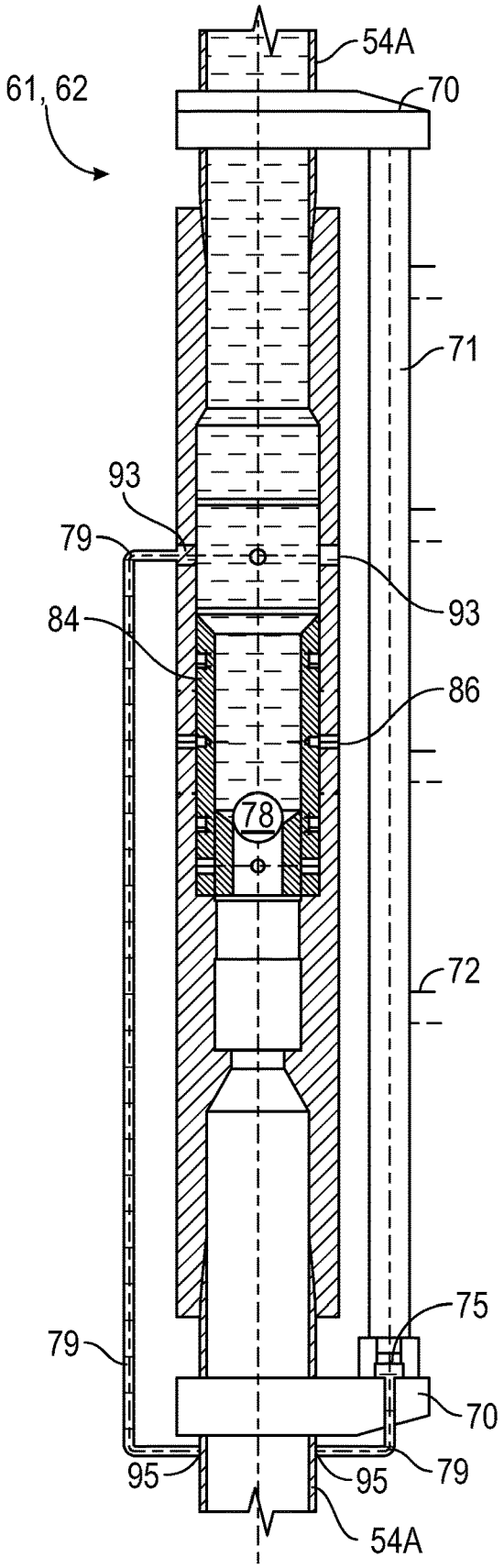

One illustrative configuration for the two uppermost perforation means 61 and 62, i.e., the ones above the packer 66 is depicted in FIG. 20. At the point in time shown in FIG. 20, a ball 78 has landed in the ball sleeve 84, the pressure above the ball 78 was increased so as to shear the pins 86, and the ball sleeve 84 has shifted downward to its lowermost position. Also depicted are two illustrative upper ports 93 in the lower segment 54, two illustrative lower ports 95 in the lower segment 54 and various sections of tubing 79. Shifting of the ball sleeve 84 downward exposes the upper ports 93 thereby permitting fluid pressure within the lower segment 54 above the ball 78 to be communicated to the pressure switch 75 via the tubing and lower ports 95. Once the ball sleeve had been shifted, the pressure within the lower segment 54 may be increased to a level sufficient to fire the perforation gun 71.

Figure 21:
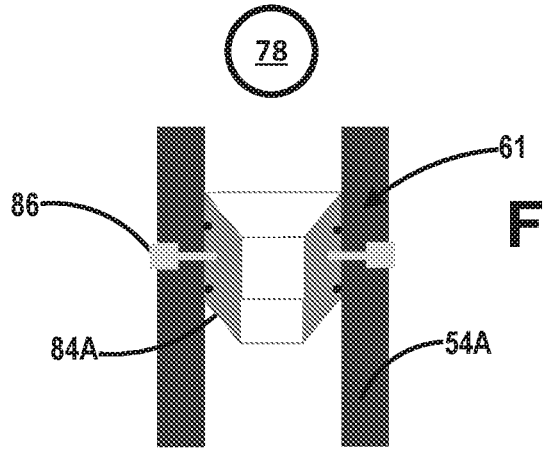
FIGS. 21-23 depict one illustrative example of various ball seats that may be employed with one embodiment of a P&A tool disclosed herein that may be employed when forming an upper plug in the process of abandoning an oil and gas well.
Figure 22:
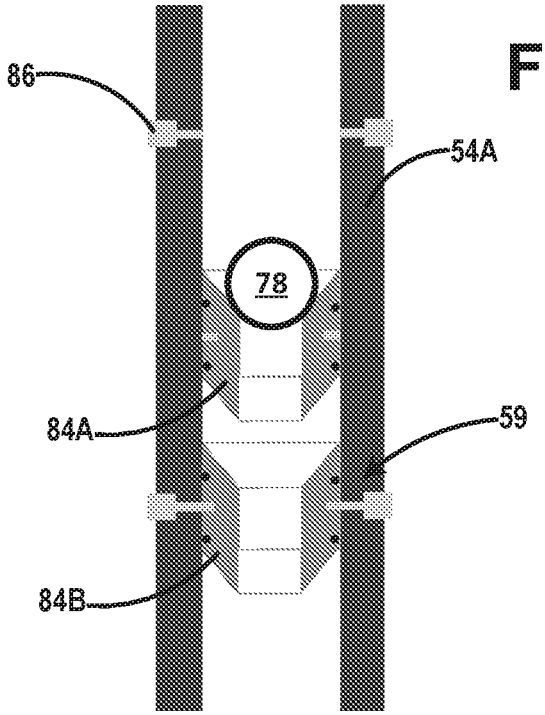
Figure 23:
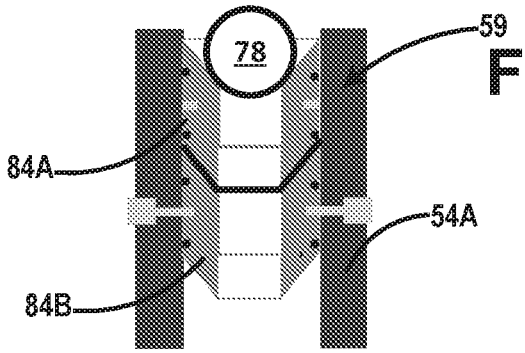

FIGS. 21-23 depict one illustrative example wherein the ball sleeve 84 for one of the perforations means 57, 59, 61 and 62, may serve as a so-called "drop dart" that will land in another ball sleeve positioned deeper in the well 12 so as to enable actuation of a component of the lower segment 54 that is positioned deeper within the well 12. By way of example only, the second and third perforation means 59, 61 will be referenced to explain this aspect of the subject matter disclosed herein. FIG. 21 shows the third perforation means 61 at a point prior to the ball 78 landing in a ball sleeve 84A and wherein the ball sleeve 84A is pinned to the lower section 54 by the shear pins 86. After the ball 78 has landed in the ball sleeve 84A, pressure may be increased above the ball 78 so as to actuate the third perforation means 61. As some point thereafter, the pressure above the ball 78 may be increased so as to shear the pins 86 holding the ball seat 84A in position. FIG. 22 depicts the tool 50 after the ball seat 84A (with the ball 78 still landed therein) has been released from its initial location in perforation means 61 and is traveling downward within the lower segment toward the pinned ball seat 84B associated with the second perforation means 59. FIG. 23 depicts the tool 50 after the ball seat 84A (with the ball 78 therein), i.e., the drop-dart, has fully landed in the ball seat 84B in the second perforation means 59. The combination of the ball 78 and the ball sleeve 84A block fluid flow through the ball sleeve 84B associated with the second perforation means 59. At this point, the pressure within the lower segment 54 above the ball 78 may be increased so as to fire the gun(s) 71 at the second perforation means 59.

Figure 24:
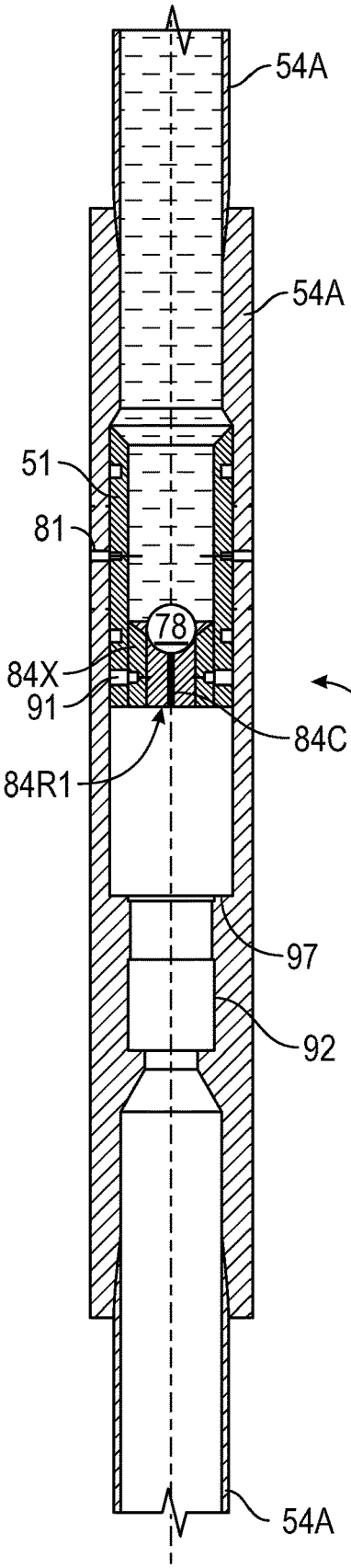
FIGS. 24-29 depict another illustrative example of various ball seats that may be employed with one embodiment of a P&A tool disclosed herein that may be employed when forming an upper plug when abandoning an oil and gas well.
Figure 25:
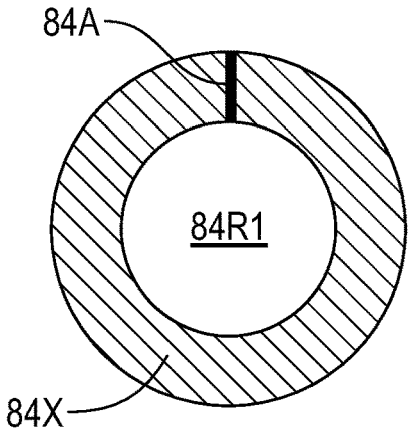
Figure 26:
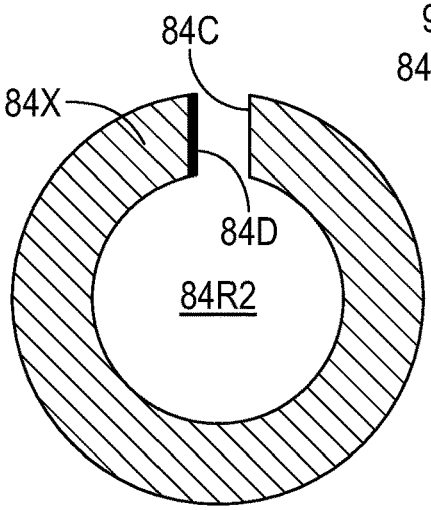

FIGS. 24-29 depict another illustrative example of the body 54A of the lower segment 54 of the tool and the ball seats 84 that may be employed in some embodiments of the system 10 disclosed herein. In this embodiment, a sliding sleeve 51 is positioned within and pinned to the body 54A of the lower segment 54 by one or more shear pins 81 (shown in the non-sheared condition in FIG. 24. FIGS. 25 and 26 are plan views of one illustrative embodiment of a split-ring ball sleeve 84X that may be employed with the tool 50 disclosed herein. In general, the split-ring ball sleeve 84X is configured and designed such that in its initially installed position within the lower segment 54, the opening 84R1 (see FIGS. 24 and 25) in the ball sleeve 84X is of a size that will not permit the ball 78 to pass through the ball sleeve 84X. However, in this embodiment, the ball sleeve 84X can be downwardly-shifted within the lower segment 54 to a second lower position wherein the ball sleeve 84X expands into a recess 92 (see FIG. 29) at which point the effective size of the opening 84R2 in the ball sleeve 84X is increased (see FIG. 26) such that it will permit the ball 78 to pass and thereby travel further downward within the lower segment 54.

FIG. 24 depicts the tool 50 after the ball 78 is landed in the ball sleeve 84X of a perforation means, such as the third perforation means 61 that is positioned above the packer 66. The ball sleeve 84X is pinned to the sliding sleeve 51 by one or more shear pins 91 (shown in the non-sheared condition in FIG. 19). This split-ring type of ball sleeve 84X may be present in all or some of the perforation means 57, 59, 61 and 62. As depicted, the split-ring ball sleeve 84X is split or cut axially, as indicated by the reference numeral 84C. FIG. 25 depicts the split-ring ball sleeve 84X in its non-expanded or closed state, while FIG. 26 depicts the split-ring ball sleeve 84X in its expanded or open state. With reference to FIG. 26, it should also be noted that a sealing material 84D, e.g., a section of rubber, may be applied to one or both sides of the ends of the split-ring ball sleeve 84X at the location of the cut 84C so as to enhance the sealing characteristics of the split-ring ball sleeve 84X when it is closed. The split-ring ball sleeve 84X is manufactured such that it is in its open state (see FIG. 26) prior to the split-ring ball sleeve 84X being positioned within the lower segment 54. Accordingly, when the split-ring ball sleeve 84X is closed (see FIG. 25) and positioned in the lower segment 54, as shown in FIG. 24, it is biased so as to return to it open configuration shown in FIG. 26. With reference to FIG. 24, in this embodiment, the body 54A of the lower segment 54 comprises a ball seat recess 92 defined therein that is adapted to receive the split-ring ball sleeve 84X when it is in its expanded or opened state.

Figure 27:
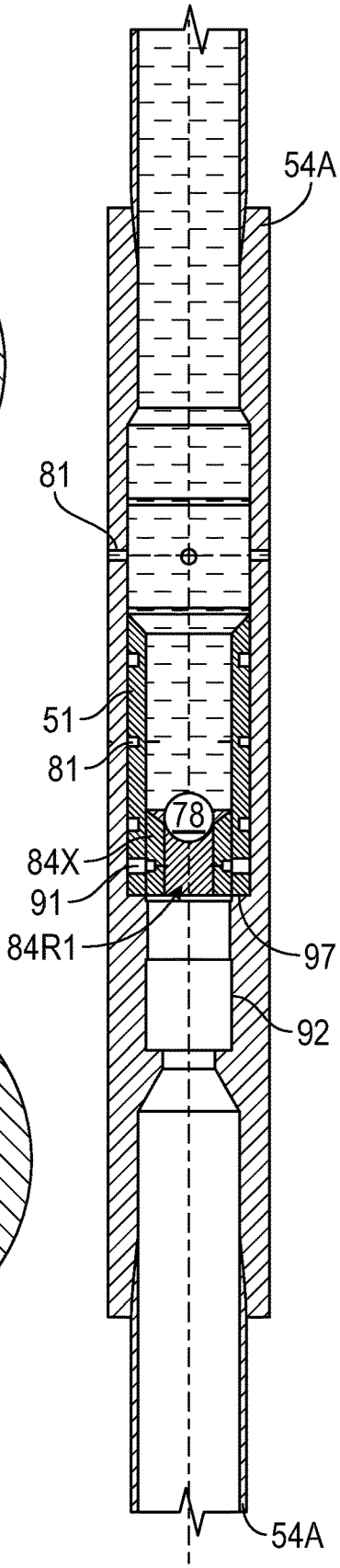
Figure 28:
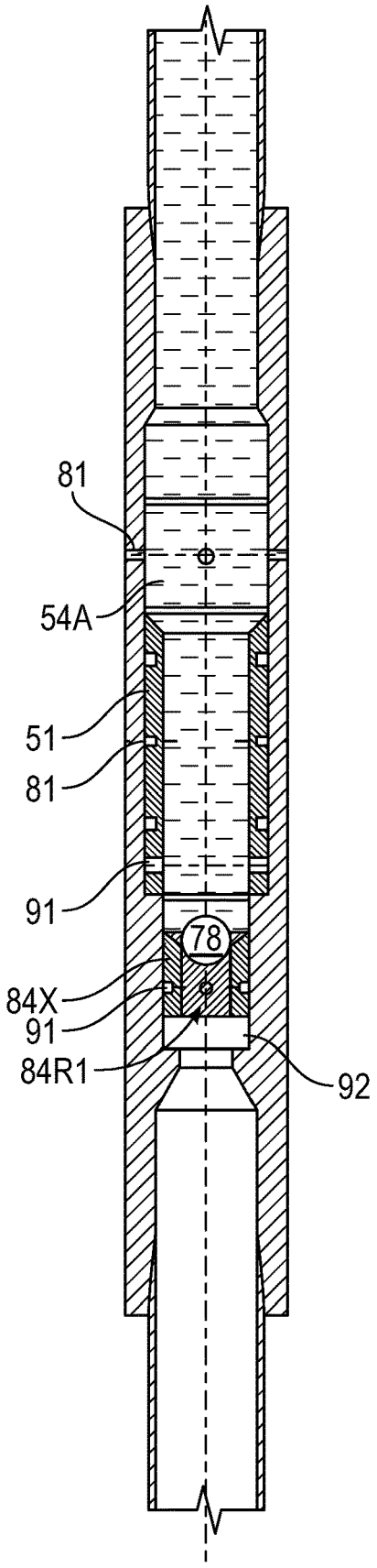
Figure 29:
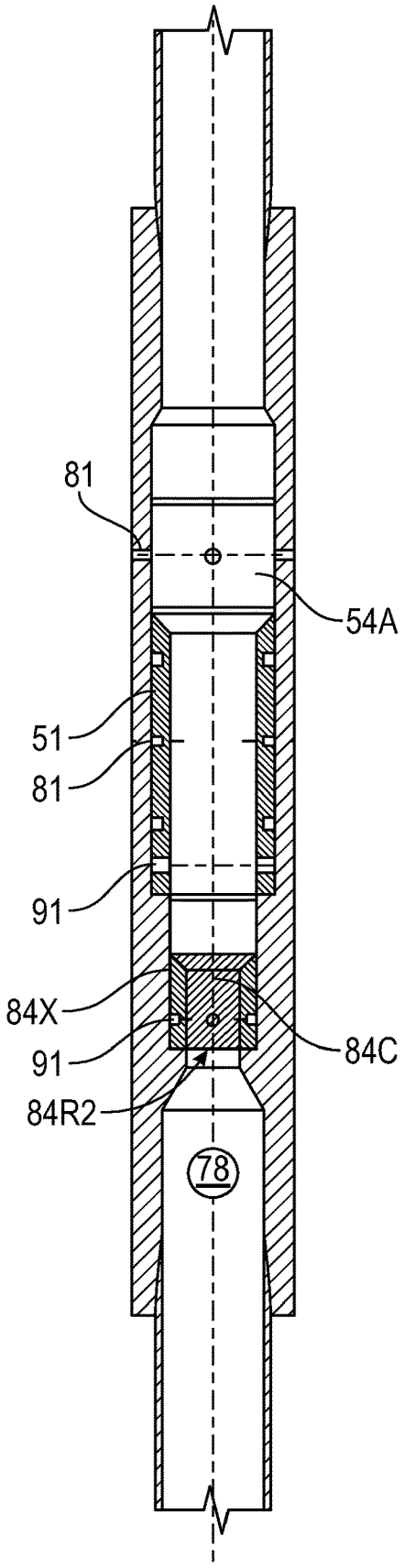

With reference to FIG. 24, in operation, the ball 78 is initially landed in the split-ring ball sleeve 84X with the shear pins 81 intact. At that time, pressure above the ball 78 is increased so as to shear the pins 81 thereby releasing the sleeve 51 to travel downward within the body 54A of the lower segment 54 until such time as the sleeve 51 shifts to its lowermost position and lands on the shoulder 97, as shown in FIG. 27. At this point in time, the pressure within the lower segment 54 above the ball 78 may be increased so as to fire the gun(s) 71 at the perforation means associated with the split-ring ball sleeve 84X. Thereafter, as shown in FIG. 28, the pressure within the lower segment 54 above the ball 78 was further increased so as to shear the shear pins 91 and thereby free the split-ring ball sleeve 84X to move downward relative to the sleeve 51. FIG. 29 depicts the tool 50 after the split-ring ball sleeve 84X has traversed far enough down the lower segment 54 such that it is aligned with the ball seat recess 92. At this point, as shown in FIG. 29, the split-ring ball sleeve 84X returns or expands to its original opened configuration (see FIG. 26) and expands or "springs" into the ball seat recess 92, thereby increasing the size of the opening in the split-ring ball sleeve 84X which allows the ball 78 to pass through the now-opened split-ring ball sleeve 84X. The pressure behind the ball 78 may also assist in urging the portions of the split-ring ball sleeve 84X into the ball seat recess 92.

FIGS. 30-34 depict another illustrative example of the body 54A of the lower segment 54 of the tool and the ball seats 84 that may be employed in some embodiments of the system 10 disclosed herein. This example of a ball seat may be present in all or some of the perforation means 57, 59, 61 and 62. As before, in this embodiment, the above-described sliding sleeve 51 is positioned within and pinned to the body 54A of the lower segment 54 by one or more shear pins 81 (not shown in FIGS. 30-34) and the above-described split-ring ball sleeve 84X is pinned to the sliding sleeve 51 by one or more shear pins 91 (shown in the un-sheared condition in FIG. 30). The above-described ball seat recess 92 was also formed in the body 54A of the lower segment 54. In this embodiment, a ratchet sleeve 94 is positioned below the split-ring ball sleeve 84X. The ratchet sleeve 94 has a split-ring configuration with a longitudinal slot 94A defined therein and a plurality of external teeth 94B formed on the outer surface of the ratchet sleeve 94. The external teeth 94B are adapted to engage a plurality of internal teeth 96 formed on the inner surface of the body 54A of the lower segment 54. In one illustrative example, the external teeth 94B may be formed with a negative rake angle such that upward movement of the ratchet sleeve 94 after the external teeth 94B have engaged with the internal teeth 96 will be much more difficult. FIG. 33 depicts the split-ring ball sleeve 84X in its non-expanded or closed state, while FIG. 34 depicts the split-ring ball sleeve 84X in its expanded or open state. Note that the opening 94A in the ratchet sleeve 94 is sized such that it permits the ratchet sleeve 94 sleeve to deform, i.e., the opening 94A may become smaller, so as to permit the external teeth 94B on the ratchet sleeve 94 to ride over the internal teeth 96 as the ratchet sleeve 94 is urged downward.

As before, with reference to FIG. 30, the ball 78 is initially landed in the split-ring ball sleeve 84X with the shear pins 81 intact. At that time, pressure above the ball is increased so as to shear the pins 81 thereby releasing the sleeve 51 to travel downward within the body 54A of the lower segment 54 until such time as the sleeve lands on the shoulder 97, as shown in FIG. 30. At this point in time, the pressure within the lower segment 54 above the ball 78 may be increased so as to fire the gun(s) 71 at the perforation means associated with the split-ring ball sleeve 84X. Thereafter, as shown in FIG. 31, the pressure within the lower segment 54 above the ball 78 was further increased so as to shear the shear pins 91 and thereby free the split-ring ball sleeve 84X to move downward relative to the sleeve 51. This action also forces more of the external teeth 94B into engagement with the internal teeth 96 on the body 54A. FIG. 32 depicts the tool 50 after the split-ring ball sleeve 84X has traversed far enough down the lower segment 54 such that it is aligned with the ball seat recess 92 and after the ratchet sleeve 94 is driven downward it to its fully engaged position with the body 54A. At this point, as shown in FIG. 32, the split-ring ball sleeve 84X returns or expands to its original opened configuration (see FIG. 32) and expands or "springs" into the ball seat recess 92, thereby increasing the size of the opening in the split-ring ball sleeve 84X which allows the ball 78 to pass through the opened split-ring ball sleeve 84X. The pressure behind the ball 78 may also assist in urging the portions of the split-ring ball sleeve 84X into the ball seat recess 92. The inside diameter of the ratchet sleeve 94 is large enough to permit passage of the ball 78. As with the previous embodiment that comprised the split ring ball sleeve 84X, this embodiment permits the ball sleeve 84X to be moved from a first position where the opening 84R1 is the ball sleeve 84X will not permit the ball 78 to pass to a second position wherein the effective size of the opening 84R2 is increased to a size that will permit the ball 78 to pass.

Figure 35:
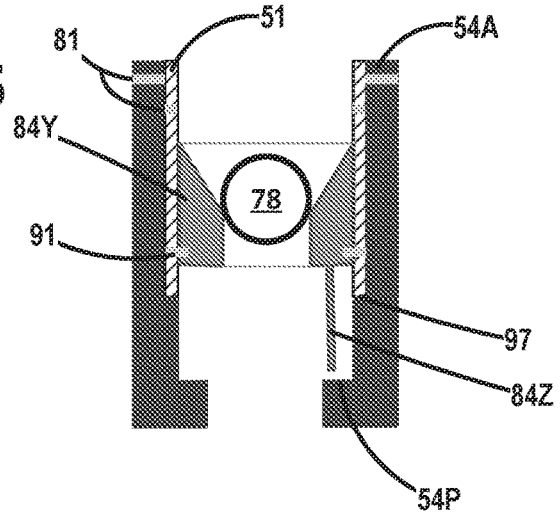
FIGS. 35-37 depict yet a further illustrative example of various ball seats that may be employed with one embodiment of a P&A tool disclosed herein that may be employed when forming an upper plug when abandoning an oil and gas well.
Figure 36:
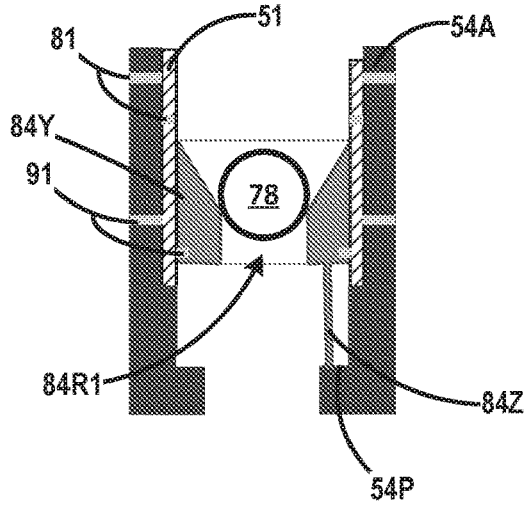
Figure 37:
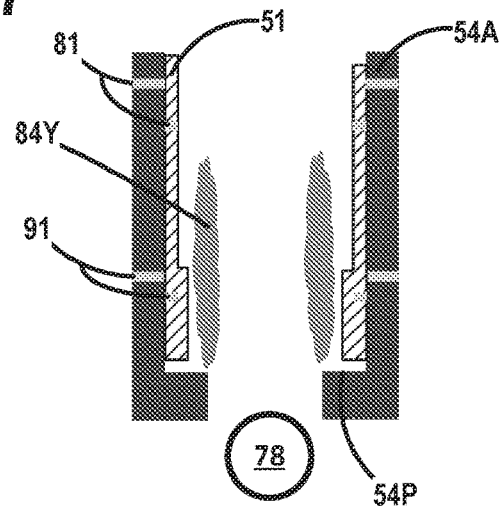

FIGS. 35-37 depict yet another illustrative example of the body 54A of the lower segment 54 of the tool and the ball seats 84 that may be employed in some embodiments of the system 10 disclosed herein. In this embodiment, the ball sleeve 84Y is made of a ceramic material and it is manufactured in such a way so as to take advantage of the characteristics associated with the well-known Rupert's drop properties of ceramic material made by rapidly cooling molten ceramic material. This process creates compressive stress in the outer surface of the ball sleeve 84Y while the interior portions of the material of the ball sleeve 84Y remain in tension. As depicted, the ball seat is manufactured such that a very small segment or tail 84Z of the ball sleeve 84Y extends downward from the main body of the ball sleeve 84Y. In this embodiment, the body 54A comprises a shoulder 54P that is adapted to engage the tail 84Z of the ball sleeve 84Y after it is released. In this particular example, the above-described sliding sleeve 51 is positioned within and pinned to the body 54A of the lower segment 54 by one or more shear pins 81 (shown in the sheared condition in FIGS. 35-37). The ceramic ball sleeve 84Y is pinned to the sliding sleeve 51 by one or more shear pins 91 (shown in the un-sheared condition in FIG. 35). This example of a hall seat may be present in all or some of the perforation means 57, 59, 61 and 62. This embodiment of the ball sleeve 84Y also permits the ball sleeve 84Y to be moved from a first position where the opening 84R1 is the ball sleeve 84*y* will not permit the ball 78 to pass to a second position wherein the ball sleeve 84Y is effectively destroyed thereby permitting the ball 78 to pass deeper into the lower segment.

With reference to FIG. 35, the ball 78 is initially landed in the ceramic ball sleeve 84Y with the shear pins 81 intact. At that time, pressure above the ball 78 is increased so as to shear the pins 81 thereby releasing the sleeve 51 to travel downward within the body 54A of the lower segment 54 until such time as the sleeve lands on the shoulder 97, as shown in FIG. 35). At this point in time, the pressure within the lower segment 54 above the ball 78 may be increased so as to fire the gun(s) 71 at the perforation means associated with the ball sleeve 84Y. Thereafter, as shown in FIG. 36, the pressure within the lower segment 54 above the ball 78 was increased so as to shear the shear pins 91 and thereby freeing the ceramic ball sleeve 84Y to move downward relative to the sleeve 51. FIG. 36 depicts the ball sleeve 84Y just prior to the tail 84Z contacting the shoulder 54P. FIG. 37 depicts the tool 50 after the ball sleeve 84Y has traversed far enough down the lower segment 54 such that the tail 84Z engages the shoulder 54P and the tail 84Z is broken. Breaking the tail 84Z releases of the compressive force in the outer surface of the ball sleeve 84Y thereby releasing the previously bound-up tensile forces within the inner portion of the ball sleeve 84Y. As a result, the ceramic ball sleeve 84Y simply shatters, as simplistically depicted in FIG. 37.

In one illustrative example depicted herein, the tool 50 may have the configuration like the tool 50 shown in FIG. 5 with four perforation means 57, 59, 61 and 62. FIGS. 38-42 depict one illustrative the ball dropping sequence to fire the four perforation means in the tool 50 in the following order: step 1—the first means 57 (below the packer 66) is fired to establish casing shoe conductivity; step 2—the third means 61 (above the packer 66) is fired to establish 61 casing annulus circulation; step-3—the second means 59 (below the packer 66) is fired to establish next outer casing shoe conductivity; and step 4—the fourth means 62 (above the packer 66) is fired to establish next outer casing annulus circulation. This illustrative sequential firing order is depicted in blocked numbers (from the bottom 1, 3, 2, 4) on the right side of FIG. 42. Note that, using the novel ball sleeves 84X, 84Y in some embodiments disclosed herein, the firing of the various means need not be performed sequentially upward from the lowermost ball sleeve to the uppermost ball sleeve within the lower segment 54. Rather, in some embodiments of the methods and systems disclosed herein, the perforation means may be fired in such an order that a perforation means located higher in the lower segment 54, e.g., the third perforation means 61 is fired before a perforation means positioned lower within the lower segment 54, e.g., the third perforation means 59 is fired.

Figures 38, 39, 40, 41, 42:
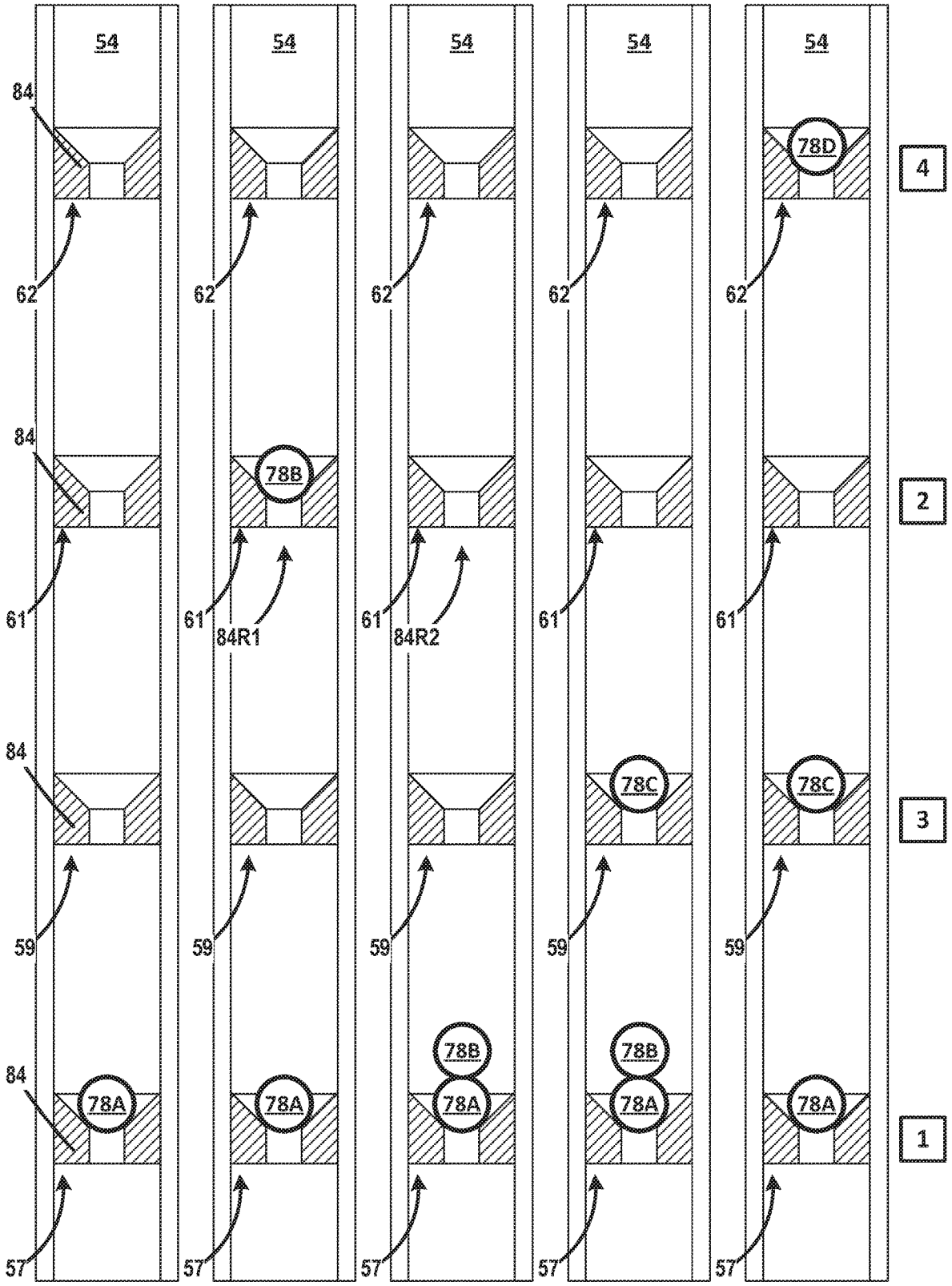
FIGS. 38-42 depict an illustrative example of a ball drop sequence that may be employed when using one illustrative embodiment of a P&A system disclosed herein.

FIG. 38 depicts the tool 50 at a point in time wherein a first ball 78A has landed in the first perforation means 57. The ball 78A is sized such that it passes through the ball sleeves 84 associated with the perforation means 59, 61 and 62. At that point, pressure may be increased above the ball 78A to fire the guns associated with the first perforation means 57.

FIG. 39 depicts the tool 50 at a point in time wherein a second ball 78B has landed in the third perforation means 61. The ball 78B is sized such that it passes through the ball sleeve 84 associated with the fourth perforation means 62. The ball 78B is smaller in diameter than the ball 78A. Note, no attempt has been made in the drawings to show actual difference in the size of the balls 76A-76D or in the size of the openings in the ball sleeves 84. In this example, the ball sleeve 84 of the third perforation means 61 is one of the ball sleeves 84X or 84Y described above. Thus, at the point in time shown in FIG. 39, the ball sleeve 84 has a relatively smaller opening 84R1 that will block the ball 78B from passing. At that point, pressure may be increased above the ball 78B to fire the guns associated with the third perforation means 61.

FIG. 40 depicts the tool 50 after the guns as the third perforation means 61 were fired and after the pressure was further increased above the ball 78B to cause the ball sleeve 84 to move further downward within the third perforation means 61 thereby permitting the ball 78B to pass through the ball sleeve 84 associated with the third perforation means 61. In the case where the ball seat 84 at the third perforation means 61 is one like the above-described split-ring ball seat 84X, this would involve shifting the ball sleeve 84X downward until such time as it is aligned with and expands into the recess 92 in the lower segment 54 thereby increasing the size of the opening to the larger diameter 84R2. In the case where the ball sleeve associated with the third perforation means 61 is like the ceramic ball sleeve 84Y described above, the pressure was increased above the ball 78B so as to shift the ball sleeve 84Y downward until such time the tail 84Z of the ball sleeve 84Y contacted the shoulder and caused the ball sleeve 84Y to effectively disintegrate. Note the opening in the ball sleeve 84 associated with the second perforation means 59 is sized so as to also permit the ball 78B to pass and come to its final resting position above the ball 78A as shown in FIG. 40.

FIG. 41 depicts the tool 50 at a point in time wherein a third ball 78C has landed in the second perforation means 59. The ball 78C is sized such that it passes through the ball sleeve 84 associated with the perforation means 62 and 61. The ball 78C is smaller in diameter than the ball 78B. At that point, pressure may be increased above the ball 78C to fire the guns associated with the second perforation means 59.

FIG. 42 depicts the tool 50 at a point in time wherein a fourth ball 78D has landed in the fourth perforation means 62. The ball 78D is smaller in diameter than the ball 78C. At that point, pressure may be increased above the ball 78D to fire the guns associated with the fourth perforation means 62.

FIGS. 43-46 depict one illustrative example of a prior art ball drop sequence in the context of a fracturing operation to show how various embodiment of the P&A system disclosed herein operate relative to other systems found in the oil and gas industry that involve the dropping of balls to perform various downhole activities, such as fracturing operations. FIGS. 43-46 depict the casing 210 of the prior art well described in the background section of the application. In one illustrative example, a plurality of packers 251-254 may be positioned and anchored within the well. At that point, a plurality of balls 99A-99D of increasingly larger size are dropped into the well so as to engage the packers 251-254, respectively, in that order.

Figure 43:
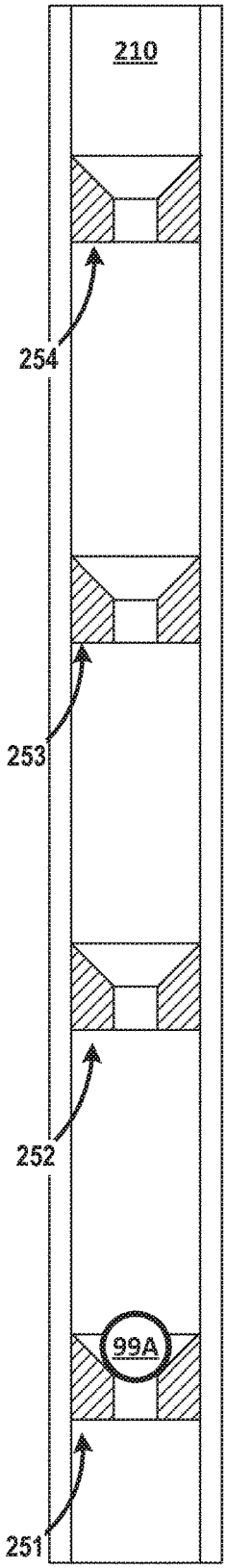
Fig. 43 (Prior Art)
FIGS. 43-46 depict one illustrative example of a prior art ball drop sequence in the context of a fracturing operation.

FIG. 43 depicts the well at a point in time wherein a first frac ball 99A has been dropped and has landed in the lowermost packer 251. The ball 99A is sized such that it passes through the packers 254, 253 and 251. At that point, after perforating the casing between the packers 251 and 252, the pressure in the well above the first frac ball 99A may be increased so as to extend or create fractures in the surrounding formation using known fracturing techniques.

Figure 44:
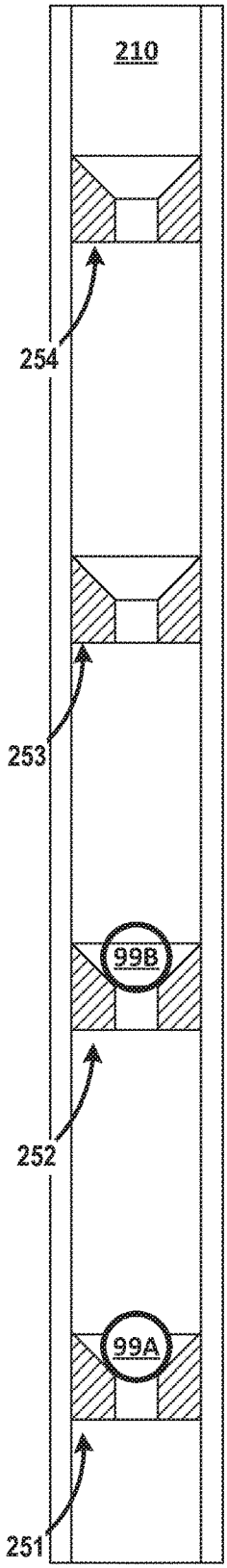
Fig. 44 (Prior Art)

FIG. 44 depicts the well at a point in time wherein a second frac ball 99B has been dropped and has landed in the packer 252, the second packer from the bottom. The ball 99B is larger in diameter than the ball 99A. Note, no attempt has been made in the drawings to show actual difference in the size of the balls 99A-99D or in the size of the openings in the packers 251-254. The ball 99B is sized such that it passes through the packers 254 and 253. At that point, after perforating the casing between the packers 252 and 253, the pressure in the well above the first frac ball 99B may be increased so as to extend or create fractures in the surrounding formation using known fracturing techniques.

Figure 45:
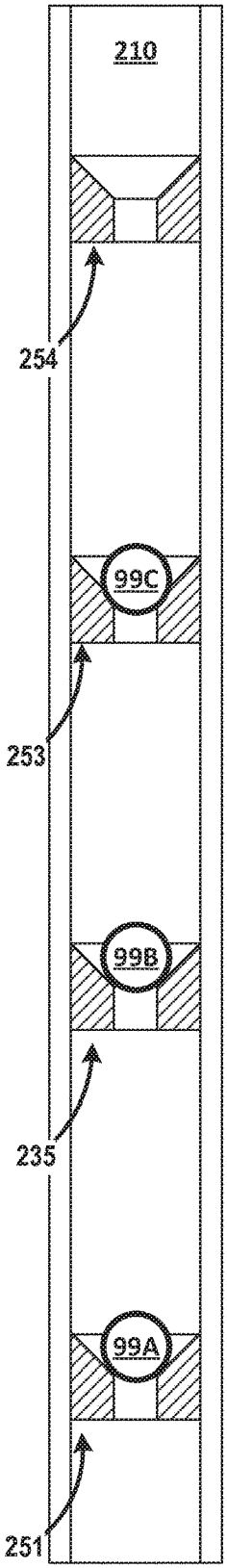
Fig. 45 (Prior Art)

FIG. 45 depicts the well at a point in time wherein a third frac ball 99C has been dropped and has landed in the packer 253, the third packer from the bottom. The ball 99C is larger in diameter than the ball 99B. The ball 99C is sized such that it passes through the packer 254. At that point, after perforating the casing between the packers 253 and 254, the pressure in the well above the third frac ball 99C may be increased so as to extend or create fractures in the surrounding formation using known fracturing techniques.

Figure 46:
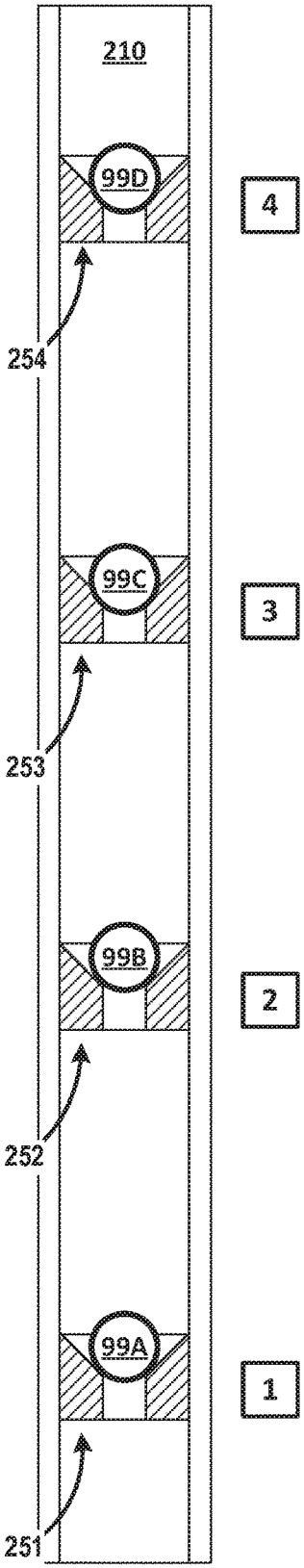
Fig. 46 (Prior Art)

FIG. 46 depicts the well at a point in time wherein a fourth frac ball 99D has been dropped and has landed in the packer 254, the uppermost packer within the well. The ball 99D is larger in diameter than the ball 99C. At that point, after perforating the casing above the packer 254, the pressure in the well above the fourth frac ball 99D may be increased so as to extend or create fractures in the surrounding formation using known fracturing techniques.

The illustrative ball drop sequence depicted in FIGS. 43-46 is indicated in blocked numbers (from the bottom 1, 2, 3, 4) on the right side of FIG. 46. Note that in oil field applications involving the dropping of balls into a well, the ball drop sequence in normally like that depicted in FIG. 43-46 wherein the balls are sized so as to land a first ball on the lowermost component first, e.g., the first packer 251, then a second ball is landed on the next packer positioned well above the first packer 251, e.g., the second packer 252. This process is repeated as one "backs out of the well" processing ever higher sections within the well in a sequential order from low to high within the well. In contrast, in one illustrative embodiment disclosed herein, wherein the system comprises at least four perforation means, the novel abandoning process disclosed herein involves "jumping" around within the well to process different section of the well. More specifically, in the illustrative method disclosed above in connection with FIGS. 38-42, the process actions are not performed in a straight "bottom-to-top" process flow. Rather, in the novel ball dropping and firing sequence used to actuate the four perforation means (57, 59, 61 and 62) in the tool 50 described above involved dropping the first ball 78A so as to enable firing of the lowermost perforation means 57. Thereafter, the second ball 78B was dropped so as to enable firing of the perforation means positioned number 3 from the bottom, i.e., the perforation means 61. That is, in the novel process described above the second perforation means from the bottom (means 59) was skipped and the third perforation means from the bottom (means 61) was fired. Next, the third ball 78C was dropped so as to enable firing of the perforation means positioned number 2 from the bottom, i.e., the perforation means 59. Then, the fourth ball 78D was dropped so as to enable firing of the uppermost perforation means positioned number 3 from the bottom, i.e., the perforation means 61 (below the packer 66) is fired: step 2—the third means 61 (above the packer 66) is fired; step-3—the second means 59 (below the packer 66) is fired; and step 4—the fourth means 62 (above the packer 66) is fired. This illustrative sequential firing order is depicted in blocked numbers (from the bottom 1, 3, 2, 4) on the right side of FIG. 42.

FIGS. 47-61 depict one illustrative example of how the system 10 disclosed herein may be employed to form an upper plug in a well. Again, the following description assumes that a lower plug has already been formed in the well 12 and that an upper portion of the production tubing (not shown) and a production tree (not shown) have already been removed from the well 12 as part of the lower plug abandonment operations. Formation of the lower plug within the well results in the temporary killing of the well and thereby allows the removal of the original well control package on the well in order to permit the removal of the production hardware. After the production hardware is removed, and prior to the attachment of the above-mentioned well control package 14 to the well, the lower segment 54 may be positioned within the now open and unprotected wellhead 15 (i.e., the wellhead 15 with the original well control package removed) as part of the overall process of forming the upper plug, as described more fully below. Additionally, as noted above, even though the production tubing has been removed, the annular space between the plug & abandonment tool 50 and the production casing 22 will still be referred to herein and in the attached claims as the A annulus.

Initially, an inspection tool (not shown) is run into the upper portions of the well to analyze/confirm the conditions of the B and C annuli as well as any cement present in the area where the upper plug will be formed. In one illustrative embodiment, the inspection tool may be a cement bond log/variable density log (CBL (acoustic) or VDL (gamma)) tool. As will be appreciated by those skilled in the art, a good bond log (i.e., no holes or gaps in the cement column 212) constitutes a good barrier. In such a situation, the operator does not have to perforate and circulate additional resin or cement in the outer annuli.

Figure 47:
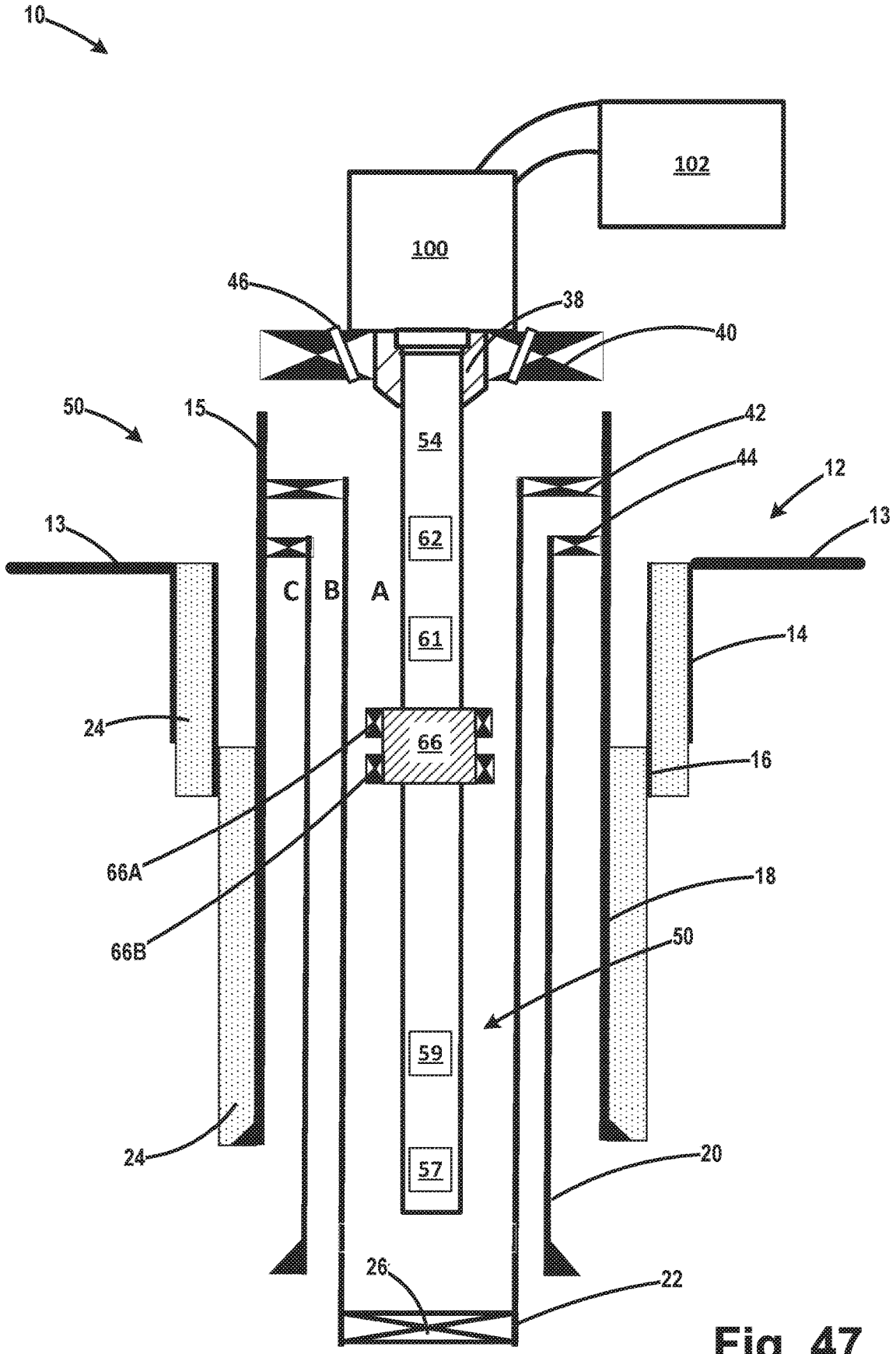
FIGS. 47-64 depict one illustrative example of how an illustrative embodiment of a P&A system disclosed herein that may be employed to form an upper plug in a well during the process of abandoning an oil and gas well.

After the conditions of the well are determined and deemed acceptable, portion of the tool 50 are assembled (either on board a surface vessel or at a land-based facility). That is, the adapter 38 is threadingly coupled to the tool landing structure 40 and the lower segment 54 of the tool 50 is threadingly coupled to the adapter 38. FIG. 47 depicts the well at a point in time where the original BOP (or any other form of well control equipment) has been removed, i.e., the wellhead 15 is in an "open-water" condition as there is no pressure containing equipment attached to the wellhead 15 at this time. Initially, the lower segment 54 will be run into the well under open water conditions. As shown in FIG. 47, a schematically depicted landing head 100 is coupled to the tool landing structure 40. The landing head 100 may be any type of structure that can hold the weight of the assembly (the tool landing structure 40 and the lower segment 54), that has some means for a ROV 102 to be able to grasp the landing head 100, center the assembly as it is lowered into the well 15 and sticks out above of the well 15 for a sufficient length such that the ROV 102 can unlatch landing head 100 from the assembly (the tool landing structure 40 and the lower segment 54). In one illustrative example, the landing head 100 may take the form of a gripping tool that can be threaded and/or groove-locked to the tool landing structure 40. FIG. 47 depicts the system 10 at a point where a portion of the lower segment 54 has been lowered into the well 12 using a schematically depicted ROV 102. Note that, at this point in time, the packer 66 is in its non-engaged state with the expandable seal 66A and the anchor slips 66B in their retracted positions.

As noted above, in one illustrative embodiment, the tool landing structure 40 will be positioned within and contact (e.g., sit on top) on the previously-positioned structure 42 (e.g., the production casing hanger 42) in the wellhead 15. Again, the tool landing structure 40 need not be securely attached (e.g., clamped) to either the previously-positioned structure 42 or the wellhead 15. The tool landing structure 40 is sized and configured such that it can fit within the inside diameter of the wellhead 15 and, when resting on the previously-positioned structure 42, support the weight of the landed assembly (the tool landing structure 40 and the lower segment 54). Note that, due to the tool landing structure 40 simply landing on the previously-positioned structure 42 in the wellhead the tool 50 disclosed herein provides a great deal of operational flexibility in that it may be employed on a variety of different wells having a variety of different structures positioned in the wellhead 15. That is, in one embodiment, the tool 50 may be employed without having to worry about the precise details of various components that were previously positioned in the wellhead 15 since the tool landing structure 40 does not necessarily have to mate or latch to any of these previously installed structures 42, although such mating and/or latching may occur in some applications. This means that the tool 50 disclosed herein is more universal in nature in that it may be used on a variety of different types of wells with a variety of different structures positioned within the wellhead 15.

Figure 48:
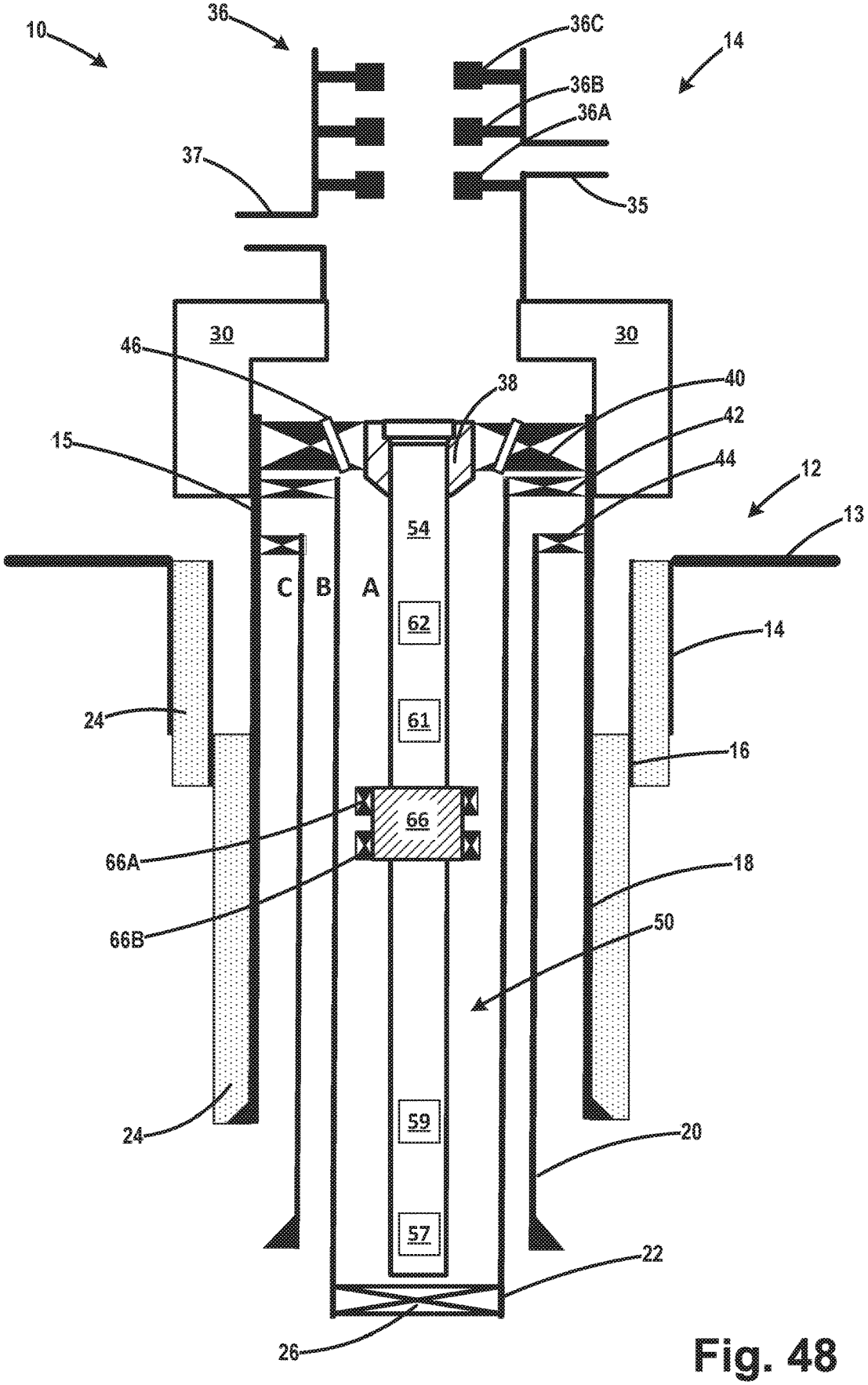

FIG. 48 depicts the system 10 after several operations were performed. First, the tool landing structure 40 was landed into the wellhead housing 15 where, as noted above, it simply rests on the previously-positioned structure 42 below. In one embodiment, the tool landing structure 40 was not connected or clamped to the wellhead housing 15 or any other structure. Thereafter, the landing head 100 was unlatched and removed using the ROV 102. Next, after positioning the lower segment 54 of the tool 50 within the wellhead 15, the various components of the well control package 14 are lowered and locked to the wellhead housing 15 by actuating one or more devices such as the illustrative connector 30. The well control package 14 may be lowered to the well by use of various downlines (not shown) that extend from cranes positioned on a surface vessel (not shown). The ROV 102 may also be used during the lowering of the well control package 14, and the ROV 102 may also be used to actuate the connector 30. At this point, the various rains 36A-C of the BOP remain completely open.

Figure 49:
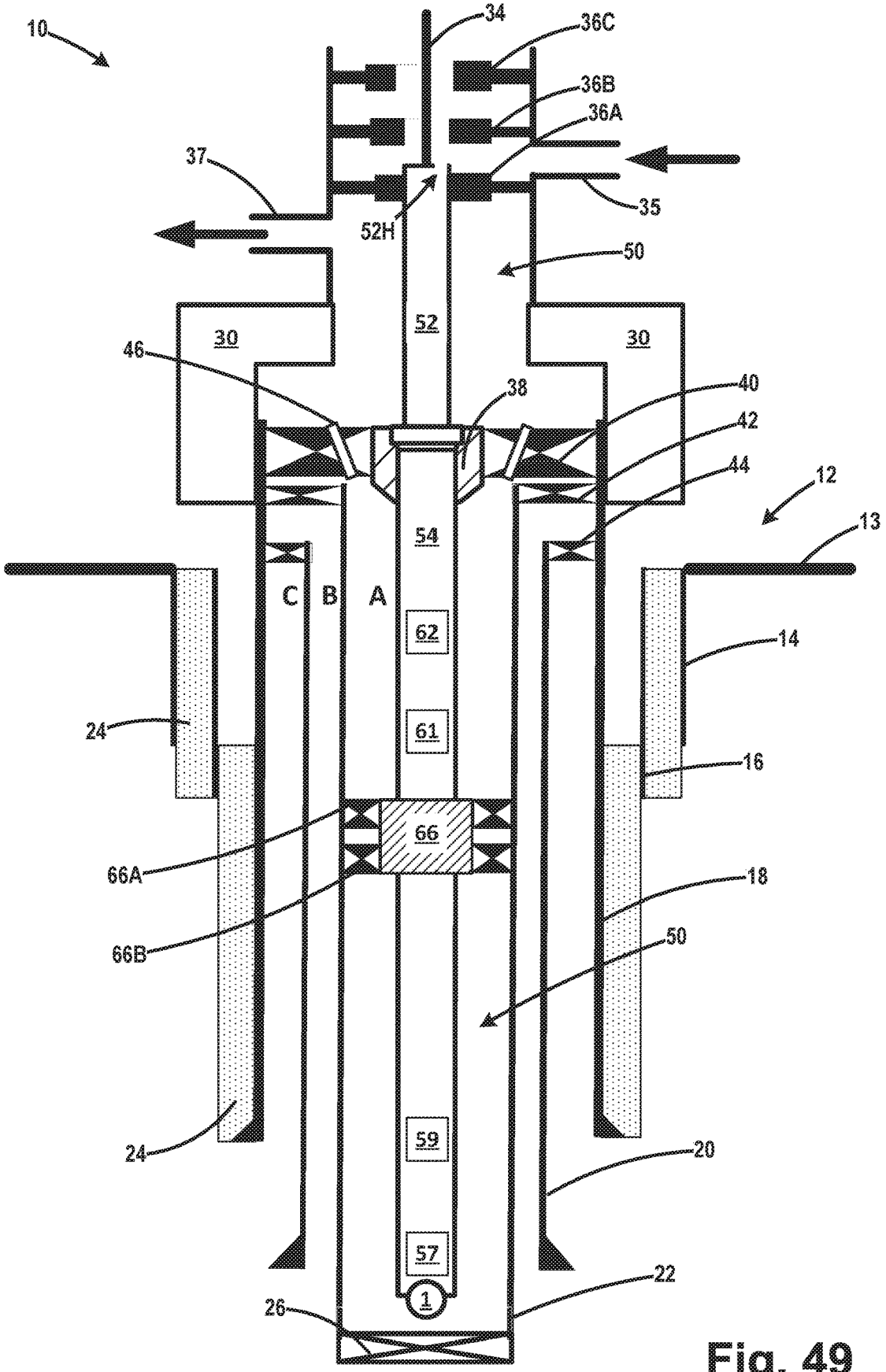

FIG. 49 depicts the system 10 after several operations were performed. First, the ball-carrying segment 52 of the tool 50 was lowered toward the sea floor using the wireline 34. The segment 52 was lowered through the well control package 14 under open water conditions until such time as its lower end is positioned with the polished bore recess 38A (see FIG. 10) defined in the adapter 38 such that the upper segment 52 of the tool 50 is operatively coupled to the lower segment 54 of the tool 50. At that point, the seal ram 36A was energized so as to engage the outer surface 52B of an upper portion of the ball-carrying segment 52 so as to effectuate a seal for a subsequent circulation path. As noted above, the ball-carrying segment 52 is sized and positioned such that when the ball-carrying segment 52 is positioned in the adapter 38, the opening 52H in the ball-carrying segment 52 is vertically positioned above the seal ram 36A. In applications where two seal rains 36A, 36B engage the ball-carrying segment 52, the opening 52H is positioned between the two seal rams 36A, 36B. The seal ram(s) also serve to prevent upward movement of the entire assembly, i.e., the ball-carrying segment 52, the tool landing structure 40, the adapter 38 and the lower segment 54, during the upper plug formation process. Stated another way, the energized seal ram(s) (in combination with the ball-carrying segment 52) act to resist any force that might tend to cause upward movement of the tool landing structure 40 and the lower segment 54. The seal ram(s) are designed such that the sealing elements in the ram(s) grip the ball-carrying segment 52 tighter when pressure below the sealing ram(s) is increased, as will be the case during the creation of the upper plug for the well, as described more fully below. A signal is sent via the wireline 34 to the control and sensor means 53 to open the sliding sleeve 52F and thereby expose the opening 52H (which remains open throughout the remainder of the process operations discussed below).

Thereafter, another signal is sent (via the wireline 34) to the control and sensor means 53 so as to release ball 1 from the ball housing 77. In one example, ball number 1 may have a diameter of, for example, about 1.9 cm (0.75 inches). As depicted, ball 1 is sized such that it passes through all of the components in lower segment 54 and lands in the opening 54X (see FIG. 5) defined in the bottom of the lower segment 54. After ball 1 lands, pressure is applied to the well 12 via the inlet/outlet 35, 37 to pressure test all of the equipment and connections. After the pressure integrity of the system 10 is confirmed, the pressure is increased within the lower segment 54 so as to set the expandable seal 66A and the anchor slips 66B, e.g., the pressure may be increased to about 5000 psi to set the packer 66.

Figure 50:
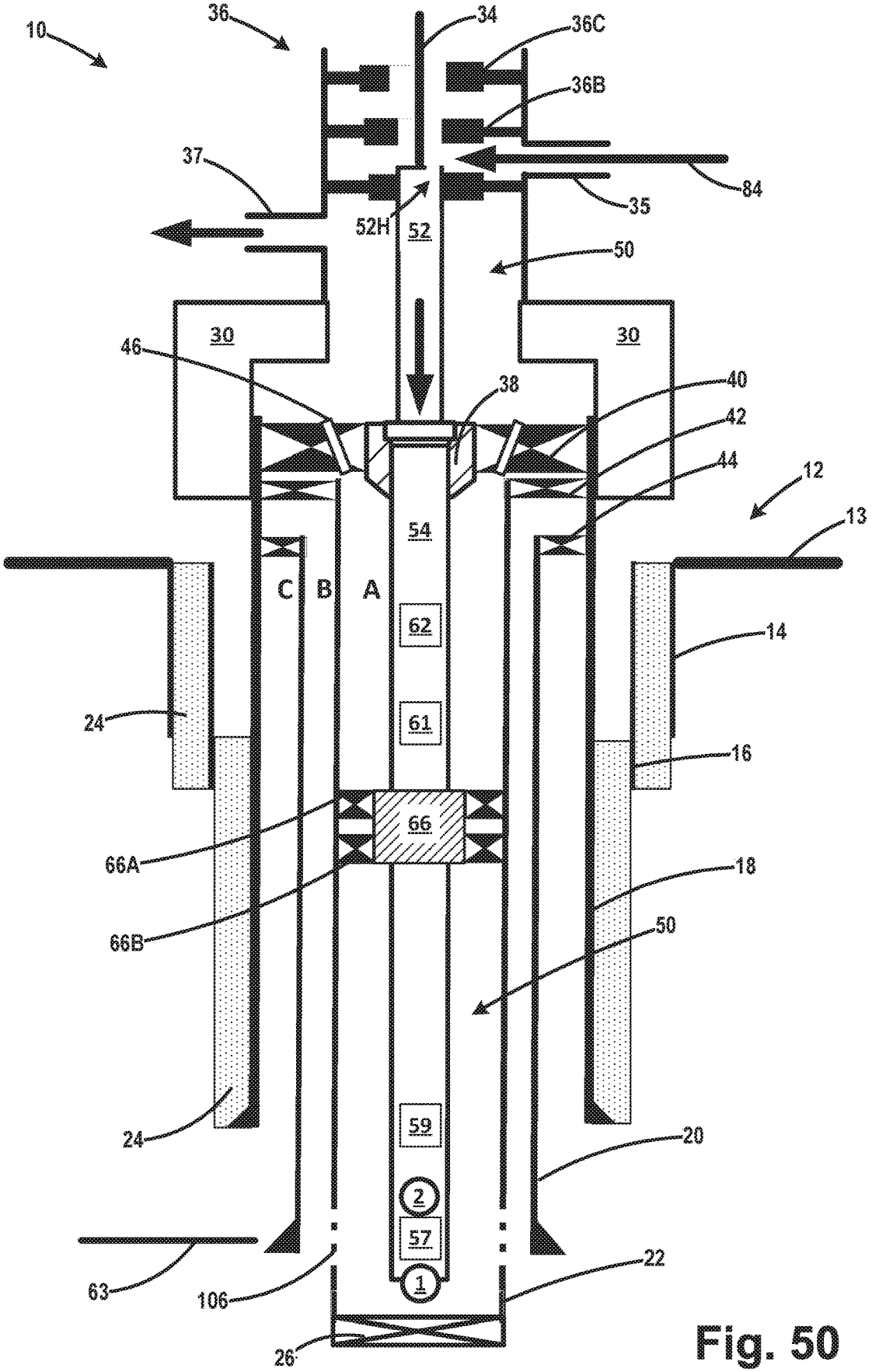
Figure 51:
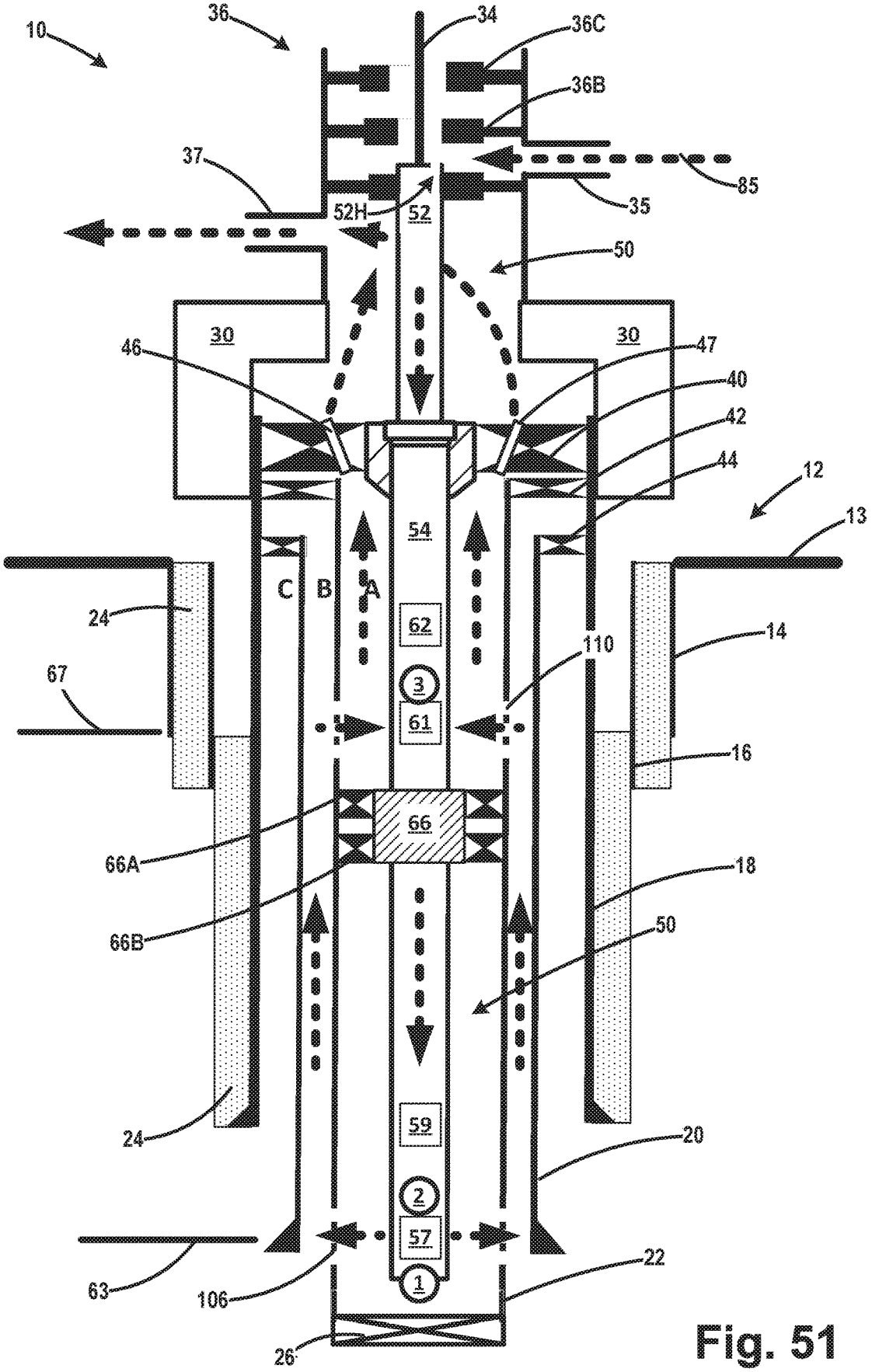

FIG. 50 depicts the system 10 after a signal was sent (via the wireline 34) to the control and sensor means 53 to release ball 2 from the ball housing 77. In one example, ball number 2 may have a diameter of, for example, about 2.54 cm (1.00 inches). As depicted, ball 2 is sized such that it passes through all of the components in lower segment 54 above the first perforation means 57, but it will not pass through the first perforation means 57. Thereafter, fluid (as indicated by the arrow 84) is pumped through the inlet 35, down the down the ball-carrying segment 52 and into the lower segment 54 so as to increase the pressure with the lower segment 54. This causes the sleeve 51 within the lower perforation means 57 to move downward. See the above discussion regarding FIGS. 14-19. At that point, the pressure within the lower segment 54 is increased to the firing pressure selected for the gun(s) 71 associated with the first perforation means 57. This creates openings 106 (e.g., perforations) in the production casing 22 that exposes the B annulus and establishes fluid communication between the A and B annuli. At that point, a pressure test is conducted against the production casing shoe to check for formation continuity and the potential for fluid leak-off. If the pressure test reveals the potential for fluid leak-off, then cement may be pumped into through the openings 106 and into the formation adjacent the openings 106, i.e., cement may be bull-headed into the formation at this location, FIG. 51 depicts the system 10 after several steps were taken. First, a signal was sent (via the wireline 34) to the control and sensor means 53 to release ball 3 from the ball housing 77. In one example, ball number 3 may have a diameter of, for example, about 3.8 cm (135 inches). As depicted, ball 3 is sized such that it passes through all of the components in lower segment 54 above the third perforation means 61, but it will not pass through the third perforation means 61. Thereafter, fluid is pumped through the inlet 35, down the down the ball-carrying segment 52 and into the lower segment 54 so as to increase the pressure with the lower segment 54. The causes the ball sleeve 84 to shift downward and exposes the upper ports 93 thereby permitting fluid pressure within the lower segment 54 above the ball 78 to be transmitted to the pressure switch 75 via the tubing 79 and lower ports 95. See the above discussion regarding FIG. 20. At that point, the pressure within the lower segment 54 is increased to the firing pressure selected for the gun(s) 71 associated with the third perforation means 61. This creates openings 110 in the production casing 22 that exposes the B annulus and establishes fluid communication between the A and B annuli. This operation also creates a B annulus circulation path (as depicted by the dashed lines 85) that will allow fluid to be pumped through the inlet 35 in the well control package 14, into the ball-carrying segment 52, down the lower segment 54, through the openings 106 and into the B annulus, up the B annulus, out of the openings 110 and into the A annulus, out of the fluid passages 46, i.e., the choke and kill lines, in the tool landing structure 40 and out of the outlet 37 of the well control package 14. Note that this circulation path extends from an opening 106 below the packer 66 to an opening 110 above the packer 66. Also note that, in this illustrative example, the openings 106 were formed prior to the openings 110. However, if desired, the openings 110 could be formed prior to the formation of the openings 106.

Figure 52:
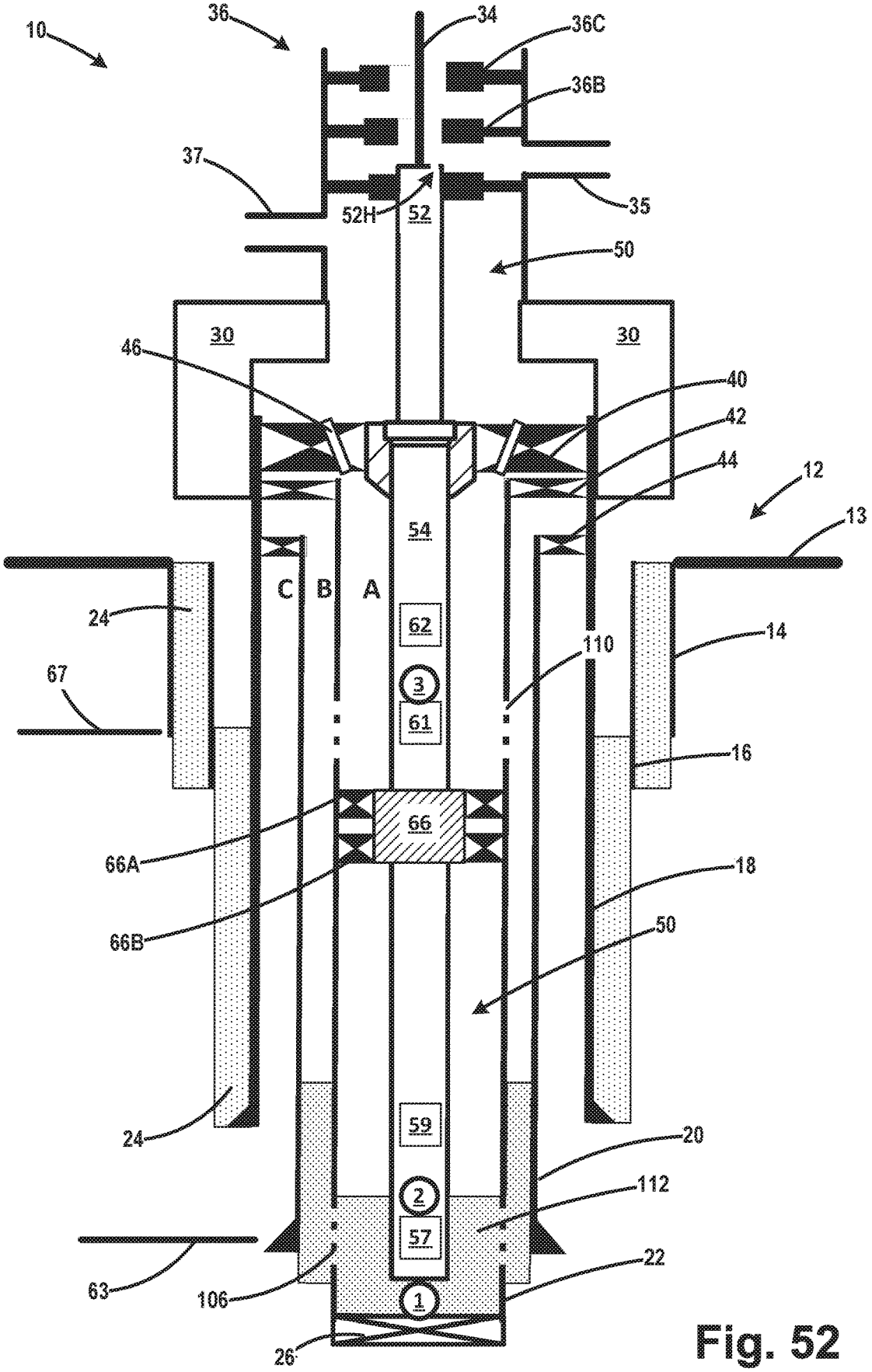

FIG. 52 depicts the system 10 after several steps were taken. After establishing the B annulus circulation path 85, a desired amount of plug material, e.g., cement or a resin material, was pumped into the well 12 until such time the plug material flowed out of the lower openings 106 and into the B annulus. The amount of the plug material circulated may vary depending upon the particular application and the desired size of the resulting plug. At that point pressure was applied to "squeeze" the plug material, and the plug material was allowed to set. These operations result in a balanced first plug 112 that seals off both the A and B annuli. Depending upon the particular application, the first plug 112 may be the only plug that needs to be formed to seal off the upper portion of the well 12. Nevertheless, the following description is provided to depict situations where additional plugs are formed to seal off additional annuli.

Figure 53:
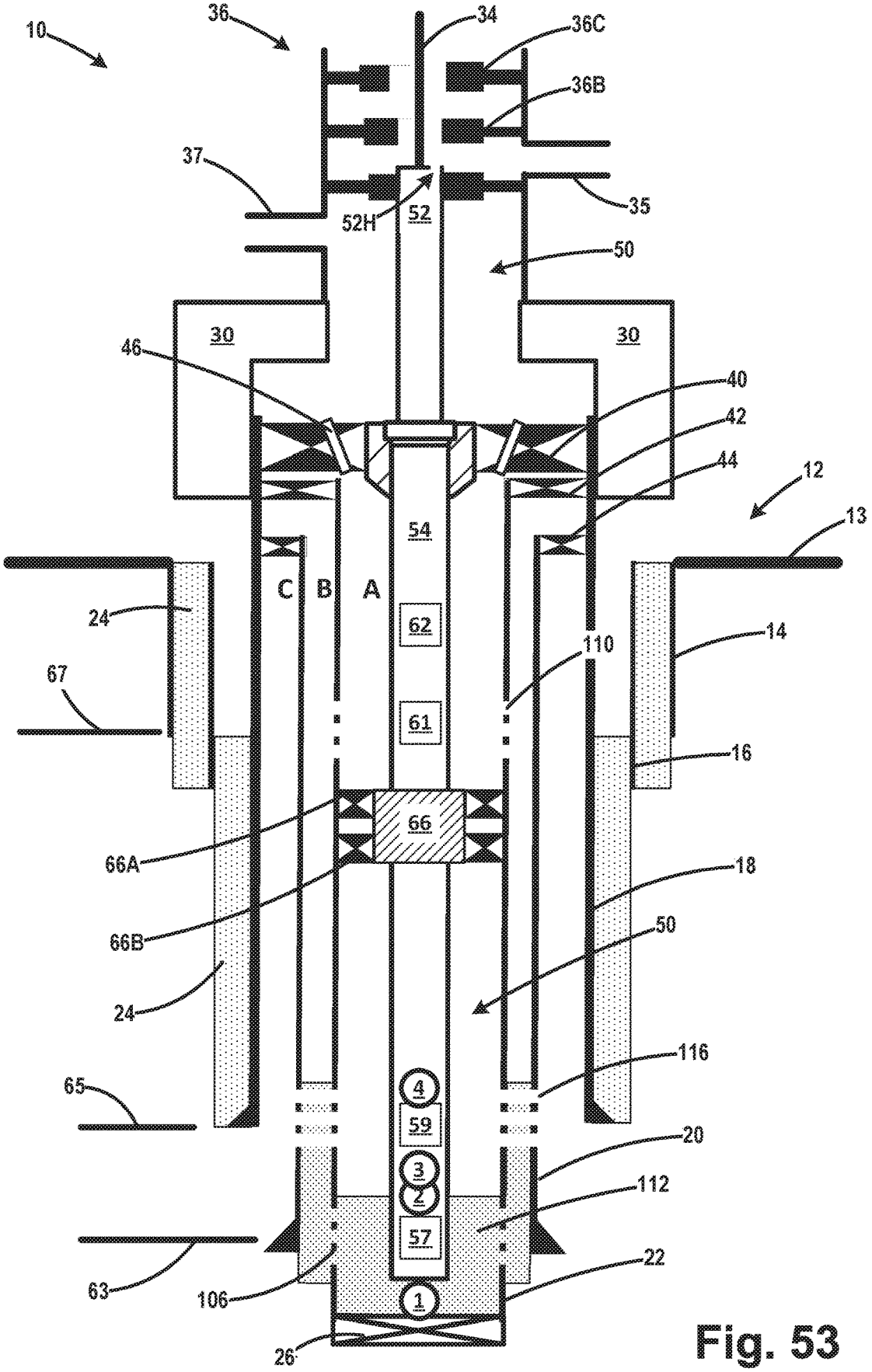

FIG. 53 depicts the system 10 after several steps were taken. After the first plug 112 was formed, ball 3 needs to be removed from the third perforation means 61 so as to allow access to the second perforation means 59 located below the packer 66. Thus, at least the ball sleeve 84 and/or portions of the body 54A of the lower segment associated with the third perforation means 61 will be configured like one of the configurations depicted in FIGS. 21-23, FIGS. 24-29, FIGS. 30-34 or FIGS. 35-37. Accordingly, after the plug 112 is formed, pressure within the lower segment 54 above ball 3 is increased so as to shear the shear pins restraining the sleeve 84 in the third perforation means 61. In turn, this allows the ball sleeve 84 in the third perforation means 61 to serve as a drop dart (see FIGS. 21-23, or it allows the split-ring ball sleeve 84X (see FIGS. 24-29 and FIGS. 30-34) to expand into the ball recess 92, or it allows the ball sleeve 84Y (see FIGS. 35-37) to travel downward until the tail 84Z of the ceramic ball sleeve 84Y contacts the shoulder 54P of the body 54A, thereby effectively disintegrating the ball sleeve 84Y. At that point ball 3 passes through the packer 66 and the second perforation means 59. In the case where ball 3 is released from the third perforation means 61, the opening in the second perforation means 59 is sized such that it will allow ball 3 to pass to its final resting position above ball 2.

Next, a signal was sent (via, the wireline 34) to the control and sensor means 53 to release ball 4 from the ball housing 77. In one example, ball number 4 may have a diameter of, for example, about 3.8 cm (1.5 inches). As depicted, ball 4 is sized such that it cannot pass the second perforation means 59. Thereafter, fluid is pumped through the inlet 35, down the down the ball-carrying segment 52 and into the lower segment 54 so as to increase the pressure with the lower segment 54 above the second perforation means 59. This causes the sleeve 51 within the second perforation means 59 to move downward. See the above discussion regarding FIGS. 14-19. At that point, the pressure within the lower segment 54 is increased to the firing pressure selected for the gun(s) 71 associated with the second perforation means 59. This creates openings 116 that extend through the production casing 22, the first cement plug 112, the intermediate casing 20 and exposes the C annulus and establishes fluid communication between the A and C annuli. At that point, a pressure test is conducted against the intermediate casing shoe to check for formation continuity and the potential for fluid leak-off. If the pressure test reveals the potential for fluid leak-off, then cement may be pumped into through the openings 116 and into the formation adjacent the openings 116, i.e., cement may be bull-headed into the formation at this location.

Figure 54:
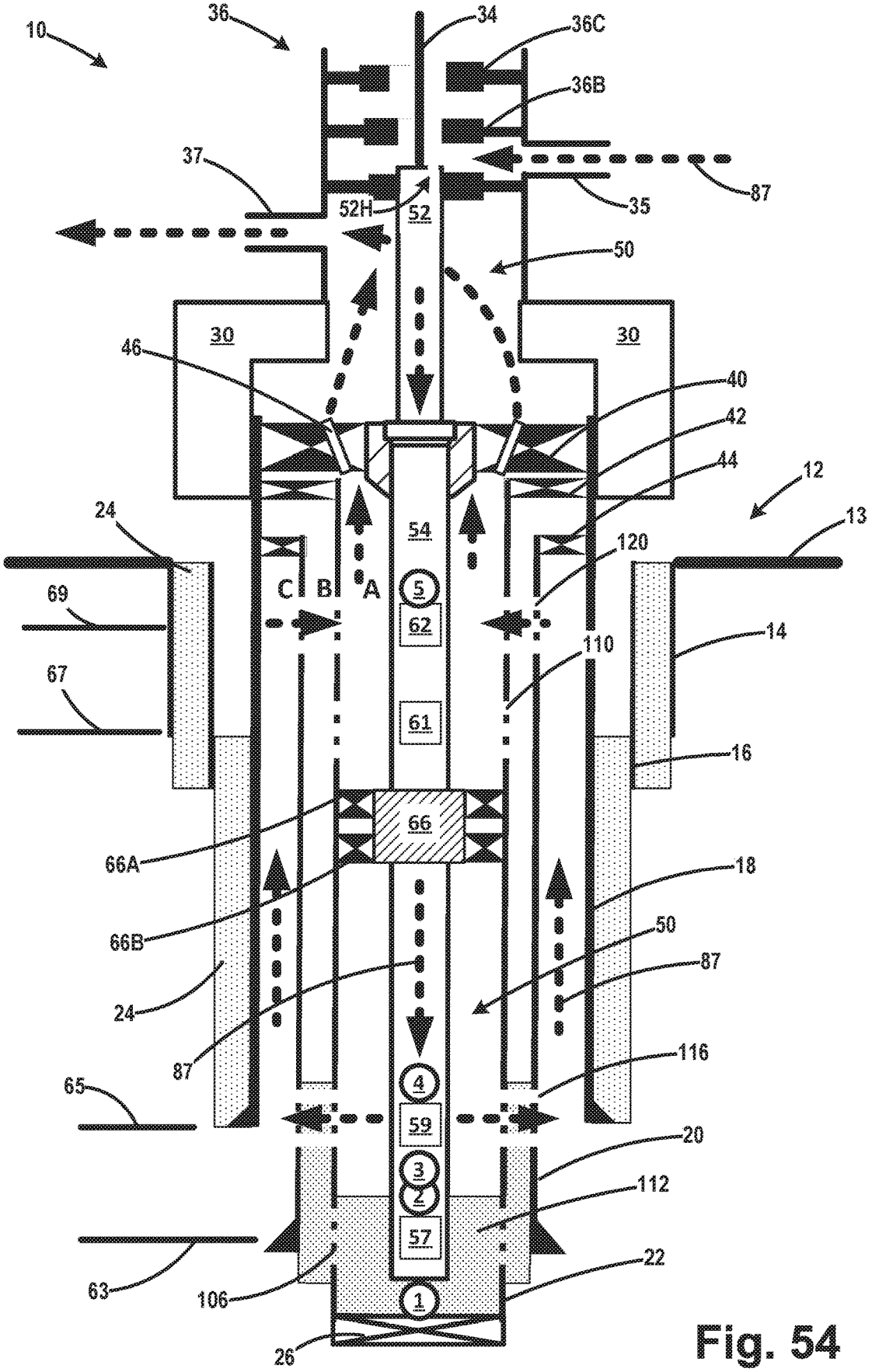

FIG. 54 depicts the system 10 after several steps were taken. First, a signal was sent (via the wireline 34) to the control and sensor means 53 to release ball 5 from the ball housing 77. In one example, ball number 5 may have a diameter of, for example, about 4.4 cm (1.75 inches). As depicted, ball 5 is sized such that it cannot pass the fourth perforation means 62. Thereafter, fluid is pumped through the inlet 35, down the down the ball-carrying segment 52 and into the lower segment 54 so as to increase the pressure with the lower segment 54. This causes the ball sleeve 84 to shift downward and exposes the upper ports 93 thereby permitting fluid pressure within the lower segment 54 above the ball 78 to be transmitted to the pressure switch 75 via the tubing and lower ports 95. See the above discussion regarding FIG. 20. At that point, the pressure within the lower segment 54 is increased to the firing pressure selected for the gun(s) 71 associated with the fourth perforation means 62. This creates openings 120 in the production casing 22 and the intermediate casing 20 and exposes the C annulus. This operation also creates a C annulus circulation path (as depicted by the dashed lines 87) that will allow fluid to be pumped through the inlet 35 in the well control package 14, into the ball-carrying segment 52, down the lower segment 54, through the openings 116, into the C annulus, up the C annulus, out of the openings 120 and into the A annulus, out of the fluid passages 46. i.e., the choke and kill lines, in the tool landing structure 40 and out of the outlet 37 of the well control package 14. Note that this circulation path extends from an opening (116) below the packer 66 to an opening (120) above the packer 66. Some fluid within the C annulus may also flow out the openings 110 and into the A annulus during this process. Also note that, in this illustrative example, the openings 116 were formed prior to the openings 120. However, if desired, the openings 120 could be formed prior to the formation of the openings 116.

Figure 55:
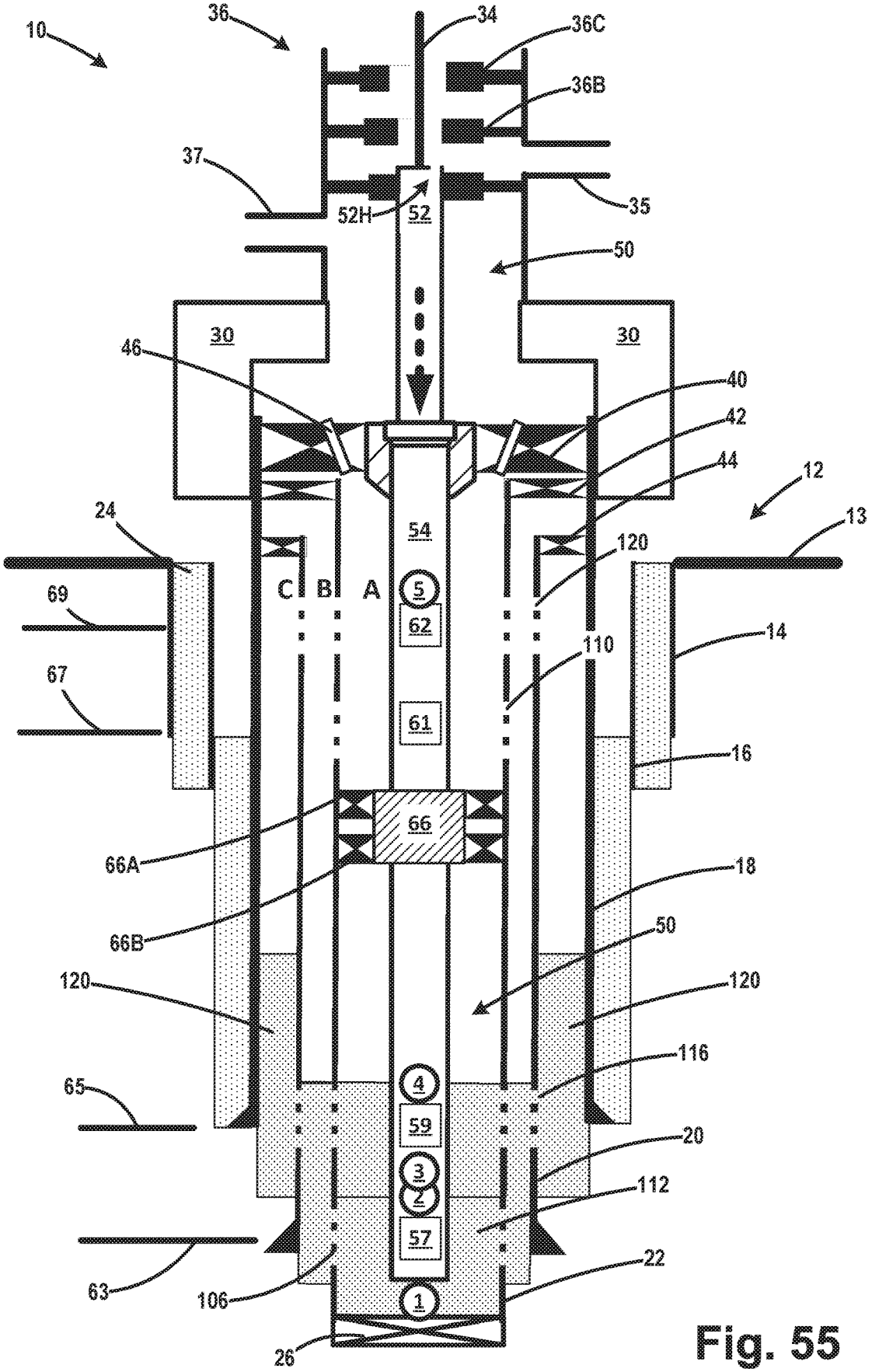

FIG. 55 depicts the system 10 after several steps were taken. After establishing the C annulus circulation path 87, a desired amount of plug material, e.g., cement or a resin material, was pumped into the well 12 until such time the plug material flowed out of the openings 116 and into the B and C annuli. The amount of the plug material circulated may vary depending upon the particular application and the desired size of the resulting plug. At that point pressure was applied to "squeeze" the plug material, and the plug material was allowed to set. These operations result in a balanced second plug 120 that seals off both the B and C annuli. Depending upon the particular application, e.g., wells having only A, B and C annuli, formation of the first plug 112 and the second plug 120 may be the only plugs that need to be formed to seal off the upper portion of the well 12. Note that portions of the second plug 120 are positioned above the portions of first plug 112 that is located within the A annulus.

As will be appreciated by those skilled in the art after a complete reading of the present applications, the novel systems and methods disclosed herein may all be used to form a third plug (not show) that would seal off the D annulus. For example, another set of perforation means (fifth and six perforation means (not shown))—i.e. a six-gun system, could be added to the lower segment 54. In such an embodiment, the fifth perforation means would be positioned above the second peroration means 59 and below the packer 66, while the sixth perforation means would be positioned between the fourth perforation means 62 and the cutting means 55. Following the procedures described above, the fifth perforation means would be fired to create openings the extend through the production casing 22, the second plug 120, the intermediate casing 20 and the surface casing 18 so as to thereby expose the D annulus. Thereafter, the sixth perforation means would be fired so as to create another set of openings in the production casing 22, the intermediate casing 20 and the surface casing 18. These two spaced-apart sets of openings create a flow path that would allow cement to be pumped into the D annulus with the result being the formation of a third plug (not shown) that spans the D, C, B and A annuli.

Figure 56:
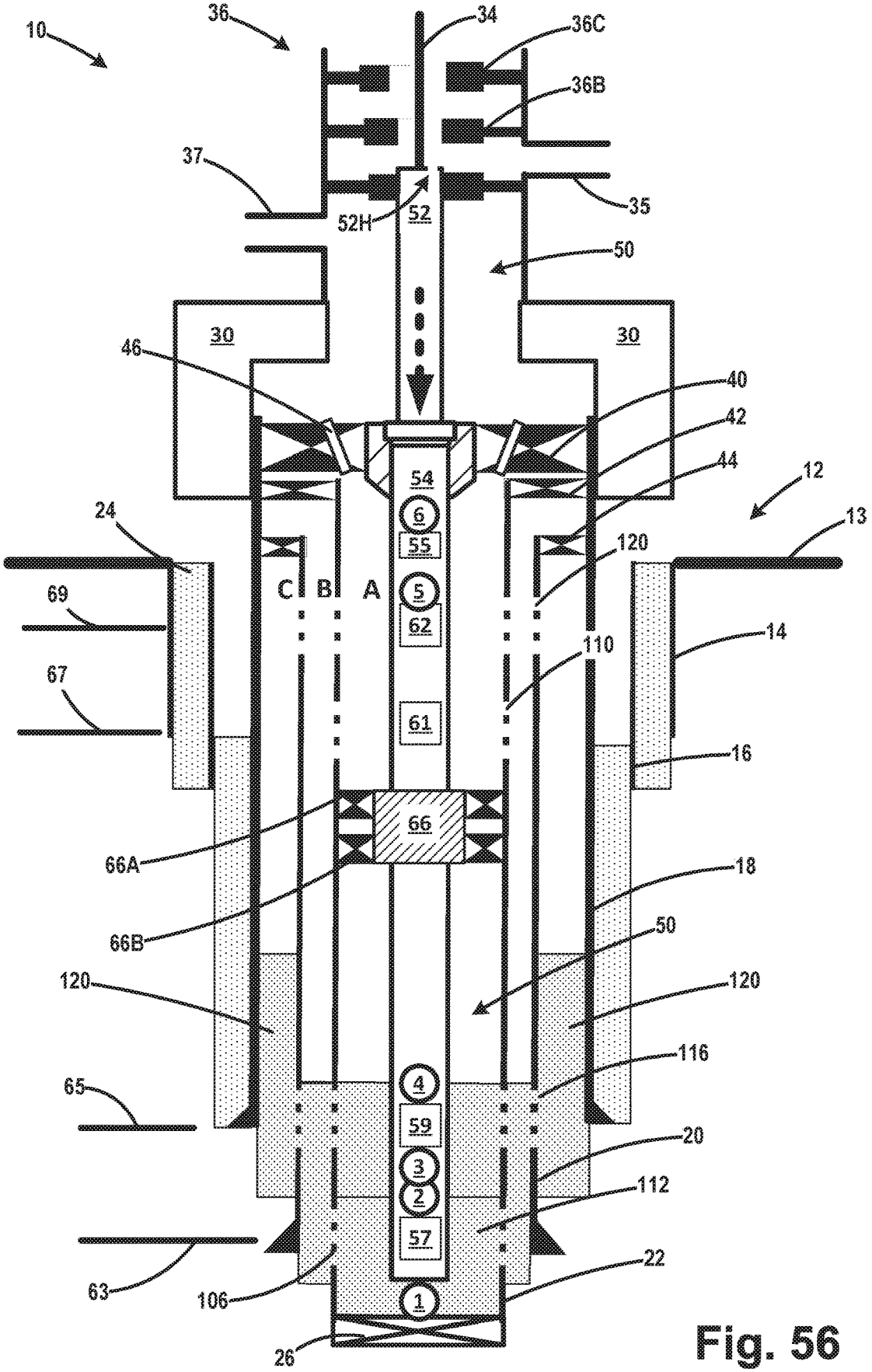

FIG. 56 depicts the system 10 after several steps were taken. First, a signal was sent (via the wireline 34) to the control and sensor means 53 to release ball 6 from the ball housing 77. In one example, ball number 6 may have a diameter of, for example, about 5.08 cm (2.0 inches). As depicted, ball 6 is sized such that it cannot pass the cutting means 55, e.g., a chemical spray cutter. Thereafter, fluid is pumped through the inlet 35, down the down the ball-carrying segment 52 and into the lower segment 54 so as to increase the pressure with the lower segment 54 to actuate cutting means 55 so as to cut the lower segment 54 of the tool 50 above the fourth perforation mean 62 as simplistically depicted by the cut line 55A shown in FIG. 57.

Figure 58:
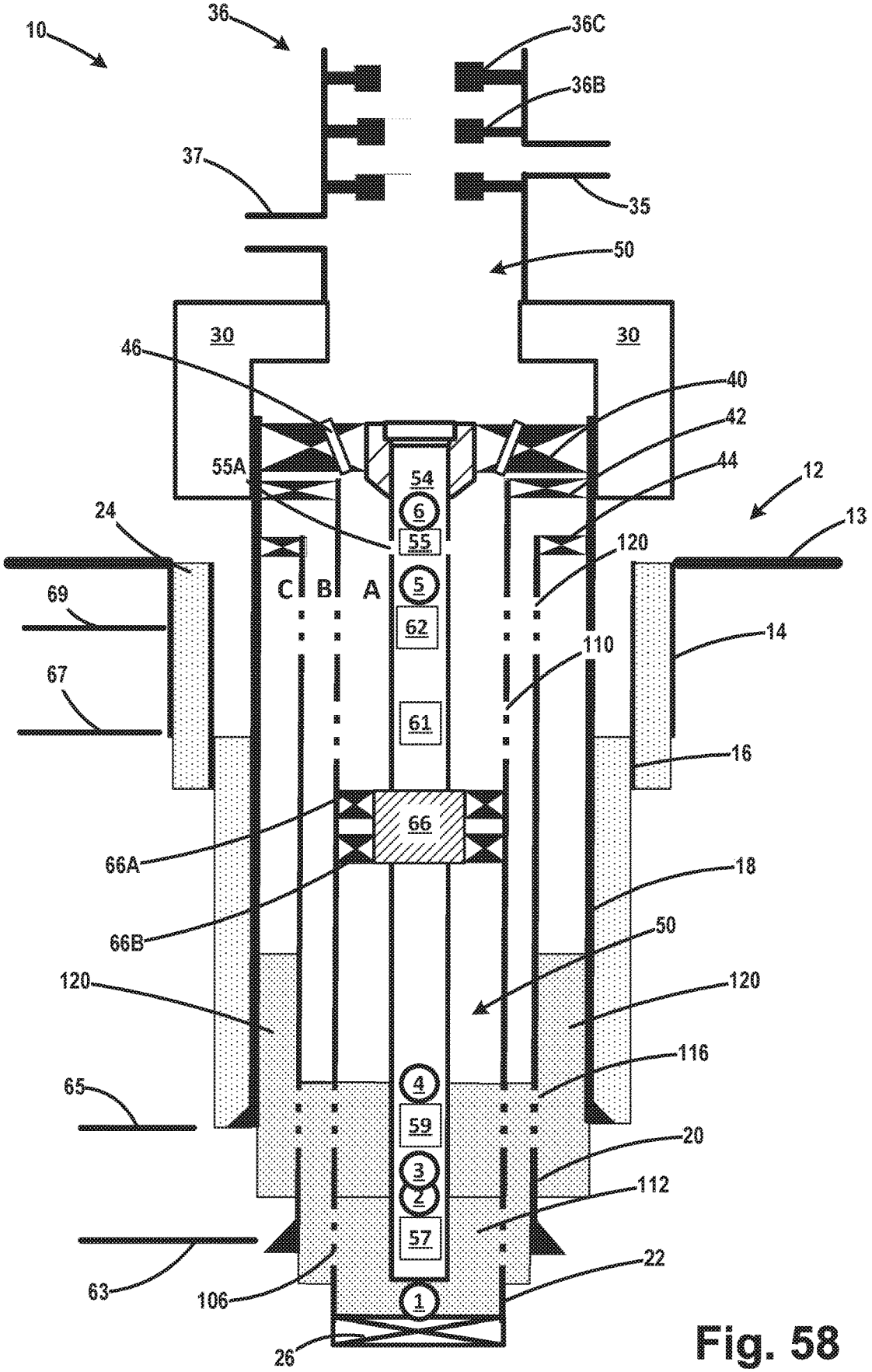

FIG. 58 depicts the system 10 after the ram(s) were retracted and after the ball-carrying segment 52 of the tool 50 was retrieved to the surface using the wireline 34.

Figure 59:
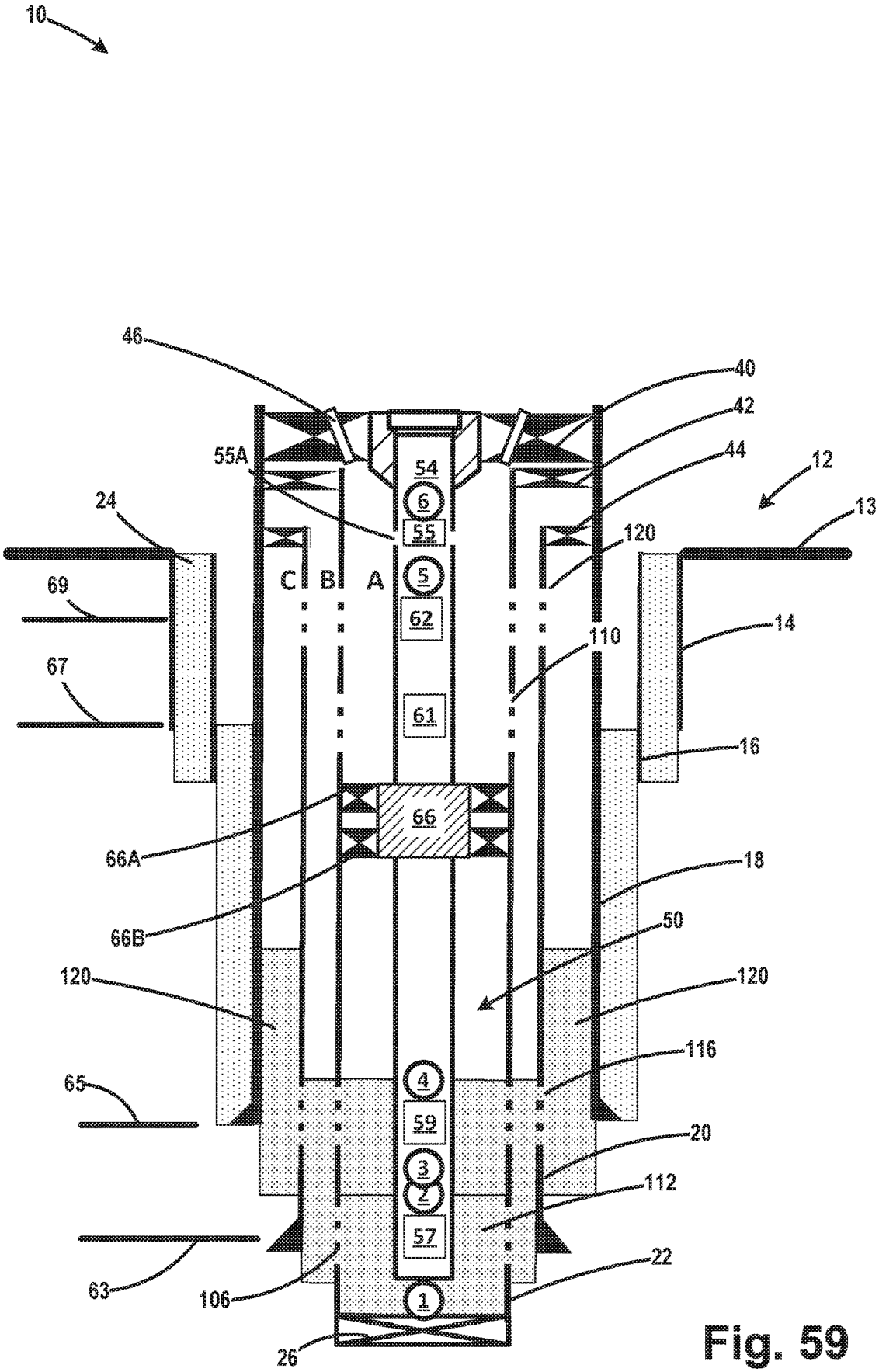

FIG. 59 depicts the system 10 after the well control package 14 was decoupled from the well and retrieved to the surface.

Figure 60:
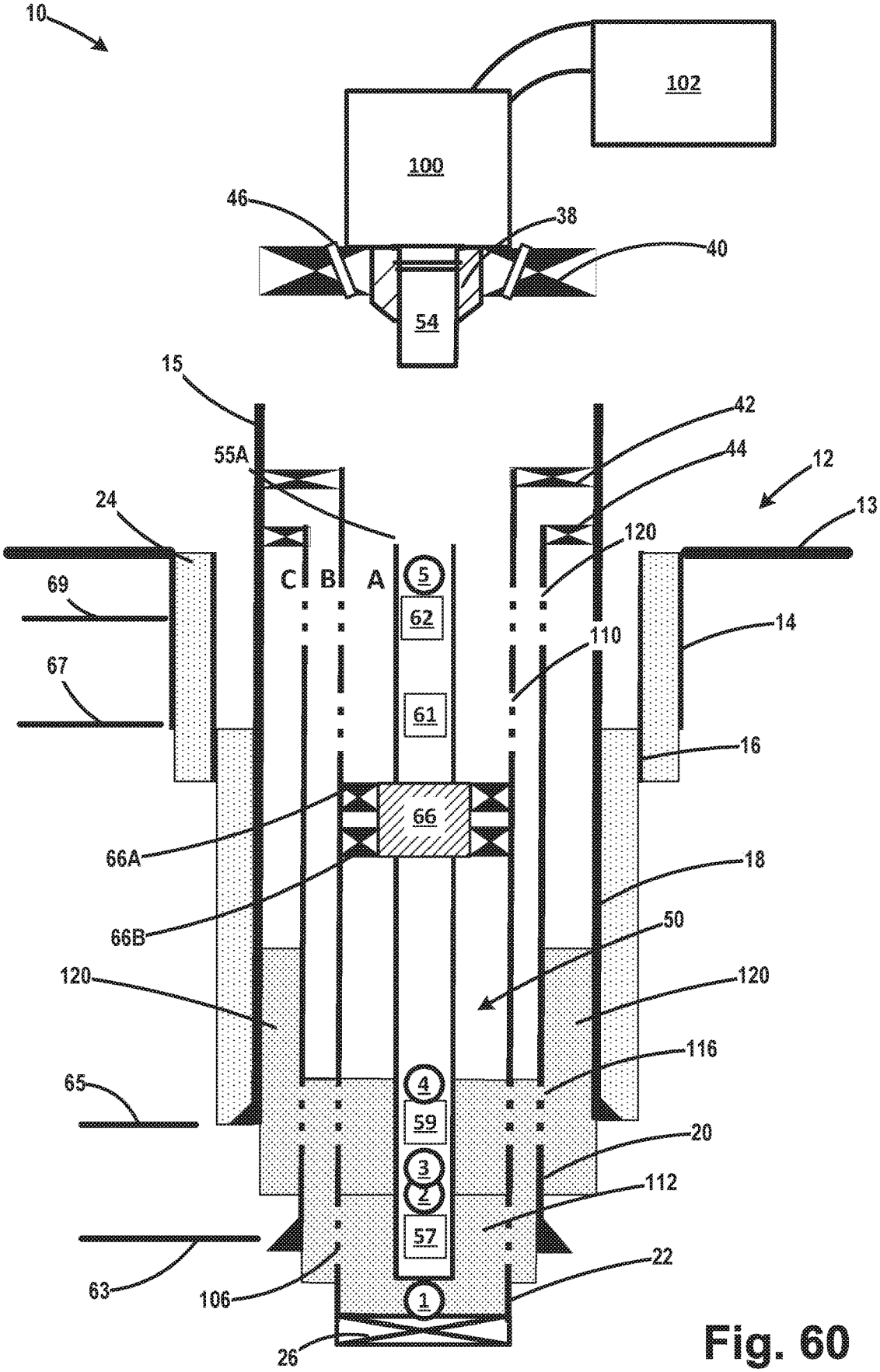

FIG. 60 depicts the system 10 after the above-described landing head 100 was lowered to the well 12 using the ROV and attached to the tool landing structure 40. At that point, the tool landing structure 40 along with the portions of the lower segment 54 above the cut 55A made by the cutting means 55 was lifted out of the well and retrieved to the surface using the ROV and/or other lift lines (not shown). As will be appreciated by those skilled in the art after a complete reading of the present application, the length of the lower segment 54 that is removed provides enough clearance in the well to repeat the process described above with a axially shorter assembly in the event that the main lower system 54 failed in some way to provide the necessary barriers, or at a point in time in the future if the previously abandoned well shows signs of starting to leak again.

Figure 57:
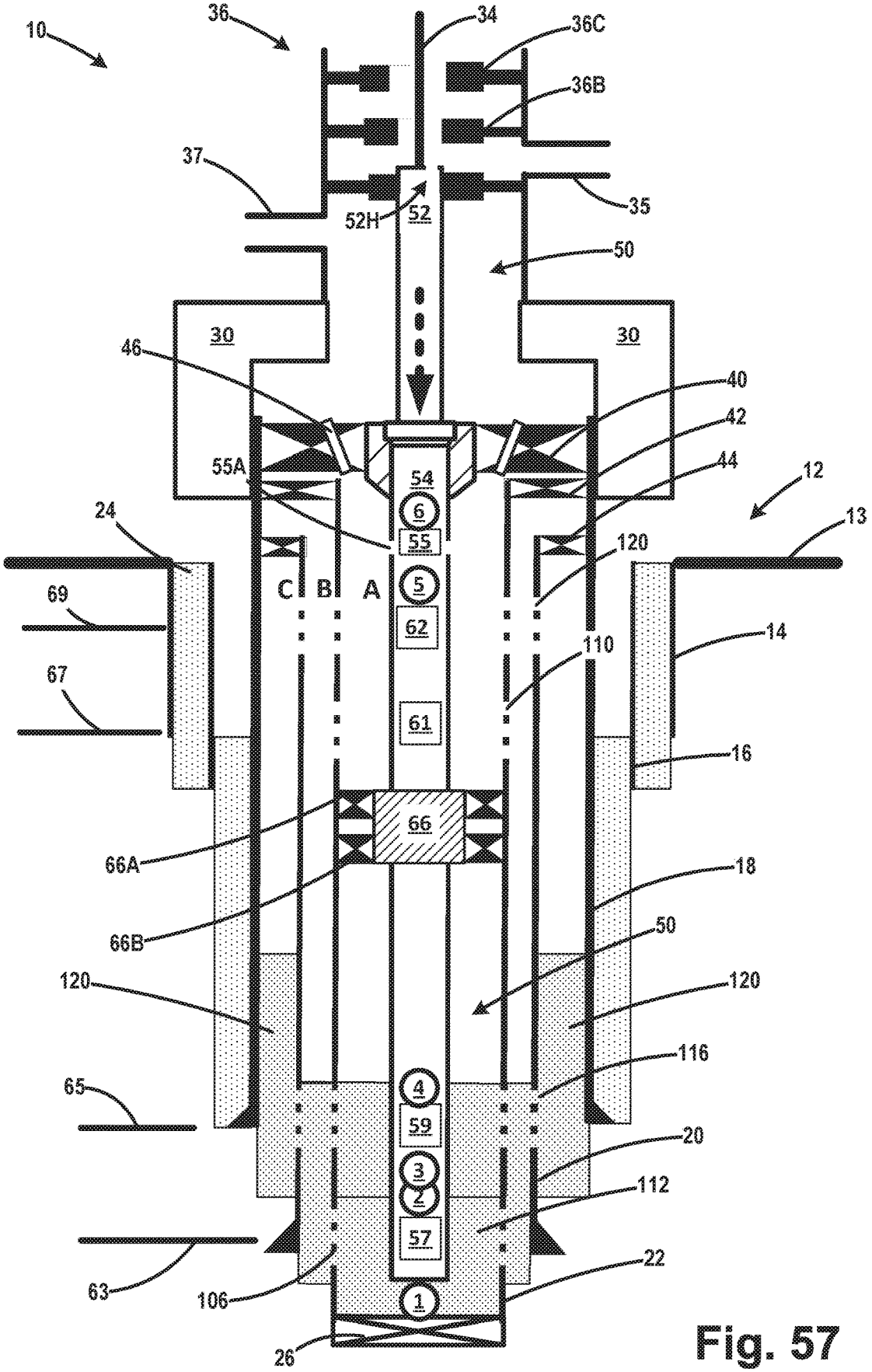

FIGS. 57, 58 and 60 also depict a feature where the known position of the tubing cut allows for a contingency upper well abandonment. Should the initial P&A of the B and C annuli fail to demonstrate a satisfactory pressure integrity barrier, a second, shorter lower segment 54 with new perforating guns may be assembled to the landing structure 40 and re-landed in the wellhead 15. Then the P&A process described above may be repeated through new penetrations in the casing hanger strings, higher in the well.

Figure 61:
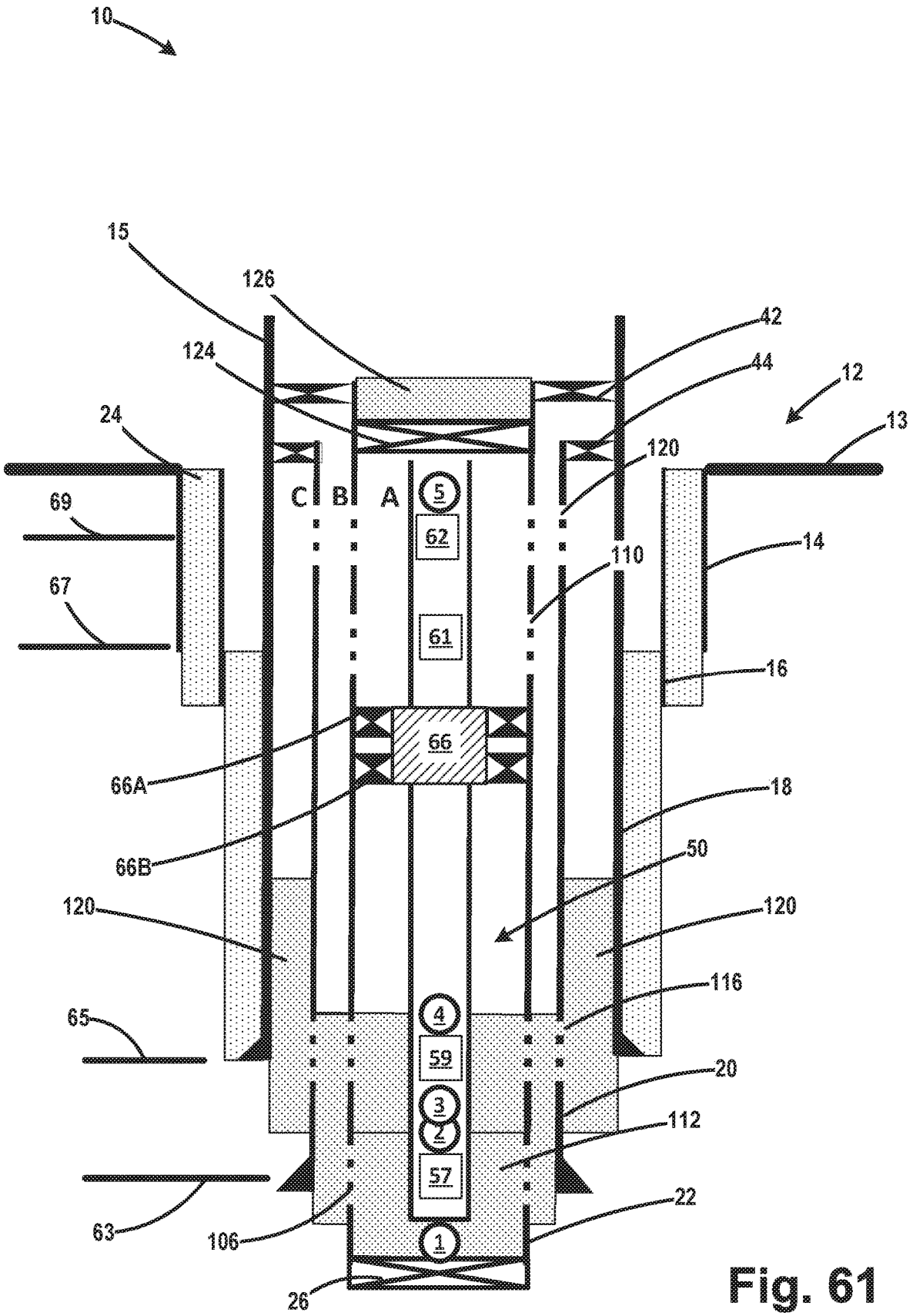
Figure 62:
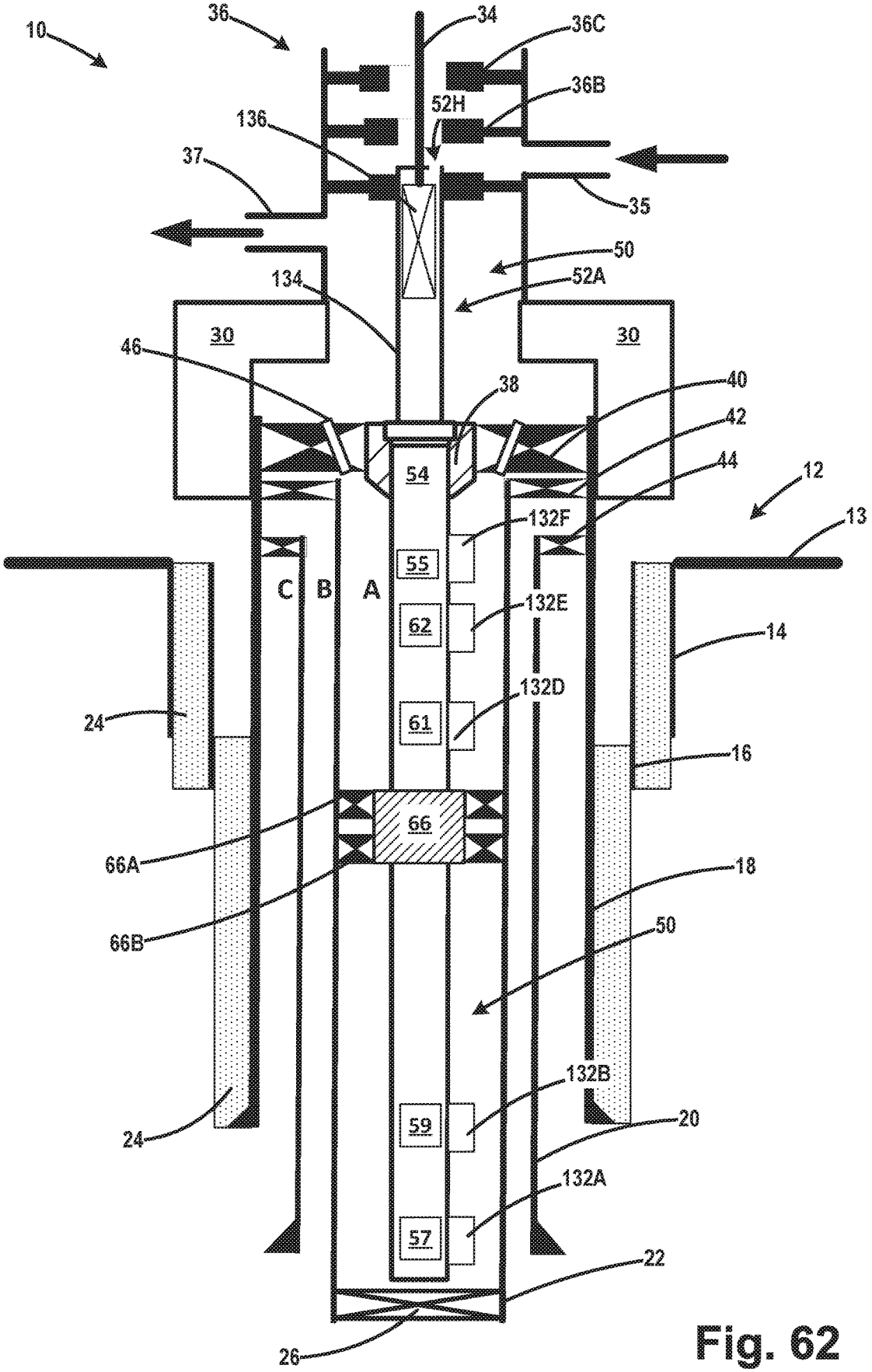

FIG. 61 depicts the system 10 after several steps were taken. First, a bridge plug 124 was installed inside the production casing 20 at a location above the fourth perforation means 62. Thereafter, using the ROV 102 and flexible downlines (not shown) another plug 126 was formed in the production casing 20 above the bridge plug 124. With reference to FIG. 61 the bridge plug 124 and the plug 126 are depicted as being positioned above the sea floor 13. In practice, the bridge plug 124 and the plug 126 will be positioned in the production casing 20 at a location well below the sea floor 13, e.g., 10-20 meters below the sea floor 13. After the plug 126 is formed, the wellhead housing 15 may be cut and removed along with about 3-5 meters of all of the casings within the well if appropriate for the particular application.

FIGS. 62-71 depict another illustrative embodiment of a P&A system 10 disclosed herein. In this embodiment, the perforating gun(s) 71 for each of the perforation means 57, 59, 61 and 62 may be actuated by means of an actuation tool 136 that may communicate wirelessly with each of the perforation means 57, 59, 61 and 62. The actuation tool 136 may be lowered into the lower segment 54 of the tool 50 such that it is positioned adjacent one of the perforation means 57, 59, 61 or 62. At that point, the actuation tool 136 sends a signal the gun(s) 71 associated with that particular perforation means so as to create the desired openings in the various sections of casing, as described more fully below. The communication between the actuation tool 136 and the gun(s) 71 may be accomplished using any desired wireless communication technology, e.g., RFID-based technology. In this embodiment, the perforation means 57, 59, 61 and 62 may be fired in the same order as they were in the previous embodiment, i.e., first perforation means 57 is fired first, the third perforation means 61 is fired second, the second perforation means 59 is fired third, and finally the fourth perforation means 62 is fired. In this embodiment, the tool 50 does not include the ball-carrying housing 77 described above.

With reference to FIGS. 62-65, in this embodiment, the upper segment 52A of the tool 50 comprises a polished bore receptacle housing 134. The lower end of the polished bore receptacle housing 134 is adapted to be positioned in the polished bore recess 38A in the adapter 38. The seal ram(s) are adapted to sealingly engage the outer surface of the polished bore receptacle housing 134. The actuation tool 136 is sized such that it may be positioned within the polished bore receptacle housing 134. The actuation tool 136 is operatively coupled to the wireline 34. The gun(s) 71 at each of the perforation means 57, 59, 61 and 62 have receivers 132A, 132B, 1320 and 132D, respectively. The cutting means 55 also has a receiver 132F. In one illustrative example, the actuation tool 136 and the various receivers described above may be RFID-based devices. Of course, other technologies that allow for wireless communication between two components may also be employed.

Figure 63:
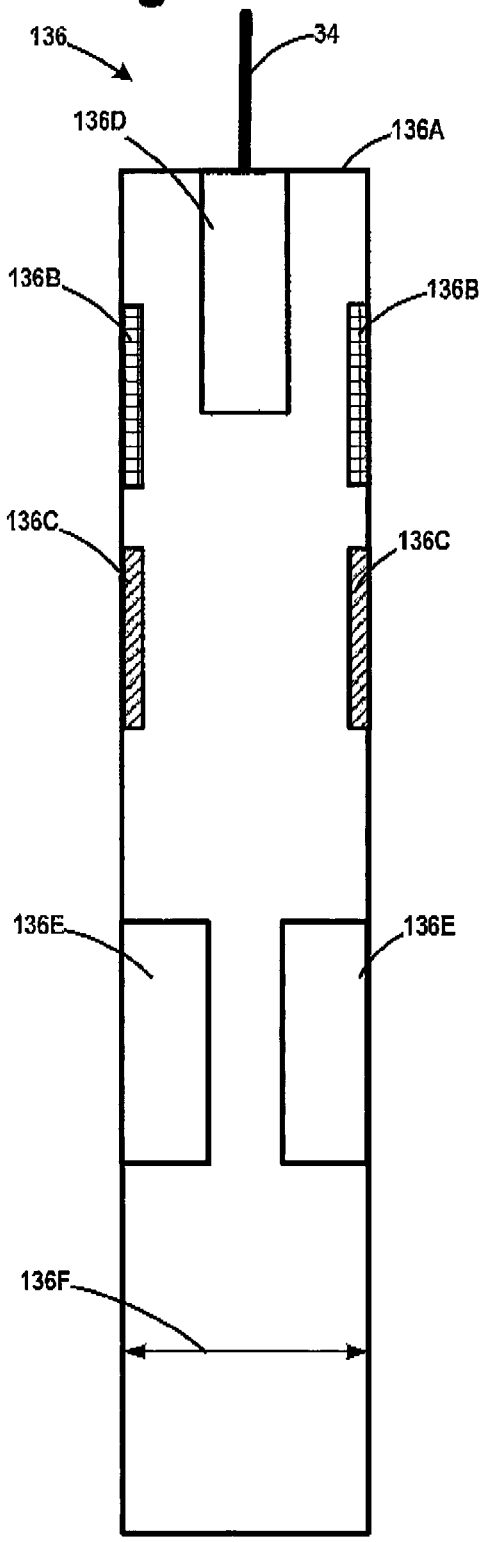
Figure 64:
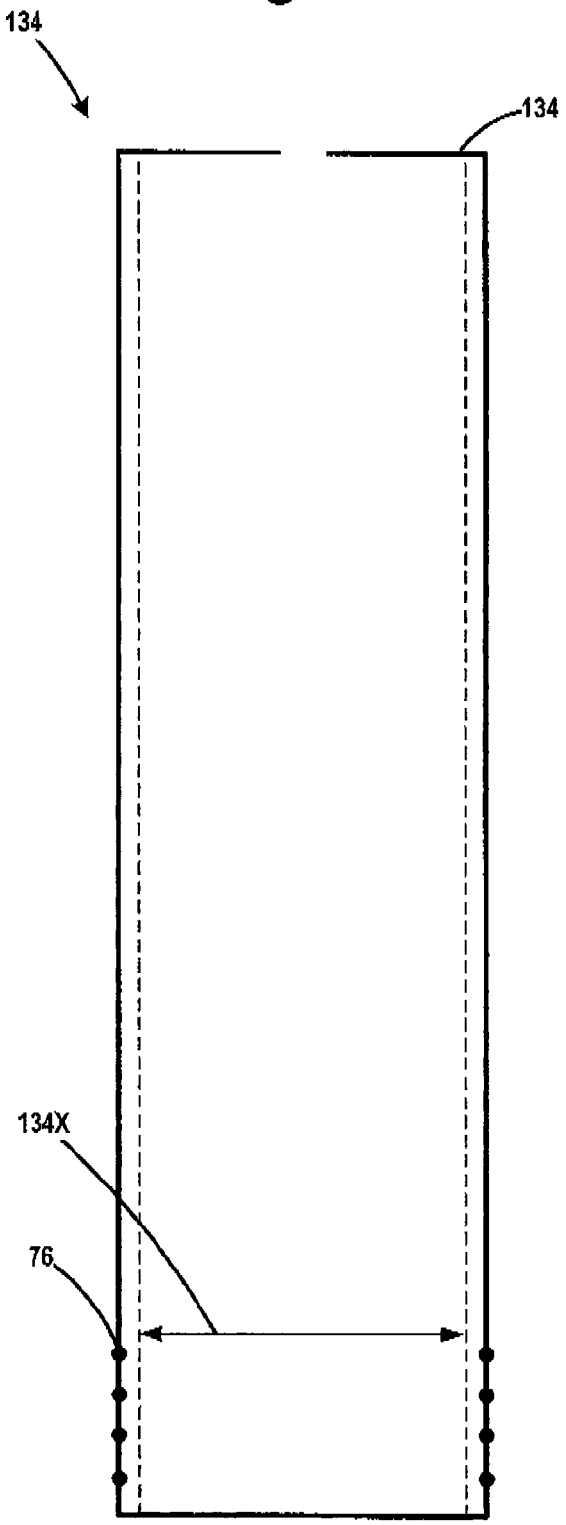
Figure 65:
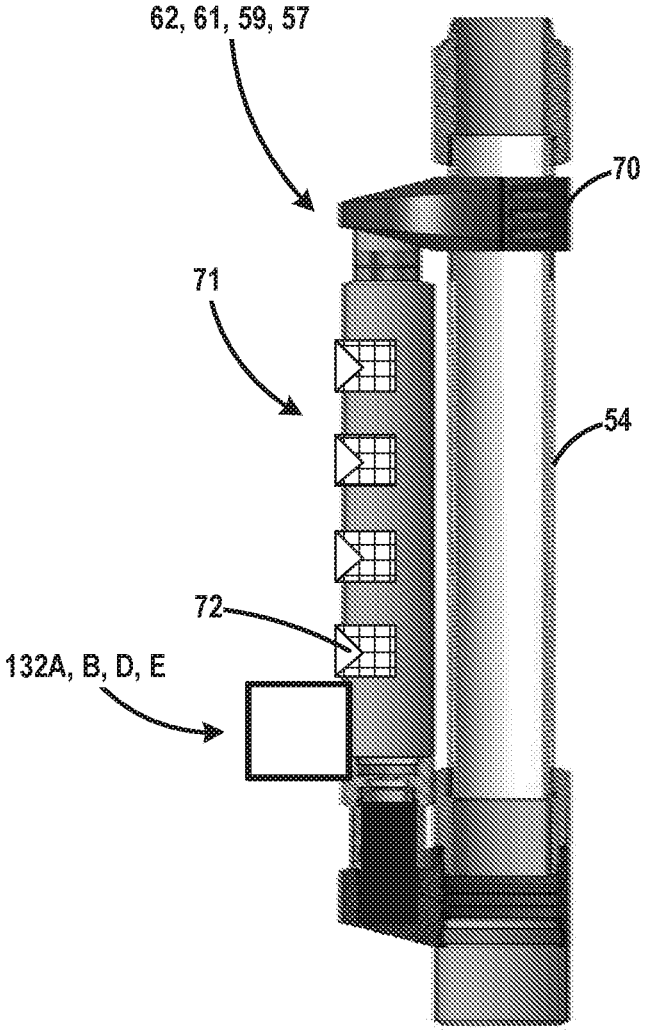
FIGS. 65-71 depict another illustrative embodiment of a P&A system disclosed herein that may be employed to form an upper plug when abandoning an oil and gas well.

With reference to FIG. 63, the actuation tool 136 comprises a body 138A, an inflatable packer seal 136B, a plurality of retractable anchor slips 1360, various REM sensors and controls 136E, and an overall controller 136D that is operatively coupled to the wireline 34. As shown in FIG. 64, the polished bore receptacle housing 134 has an inside diameter 134X is large enough to permit the actuation tool 136 to pass through the polished bore receptacle housing. 134. As indicated above, the actuation tool 136 is sized such that it may be inserted into and withdrawn from the lower segment 54 of the tool 50. As indicated in FIG. 65, each of the guns 71 comprise a simplistically depicted RFID receiver (132A, 132B, 132D or 132E) that is adapted to receive a wireless "fire" signal from the actuation tool 136 that will cause the gun(s) 71 to discharge. A similar type of receiver is provided on the cutting means 55 so as to permit actuation of the cutting device using the actuation tool 136.

Figure 66:
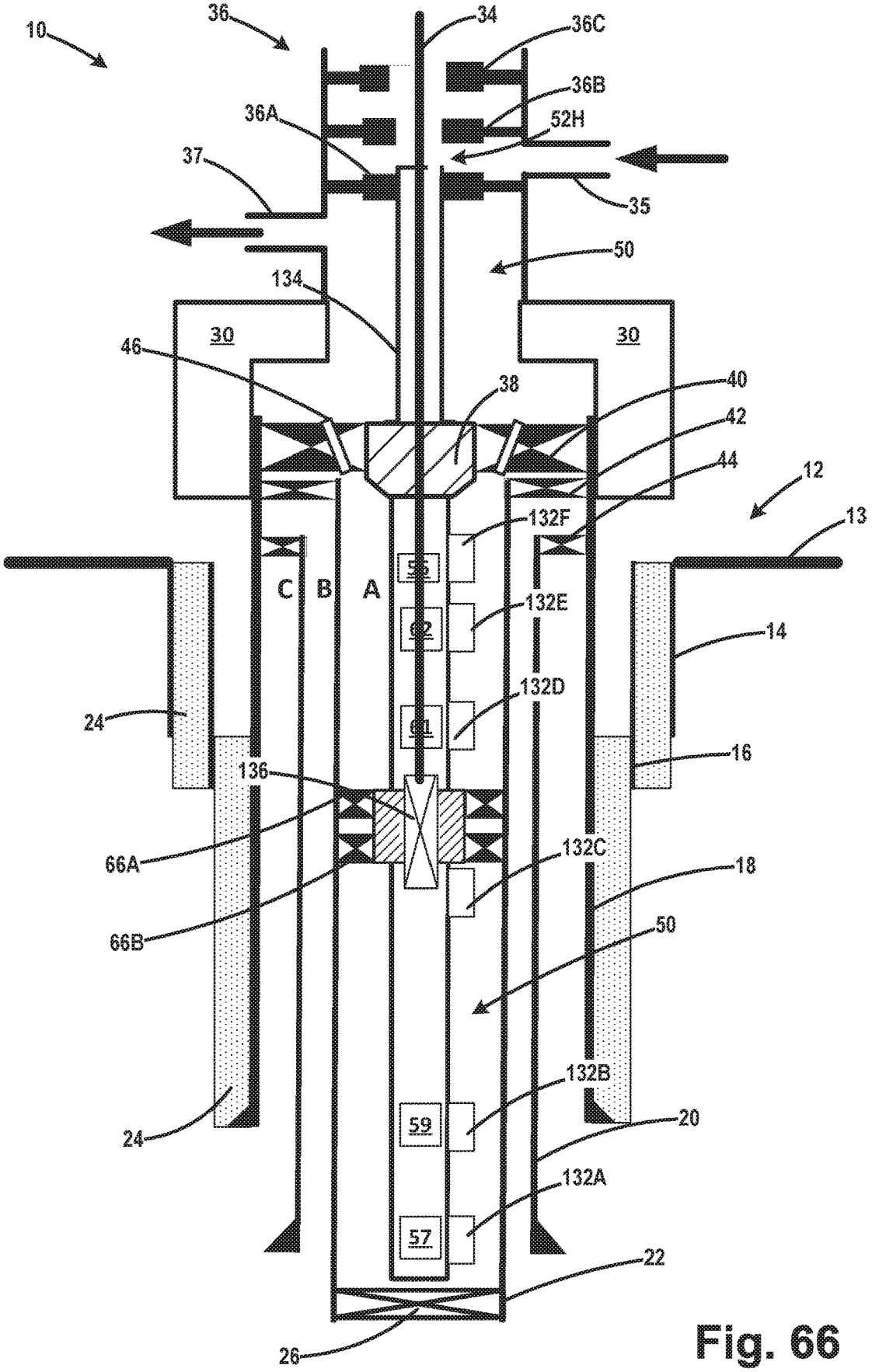

FIG. 66 depicts the system 10 after several operations were performed. First, the tool landing structure 40 was positioned in the well using the above-described landing head 100 and ROV wherein the tool landing structure 40 simply rests on the casing hanger 42 below. Thereafter, the landing head 100 was removed using the ROV 102. Next, the well control package 14 was lowered and locked to the wellhead housing 15 by actuating the connector 30. At this point, the various ram(s) remain completely open. Next, the polished bore receptacle housing 134 (with the actuation tool 136 positioned therein) was lowered via wireline 34 and into engagement with the polished bore recess 38A in the adapter 38. At that point, the seal ram(s) were energized so as to seal around the polished bore receptacle housing 134. After this point, the sleeve 52F was actuated so as to open the opening 52H. At that point, pressure is applied to the well 12 via the inlet/outlet 35, 37 to pressure test all of the equipment and connections. After the pressure integrity of the system 10 is confirmed, pressure within the well was increased to set the expandable seal 66A and the anchor slips 66B of the packer 66.

Figure 67:
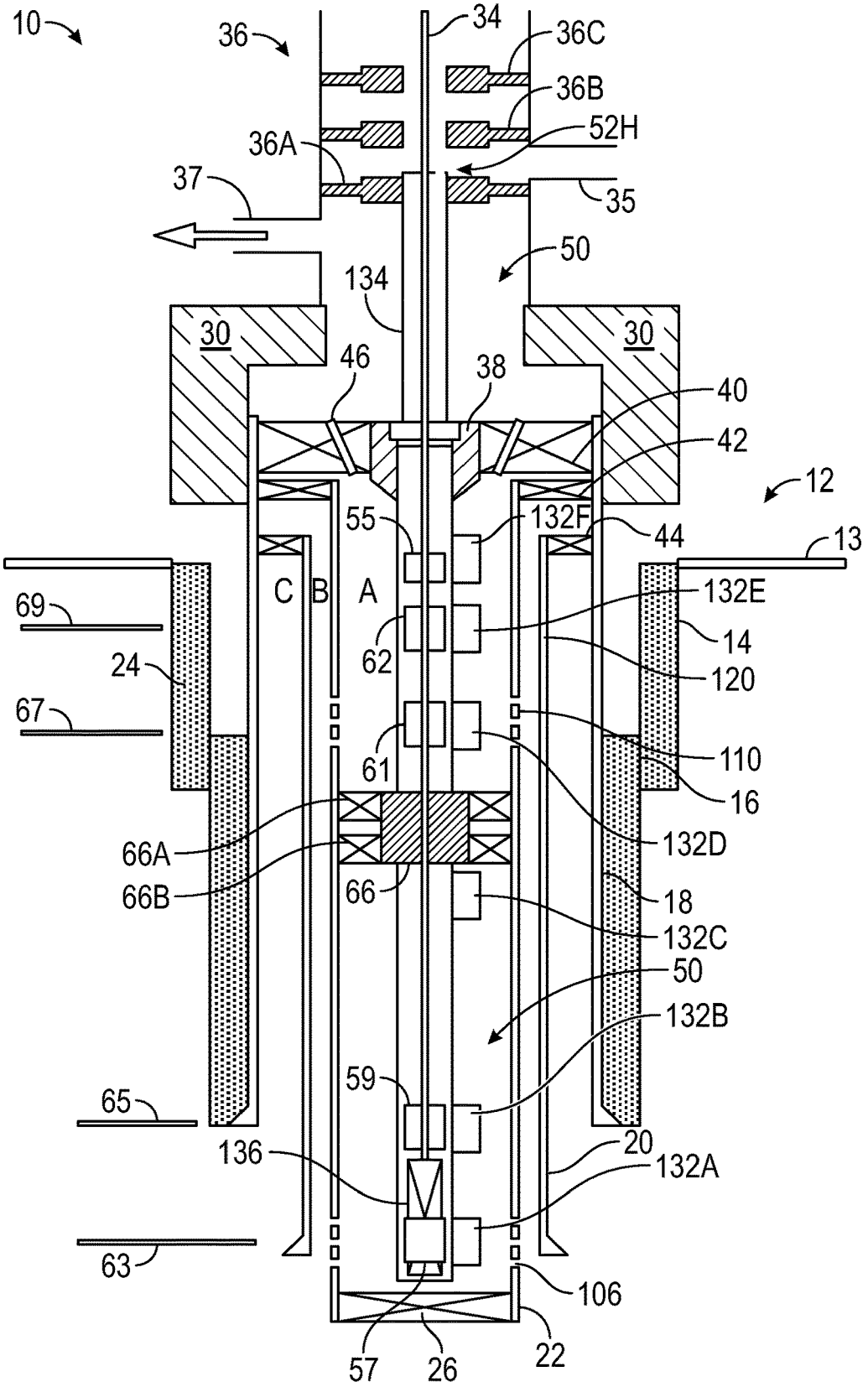

FIG. 67 depicts the system 10 after several operations were performed. First, the actuation tool 136 was lowered from the polished bore receptacle housing 134 into lower segment 54 to a location proximate the first perforation means 57. At that point, a signal from the wireline causes the actuation tool 136 to send a wireless "fire" signal to the receiver 132A so as to fire the gun(s) 71 associated with the first perforation means 57. This creates the above-described openings 106 in the production casing 22 and exposes the B annulus. At that point, a pressure test is conducted against the production casing shoe to check for formation continuity and the potential for fluid leak-off. If the pressure test reveals the potential for fluid leak-off, then cement may be pumped into through the openings 106 and into the formation adjacent the openings 106, i.e., cement may be bull-headed into the formation at this location.

Figure 68:
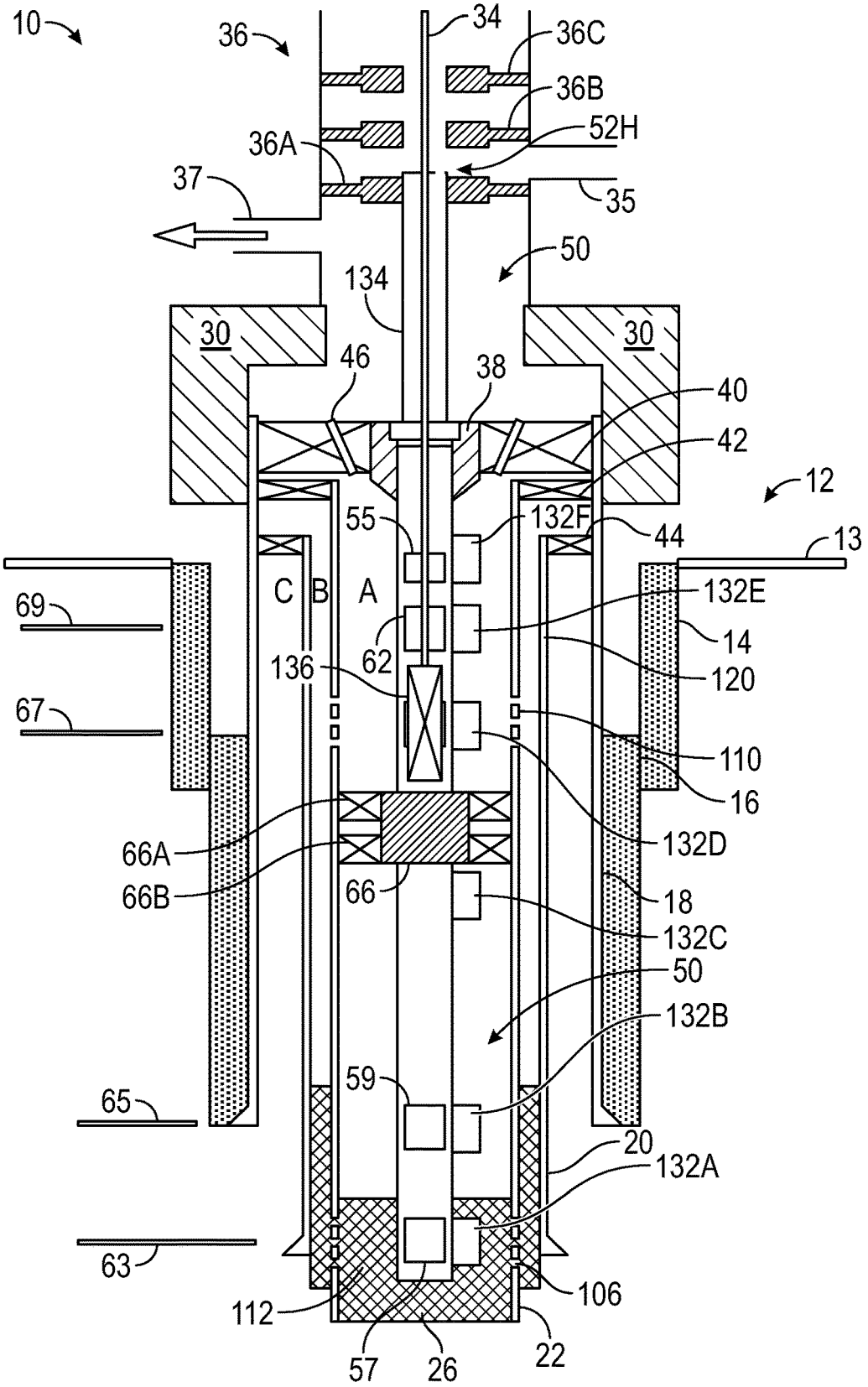

FIG. 68 depicts the system 10 after several operations were performed. First, the actuation tool 136 was raised up within the lower segment 54 to a location proximate the third perforation means 61. At that point, another signal was sent via the wireline 34 to cause the actuation tool 136 to send a wireless "fire" signal to the receiver 132D so as to fire the gun(s) 71 associated with the third perforation means 61. This creates the above-described openings 110 in the production casing 22 and exposes the B annulus. This operation also creates the above-described B annulus circulation path 85 (see FIG. 51). Next, the actuation tool 136 was retrieved into the polished bore receptacle housing 134. At that point, a desired amount of plug material, e.g., cement or a resin material, was pumped into the well 12 until such time the plug material flowed out of the lower openings 106 and into the B annulus. At that point, pressure was applied to "squeeze" the plug material, and the plug material was allowed to set. These operations result in above-described balanced first plug 112 that seals off both the A and B annuli.

Figure 69:
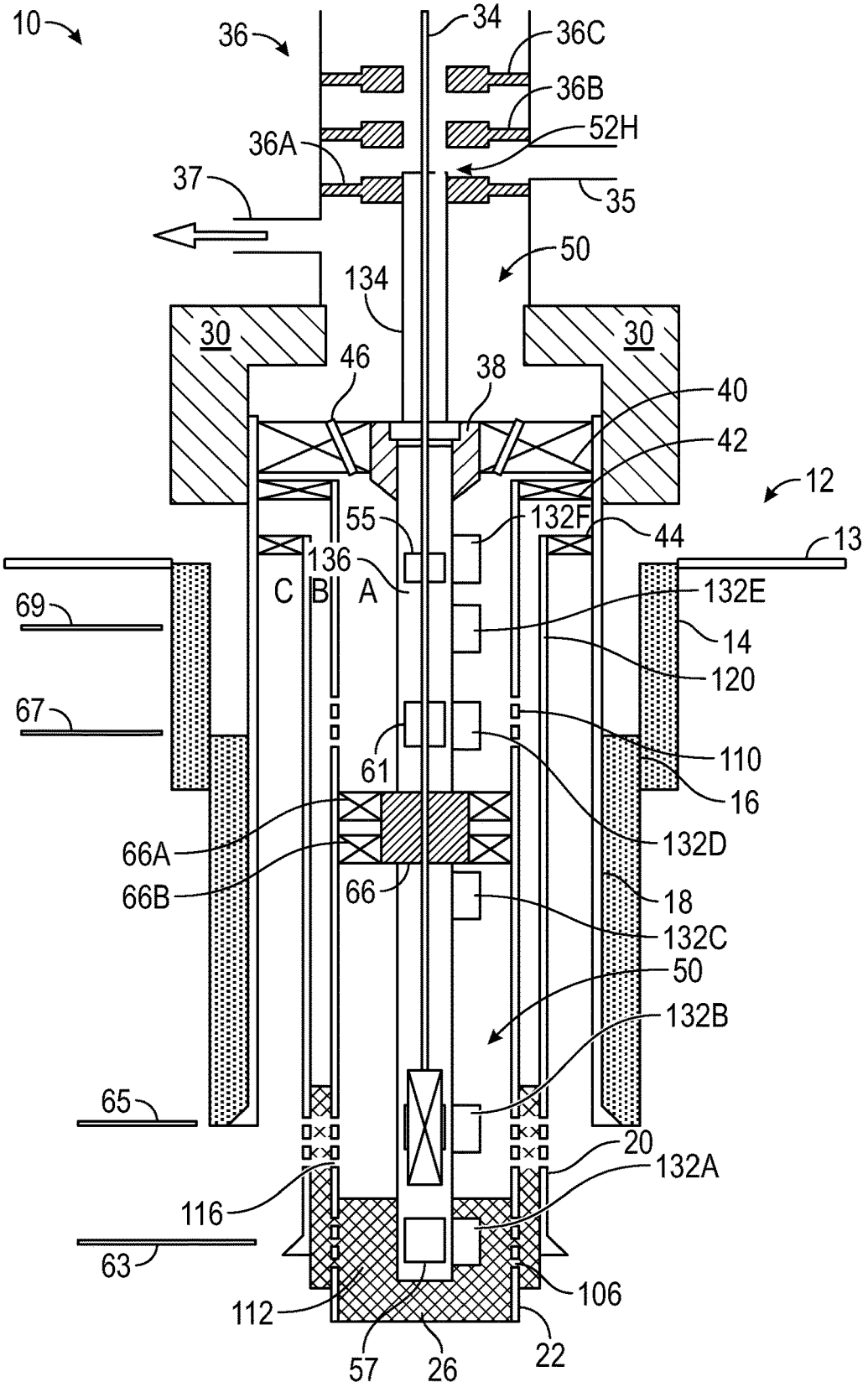

FIG. 69 depicts the system 10 after several operations were performed. First, the actuation tool 136 was lowered from the polished bore receptacle housing 134 into the lower segment 54 to a location proximate the second perforation means 59. At that point, another signal was sent via the wireline 34 to cause the actuation tool 136 to send a wireless "fire" signal to the receiver 132B so as to fire the gun(s) 71 associated with the second perforation means 59. This creates the above-described openings 116 in the production casing 22, the first plug 112 and the intermediate casing 20 and exposes the C annulus. At that point, a pressure test is conducted against the production casing shoe to check for formation continuity and the potential for fluid leak-off. If the pressure test reveals the potential for fluid leak-off, then cement may be pumped into through the openings 116 and into the formation adjacent the openings 116, i.e., cement may be bull-headed into the formation at this location.

Figure 70:
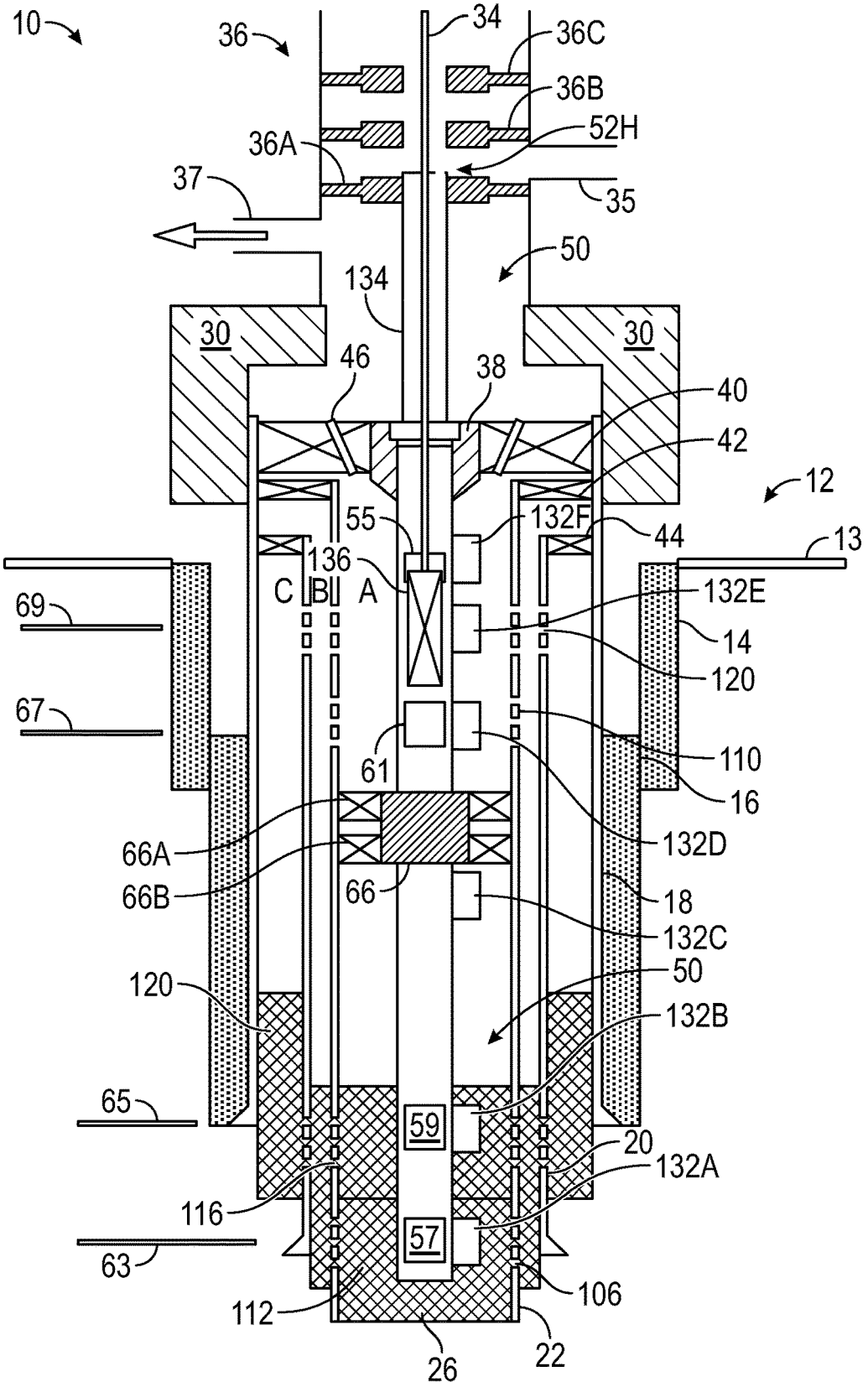

FIG. 70 depicts the system 10 after several operations were performed. First, the actuation tool 136 was raised up within the lower segment 54 to a location proximate the fourth perforation means 62. At that point, another signal was sent to cause the actuation tool 136 to send a wireless "fire" signal to the receiver 132E so as to fire the gun(s) 71 associated with the fourth perforation means 62. This creates the above-described openings 120 in the production casing 22 and the intermediate casing 20 and exposes the C annulus. This operation also creates the above-described C annulus circulation path 87 (see FIG. 44). Next, the actuation tool 136 was retrieved into the polished bore receptacle housing 134. At that point, a desired amount of plug material, e.g., cement or a resin material, was pumped into the well 12 until such time the plug material flowed out of the lower openings 116 and into the B and C annuli. At that point, pressure was applied to "squeeze" the plug material, and the plug material was allowed to set. These operations result in above-described balanced second plug 120 that seals off the A, B and C annuli.

Figure 71:
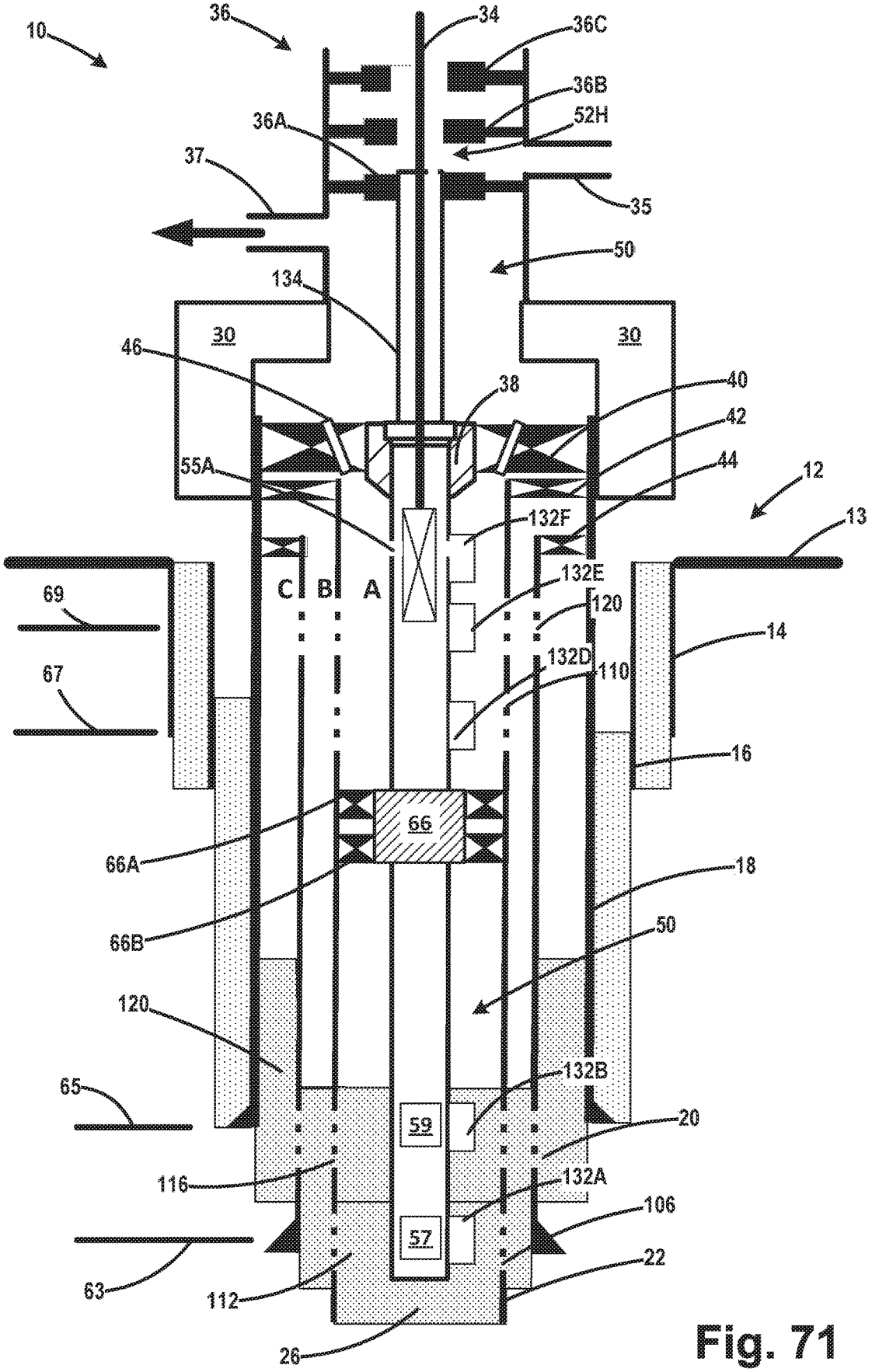

FIG. 71 depicts the system 10 after several operations were performed. First, the actuation tool 136 was lowered from within the polished bore receptacle housing 134 into the lower segment 54 to a location proximate the cutting means 55. At that point, another signal was sent via the wireline 34 to cause the actuation tool 136 to send a wireless signal to the receiver 132E so as to actuate the cutting means 55 as and cut the lower segment 54, as indicated by the cut line 55A. The actuation tool 136 may then be retrieved into the polished bore receptacle housing 134, the seal ram(s) may be de-energized and the polished bore receptacle housing 134 and actuation tool 136 may be retrieved to the surface using the wireline 34. Thereafter, the various activities described above in connection with FIGS. 58-61 may be performed.

Figure 72:
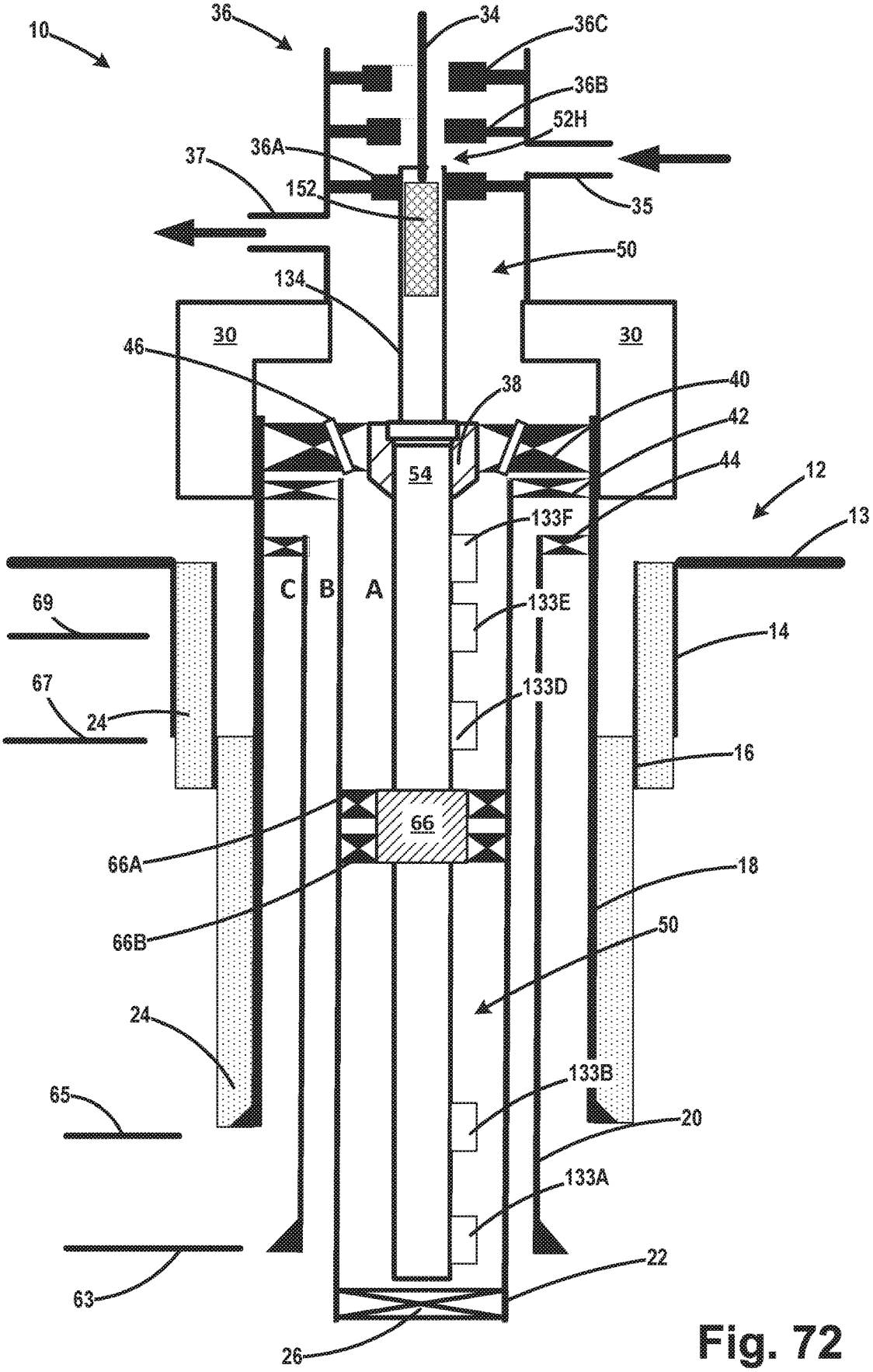
FIGS. 72-74 depict yet another illustrative embodiment of a P&A system disclosed herein describes how it may be employed to form an upper plug during the process of abandoning an oil and gas well.
Figure 73:
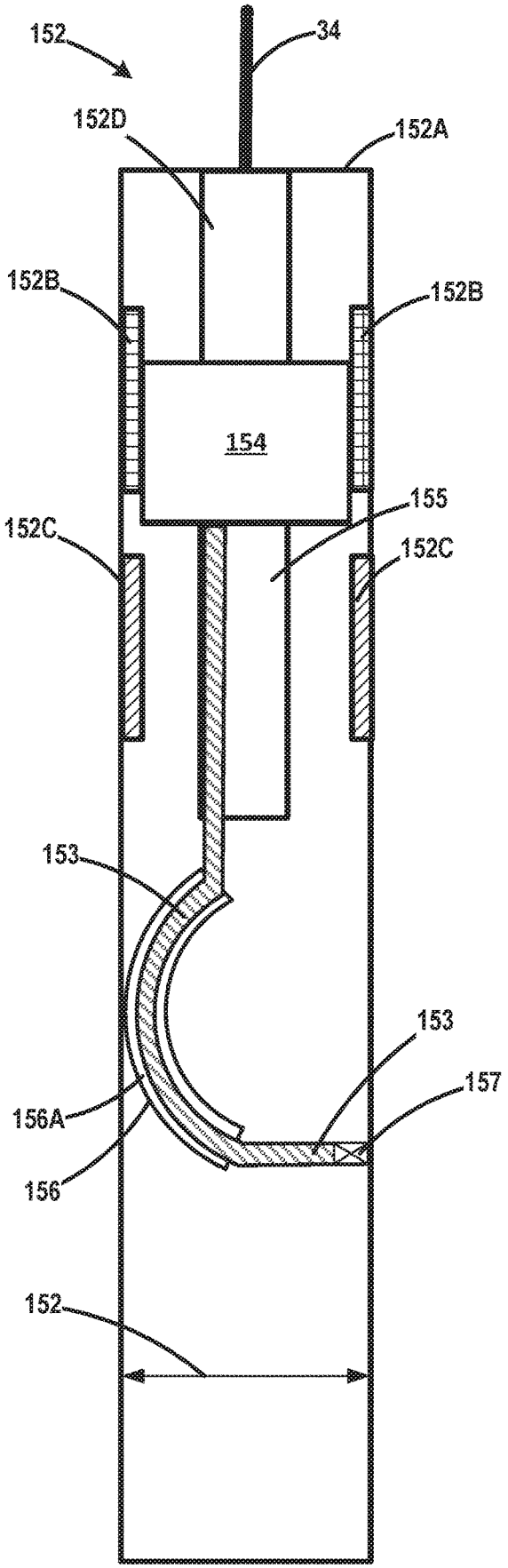
Figure 74:
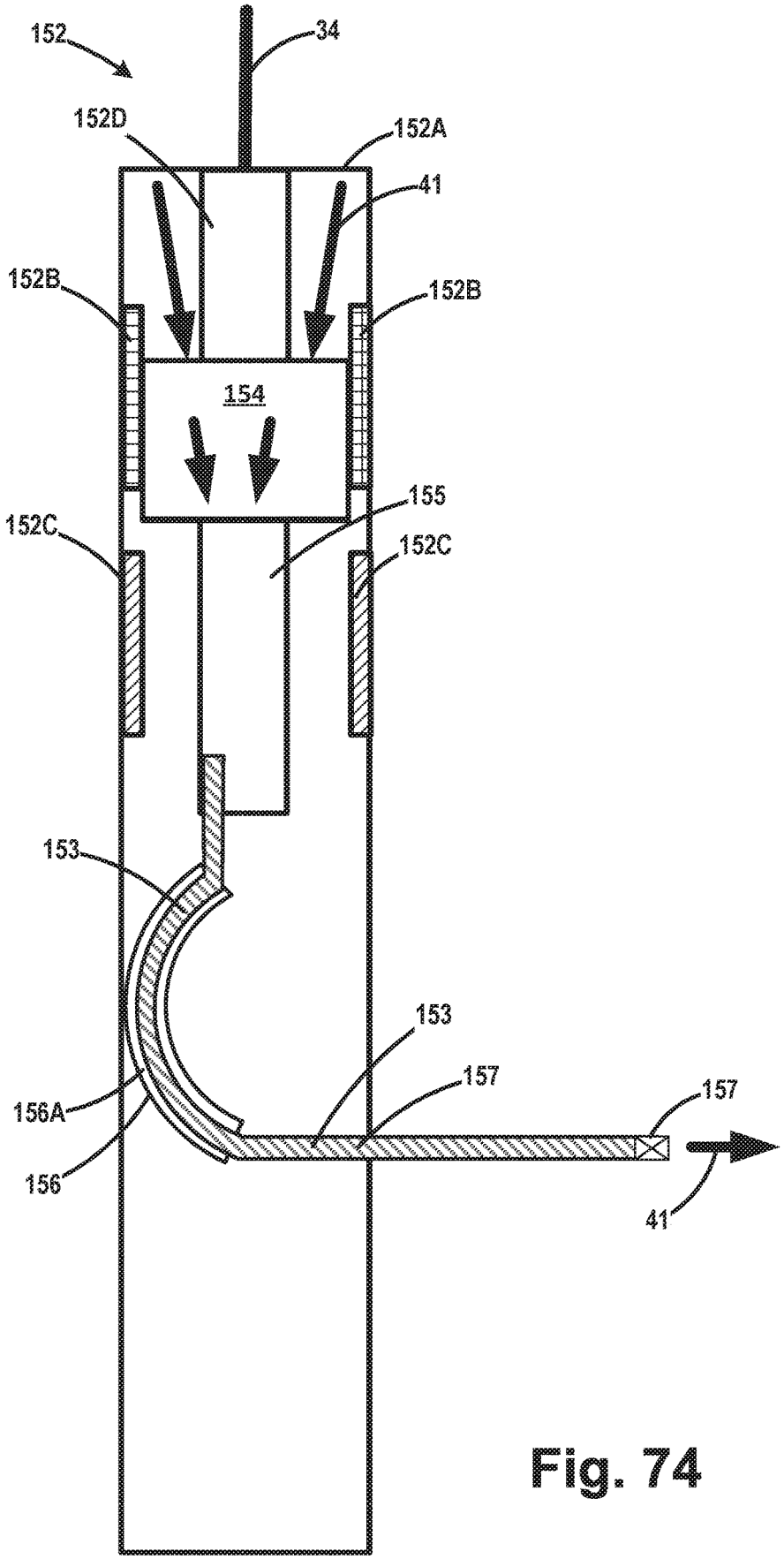

FIGS. 72-74 depict yet another illustrative embodiment of a P&A system 10 disclosed herein. In this embodiment, in lieu of using the above-described firing guns 71 to define the various perforations (described above) in the various casing strings, a small radius side-boring or cutting device 152 will be actuated to cut openings in the casing strings at the desired locations through sleeved ports (or windows) opened by the tool 152 before side-boring commences. In some applications, portions of the lower segment 54 below the packer 66 may be omitted. In that situation, the cutting device 152 positioned below the packer 66 would have free access to the casing string walls. With reference to FIG. 72, the cutting device 152 is adapted to be positioned in the polished bore receptacle housing 134 that is positioned in the adapter 38. The cutting device 152 is adapted to be operatively coupled to the wireline 34. A plurality of wirelessly accessible tags 133A, 133B, 133C and 133D (generally referred to by the reference numeral 133) are positioned on the lower section 54 of the tool at the desired location so as to enable the cutting device 152 to be accurately positioned within the lower section 54. The location of the tags 133 may vary depending upon the particular well design and planned plugging operations, and they may be attached to the lower segment 54 prior to positioning the lower segment 54 downhole. The communication between the cutting device 152 and the tags 133 may be accomplished using any desired wireless communication technology, e.g., RFID-based technology. In this embodiment, the cutting device 152 may be actuated to cut various openings in the various casings strings in the same order that the perforation means 57, 59, 61 and 62 were fired in the previous embodiment, i.e., the cutting device 152 is first actuated to cut one or more first openings (not shown) at the first depth 63, then the cutting device 152 is actuated to cut one or more second openings (not shown) at the third depth 67 (i.e., above the packer 66), the cutting device 152 is then actuated to cut one or more third openings (not shown) at the second depth 65, and finally the cutting device 152 is actuated to cut one or more fourth openings (not shown) at the fourth depth 69. In this embodiment, the tool 50 does not include the ball-carrying housing 52 described above. As noted, in this embodiment of the tool 50, the perforation means 57, 59, 61 and 62 are omitted. Also, as noted above, in this embodiment, when actuated, the cutting device 152 may also cuts openings in the body 54A of the lower segment 54 of the tool.

With reference to FIG. 73-74, the cutting device 152 comprises a body 152A, an inflatable packer seal 152B, a plurality of retractable anchor slips 152C and an overall controller 152D. The controller 152D is operatively coupled to the wireline 34. The cutting device 152 also comprises a flexible pipe 153, a fluid filter 154, an axial direction drive motor 155 that is adapted to apply downward force and torque to the flexible pipe, a diverter shoe 156 (a solid cylindrical body with hook curved hole machined passageway 156A) which in turn structurally supports and redirects the downward motion of the flex pipe 153 to horizontal movement of the flex pipe 153 as it exits the diverter shoe 156. At the distal end of the flex pipe 153 is a fluid outlet connected to a side boring drill bit 157 that comprises at least one rotating cutter head (not separately shown). FIG. 73 depicts the device 152 with the flex pipe 153 in the fully retracted position within the device 152. FIG. 74 depicts the device 152 after the motor 155 has been actuated so as to drive the flex pipe 153 downward thereby forcing the flex pipe 153 and the side boring drill bit 157 horizontally outward such that the at least one rotating cutter head of the side boring drill bit 157 contacts the casing at the desired location(s). The motor 155 also causes rotation of the rotating cutter head of the side boring drill bit 157 thereby allowing the casing to be cut as the side boring drill bit 157 is continuously urged radially outward as cutting progresses by virtue of the downward force applied to the flexible pipe 153 during the cutting process. In the depicted example, the cutting device 152 is lowered to its proper depth in the well and subsequently anchored and sealed to the inner wall of the casing string 20. Power is transmitted through the wireline 34 to the motor 155, which in turn transmits torque and radial outward force through the flex tube 153 to the side boring drill bit 157. The size of the rotating cutter head of the side boring drill bit 157 cutting heads 152X may vary, e.g., on the order of about 1.27-2.5 cm (0.5-2.0 inches) in diameter. As noted above, FIG. 74 simplistically depicts the cutting device 152 with only the flex pipe 13 and the side boring drill bit 157 in their fully extended position wherein the cutting device 152 may be used to cut the desired openings in one or more casing strings. After the bit 156 has penetrated through the wall of the casing strings) 22, 20, etc., and communication has been established, fluids 41 may be circulated through the inlet 35 of the well control package 14 down to the tool 150, through the filter 154, flex pipe 153 and bit 156 into the newly drilled port in the casing(s). At that point, a pressure test is conducted against the production casing shoe to check for formation continuity and the potential for fluid leak-off. If the pressure test reveals the potential for fluid leak-off, then cement may be pumped into through first openings and into the formation adjacent the first openings, i.e., cement may be bull-headed into the formation at this location.

This embodiment of the tool 50 may be employed in ways that are similar to the embodiment shown in FIGS. 62-71, thus reference will be made to those drawings so as not to overly complicate the presentation herein. Initially, much like in FIG. 66, the tool landing structure 40 was positioned in the well using the above-described landing head 100 and ROV wherein the casing hanger 40 simply rests on the casing hanger 42 below. Thereafter, the landing head 100 was removed using the ROV 102. Next, the well control package 14 was lowered and locked to the wellhead housing 15 by actuating the connector 30. At this point, the various ram(s) remain completely open. Next, the polished bore receptacle housing 134 (with the cutting device 152 positioned therein) was lowered through the well control package 14 into the polished bore recess 38A in the adapter 38. At that point, the seal rams) were energized so as to seal around the polished bore receptacle housing 134. After this point, the packer 66 was set and pressure tested from above and below as described above.

At that point, similar to FIG. 67, the cutting device 152 was lowered into the lower section 54 to a location proximate the first depth 63 in the well 12. The cutting device 152 may be accurately positioned within the well 12 by sensing the location of the sensor 133A that is positioned at a location that approximately level with the first depth 63. At that point, the cutting device 152 is actuated thereby driving one or more of the rotating cutter heads of the side boring drill bit 157 into engagement with the body 54A of the lower segment and thereafter the production casing 22 so as to thereby form one or more first openings (not shown) in the production casing and exposing the B annulus. The first openings firmed by the cutting device 152 correspond to and serves a similar function to the above-described openings 106 in the production casing 22. At that point, a pressure test is conducted against the production casing shoe to check for formation continuity and the potential for fluid leak-off if the pressure test reveals the potential for fluid leak-off, then cement may be pumped into through first openings and into the formation adjacent the first openings, i.e., cement may be bull-headed into the formation at this location.

At this point, similar to what is shown in FIG. 68, the cutting device 152 was raised up within the lower segment 54 to a location proximate the third depth 67, i.e., above the packer 66. The culling device 152 may be accurately positioned within the well 12 by sensing the location of the sensor 1331) that is positioned at a location that approximately even with the third depth 67. At that point, the cutting device 152 is actuated thereby driving the side boring drill bit 157 into engagement with the body 54A of the lower segment and thereafter with the production casing 22 so as to thereby form one or more second openings (not shown) in the production casing 22 above the packer 66 and exposing the B annulus. The second openings formed by the cutting device 150 correspond to and serves a similar function to the above-described openings 110 in the production casing 22. This operation also creates the above-described. B annulus circulation path 85 (see FIG. 51). Next, the cutting device 152 was retrieved into the polished bore receptacle housing 134. At that point, a desired amount of plug material, e.g., cement or a resin material, was pumped into the well 12 until such time the plug material flowed out of the lower first openings (similar to the openings 106) and into the B annulus. At that point, pressure was applied to "squeeze" the plug material, and the plug material was allowed to set. These operations result in above-described balanced first plug 112 that seals off both the A and B annuli.

Next, similar to the process shown in FIG. 69, the cutting device 152 was lowered from the polished bore receptacle housing 134 into the lower segment 54 to a location proximate the second depth 65. The cutting device 152 may be accurately positioned within the well 12 by sensing the location of the sensor 133B that is positioned at a location that approximately level with the second depth 65. At that point, the cutting device 152 is actuated thereby driving the side boring drill bit 157 into engagement with the body 54A of the lower segment and thereafter with the production casing 22 so as to thereby form one or more third openings (not shown) in the production casing 22, the first plug 112 and the intermediate casing 20 and thereby exposing the C annulus. The third openings formed by the cutting device 152 correspond to and serves a similar function to the above-described openings 116 in the production casing 22 and in the intermediate casing 20. At that point, a pressure test is conducted against the production casing shoe and the intermediate casing shoe to check for formation continuity and the potential for fluid leak-off. If the pressure test reveals the potential for fluid leak-off, then cement may be pumped into through first openings and into the formation adjacent the first openings, i.e., cement may be bull-headed into the formation at this location.

Thereafter, similar to the process shown in FIG. 70, the cutting device 152 was raised up within the lower segment 54 to a location proximate the fourth depth 69, i.e., above the packer 66. The cutting device 152 may be accurately positioned within the well 12 by sensing the location of the sensor 133E that is positioned at a location that approximately even with the fourth depth 69. At that point, the cutting device 152 is actuated thereby driving the side boring drill bit 157 into engagement with the body 54A of the lower segment and thereafter with the production casing 22 and the intermediate casing 20 so as to thereby form one or more fourth openings (not shown) in the production casing 22 and the intermediate casings 20 above the packer 66 and exposing the C annulus. The fourth openings formed by the cutting device 152 correspond to and serves a similar function to the above-described openings 120 in the production casing 22 and the intermediate casing 20. This operation also creates the above-described C annulus circulation path 87 (see FIG. 44). Next, the cutting device 152 was retrieved into the polished bore receptacle housing 134. At that point, a desired amount of plug material, e.g., cement or a resin material, was pumped into the well 12 until such time the plug material flowed out of the lower third openings and into the B and C annuli. At that point, pressure was applied to "squeeze" the plug material, and the plug material was allowed to set. These operations result in above-described balanced second plug 120 that seals off the A, B and C annuli.

Thereafter, the cutting device 152 was lowered from within the polished bore receptacle housing 134 into the lower segment 54 to a location proximate the cutting means 55. At that point, a signal is sent via the wireline 34 to cause the cutting device 152 to send a wireless signal to the receiver 133E so as to actuate the cutting means 55 as and cut the lower segment 54. The cutting device 152 may then be retrieved into the polished bore receptacle housing 134, the seal ram(s) may be de-energized and the polished bore receptacle housing 134 and cutting device 150 may be retrieved to the surface using the wireline 34. Thereafter, the various activities described above in connection with FIGS. 58-61 may be performed.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A system for forming an upper plug in a well, the system, comprising:

a lower tool segment comprising a landing structure that is adapted to land within a wellhead housing and contact a structure positioned in the wellhead housing;

a well control package that is adapted to be positioned above the lower tool segment positioned within the wellhead housing and coupled to the wellhead housing, the well control package comprising at least one seal ram;

an upper tool segment that is adapted to be positioned through the well control package and operatively coupled to the lower tool segment, wherein the at least one seal ram is adapted to engage an outer surface of the upper tool segment; and at least one cutting means that is coupled to the lower segment and adapted to be actuated to cut at least one opening in at least one section of casing within the well.

2. The system of claim 1, further comprising:

an adapter that is operatively coupled to a bottom of the tool landing structure, the adapter comprising a polished bore recess and a bottom opening, wherein a first end of the upper tool segment is adapted to be positioned within the polished bore recess, the at least one seal ram that is adapted to engage an outer surface of a second end of the upper tool segment and a first end of the lower tool segment is adapted to be operatively coupled to the bottom opening; and a packer coupled to the lower tool segment.

3. The system of claim 1, wherein the landing structure is mechanically coupled and secured to the structure positioned in the wellhead housing.

4. The system of claim 1, wherein the at least one cutting means comprises a plurality of perforation means that are positioned on the lower tool segment and axially spaced apart from one another on the lower tool segment.

5. The system of claim 4, wherein a first one of the plurality of perforation means is positioned on the lower tool segment below the packer while a second one of the plurality of pressure actuatable perforation means is positioned on the lower tool segment below the tool landing structure and above the packer.

6. The system of claim 4, wherein at least one of the perforation means comprises at least one perforation gun.

7. The system of claim 4, wherein the plurality of perforation means are pressure actuatable perforation means.

8. The system of claim 4, wherein the plurality of perforation means are electrically actuatable perforation means.

9. The system of claim 4, wherein the perforation means are electrically actuatable perforation means and wherein the system further comprises:

a plurality of wireless receivers, each of which is individually associated with one of the electrically actuatable perforation means; and an actuation tool that is adapted to be positioned within the upper tool segment, the actuation tool being sized and configured to permit its movement into and within the lower tool segment, the actuation tool being adapted to send a wireless signal to one of the wireless receivers to actuate its associated electrically actuatable perforation means.

10. The system of claim 9, wherein the actuation tool comprises:

an inflatable packer;

a plurality of retractable anchor slips;

a plurality of RFID-based sensors and controls; and a controller that is adapted to be operatively coupled to a wireline.

11. The system of claim 1, wherein the at least one cutting means comprises a plurality of pressure actuatable perforation means and wherein the system further comprises a ball housing that is positioned within the upper tool segment, the ball housing being adapted to hold a plurality of balls that are adapted to be individually released, wherein each individually released ball enables actuation of one of the plurality of pressure actuatable perforation means.

12. The system of claim 11, wherein the system further comprises a ball landing seat that is releasably secured within the lower tool segment, wherein when a ball is landed in the ball landing seat pressure within the lower tool segment may be increased so as to release the ball landing seat from the lower tool segment thereby allowing the ball landing seat to travel further down the lower tool segment.

13. The system of claim 11, wherein the system further comprises a split-ring ball landing seat that is releasably secured to a sliding sleeve positioned within the lower tool segment, the body of the lower tool segment comprising a ball recess, wherein when a ball is landed in the split-ring ball landing seat pressure within the lower tool segment may be increased so as to release the split-ring ball landing seat from the sliding sleeve thereby allowing the split-ring ball landing seat to travel further down the lower tool segment until the split-ring ball landing seat is aligned with the ball recess, wherein at least a portion of the split-ring ball landing seat is adapted to expand into the split-ring ball landing seat.

14. The system of claim 13, further comprising a split-ring ratchet sleeve positioned under the split-ring ball landing seat, the split-ring ratchet sleeve comprising a longitudinal slot and a plurality of teeth formed on an outer surface of the split-ring ratchet sleeve that are adapted to engage a plurality of internal teeth formed on an inner surface of the body of the lower tool segment.

15. The system of claim 11, wherein the system further comprises a ceramic ball seat that is releasably secured to a sliding sleeve positioned within the lower tool segment, the ceramic ball seat comprising a tail, wherein an outer surface of the ceramic ball seat is under compressive stress while interior portions of the ceramic ball seat are under tensile stress, the lower tool segment comprising a shoulder, wherein when a ball is landed in the ceramic ball seat pressure within the lower tool segment may be increased so as to release the ceramic ball seat from the sliding sleeve thereby allowing ceramic ball seat to travel further down the lower tool segment until the tail engages the shoulder and breaks, thereby disintegrating the ceramic ball seat.

16. The system of claim 1, wherein the at least one cutting means comprises a cutting device that is adapted to be positioned within the upper tool segment, the cutting device being sized and configured to permit its movement into and within the lower tool segment, the cutting device comprising at least one extendable flexible pipe having at least one side boring drill bit positioned at a distal end thereof, the at least one side boring bit being adapted to be actuated so as to cut the at least one opening in the at least one section of casing.

17. The system of claim 16, wherein the at least one side boring drill bit comprises a plurality of cutting heads that are each adapted to be individually actuated so as to cut the at least one opening in the at least one section of casing.

18. The system of claim 16, wherein the cutting device further comprises a motor that is operatively coupled to the flexible pipe.

19. The system of claim 1, wherein the tool landing structure has an outside diameter that is less than an inside diameter of the high-pressure wellhead.

20. The system of claim 1, wherein the tool landing structure comprises one of a casing hanger, a plate, or a wear bushing with a plurality of flow passages defined therein.

21. The system of claim 1, wherein the structure positioned in the wellhead comprises one of a casing hanger or a wear bushing.

22. The system of claim 1, wherein the tool landing structure comprises a 178 mm (7 inch) casing hanger and the structure positioned in the wellhead comprises a 244 mm (9⅝ inch) casing hanger.

23. A method of forming an upper plug in a well, the method, comprising:

positioning a lower tool segment within a wellhead housing, the lower tool segment comprising a landing structure that is adapted to land within the wellhead housing and contact a structure positioned in the wellhead housing and at least one cutting means that is adapted to be actuated to cut at least one opening in at least one section of casing within the well;

after positioning the lower tool segment within the wellhead housing, operatively coupling a well control package to the wellhead housing, the well control package comprising at least one seal ram;

inserting an upper tool segment through the well control package and into operative engagement with the lower tool segment; and urging the at least one seal ram into engagement with an outer surface of the upper tool segment.

24. The method of claim 23, further comprising mechanically coupling the landing structure to the structure positioned in the wellhead housing.

25. The method of claim 23, wherein the at least one cutting means comprises a plurality of actuatable perforation means that are positioned on the lower tool segment and axially spaced apart from one another on the lower tool segment and wherein the method further comprises individually actuating the perforation means one at a time in a desired sequence.

26. The method of claim 23, wherein the well comprises A and B annuli, wherein the at least one cutting means comprises a first and second actuatable perforation means that are positioned on the lower tool segment and wherein the method further comprises:

energizing a packer positioned on the lower tool segment such that the packer engages a casing positioned in the well;

actuating the first perforation means that is positioned on the lower tool segment below the packer so as to form a first opening in the casing below the packer that establishes fluid communication between the A and B annuli; and after actuating the first perforation means, actuating the second perforation means that is positioned on the lower tool segment below the tool landing structure and above the packer so as to form a second opening in the casing above the packer that establishes a fluid circulation path between the A and B annuli.

27. The method of claim 26, wherein the method further comprises:

circulating a fluid comprising a plug material downwardly within the lower tool segment, out of the first opening into the B annulus, up the B annulus, through the second opening and into the A annulus, through a plurality of openings formed in the tool landing structure and out of an opening in the well control package; and allowing a quantity of the plug material to set so as to form a first plug that extends through the first opening and into the B annulus.

28. The method of claim 27, wherein the well further comprises a C annulus and wherein the at least one cutting means comprises a third and fourth actuatable perforation means that are positioned on the lower tool segment, the method further comprises:

after forming the first plug, actuating the third perforation means that is positioned on the lower tool segment below the packer and above the first perforation means so as to form a third opening in the casings below the packer that establishes fluid communication between the A and C annuli, wherein the third opening is formed such that it extends through the first plug; and after actuating the third perforation means, actuating the fourth perforation means that is positioned on the lower tool segment above the second perforation means so as to form a fourth opening in the casings above the second opening, wherein the fourth opening establishes a fluid circulation path between the A, B and C annuli of the well.

29. The method of claim 28, further comprising:

circulating a fluid comprising a plug material downwardly within the lower tool segment, out of the third opening into the C annulus, up the C annulus through the fourth opening and into the A annulus, through the plurality of openings formed in the tool landing structure and out of the opening in the well control package; and allowing a quantity of the plug material to set so as to form a second plug that extends through the third opening and into the C annulus, wherein a portion of the second plug is positioned above a portion of the first plug that is positioned within the A annulus.

30. The method of claim 29, further comprising:

releasing the least one seal ram from engagement with the outer surface of the upper tool segment;

retrieving the upper tool segment through the well control package to a surface location;

removing the well control package from the wellhead housing; and cutting the lower tool segment at a location below the tool landing structure and removing the portions of the lower tool segment above the cut from within the wellhead housing.

31. The method of claim 26, wherein the first and second perforation means are pressure actuatable perforation means, each of which is comprised of at least one perforation gun.

32. The method of claim 31, wherein further comprising a ball housing that is positioned within the upper tool segment, the ball housing being adapted to hold a plurality of balls that are adapted to be individually released, wherein the method further comprises individually releasing a ball from the ball housing so as to enable actuation of only one of the first and second pressure actuatable perforation means.

33. The method of claim 26, wherein the first and second perforation means are electrically actuatable perforation means comprised of at least one perforation gun, wherein the lower tool segment comprises a plurality of wireless receivers, each of which is individually associated with one of the electrically actuatable perforation means, the method further comprising:

moving an actuation tool from its initial position within the upper tool segment down into the lower tool segment such that the actuation tool is positioned at a location within the lower tool segment such that it can communicate with at least one of the wireless receivers;

energizing the actuation tool so as to send a wireless signal to only one of the wireless receivers to actuate its associated electrically actuatable perforation means.

34. The method of claim 26, wherein the at least one cutting means comprises a cutting device that is positioned within the upper tool segment, the cutting device comprising at least one extendable flexible pipe having at least one side boring drill bit positioned at a distal end thereof, the side boring drill bit being adapted to be actuated so as to cut the at least one opening in the at least one section of casing, wherein the method further comprises:

moving the cutting device from its initial position within the upper tool segment down into the lower tool segment such that the cutting device is positioned at a location within the lower tool segment corresponding to a desired location for the at least one opening;

actuating a motor of the cutting device so as to extend the at least one side boring drill bit into engagement with the at least one section of casing; and actuating at least one cutting head of the side boring drill bit so as to cut the at least one opening in the at least one section of casing.

* * * * *